US012449219B2

(12) United States Patent
Bundy et al.

(10) Patent No.: US 12,449,219 B2
(45) Date of Patent: Oct. 21, 2025

(54) FIREARM SUPPRESSOR AND SELF-TORQUING FEATURE

(71) Applicant: Maxim Defense Industries, LLC, St. Cloud, MN (US)

(72) Inventors: Travis Bundy, Ola, ID (US); Oddbjorn Eken, Prestfoss (NO)

(73) Assignee: Maxim Defense Industries, LLC, St. Cloud, MN (US)

( * ) Notice: Subject to any disclaimer, the term of this patent is extended or adjusted under 35 U.S.C. 154(b) by 0 days.

(21) Appl. No.: 17/823,509

(22) Filed: Aug. 30, 2022

(65) Prior Publication Data

US 2023/0175802 A1 Jun. 8, 2023

Related U.S. Application Data

(63) Continuation-in-part of application No. 29/812,871, filed on Oct. 25, 2021, now Pat. No. Des. 1,069,018,
(Continued)

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
(Continued)

(56) References Cited

U.S. PATENT DOCUMENTS 958,934 A * 5/1910 Maxim ..... F41A 21/30
89/14.4
2,143,596 A * 1/1939 Galliot ..... F41A 21/36
89/14.3
(Continued)

FOREIGN PATENT DOCUMENTS

CA 212226 10/2023
CA 212227 10/2023
(Continued)

OTHER PUBLICATIONS

International Search Report, International Application No. PCT/US2022/075711; mailed Aug. 4, 2023; pp. 3.
(Continued)

*Primary Examiner* — Troy Chambers
*Assistant Examiner* — Benjamin S Gomberg
(74) *Attorney, Agent, or Firm* — Law Office of Arthur M. Antonelli, PLLC

(57) ABSTRACT

A suppressor for a firearm may include a core and a tube. The tube may be arranged around the core. The core may have a first longitudinal axis and include a first proximal end, a first distal, and a first end cap disposed adjacent to the first proximal end. The first end cap may include a proximal end wall and an opening for receiving a barrel of a firearm. The opening for receiving the barrel of the firearm may extend from the first proximal end to a first interior end wall. A bore may extend from the first interior end wall to the proximal end wall. The core may further include a first static vane spaced from the proximal end wall along the first longitudinal axis, and an array of baffles aligned with the bore, the array of baffles being arranged between the first static vane and the distal end.

50 Claims, 56 Drawing Sheets

Related U.S. Application Data and a continuation-in-part of application No. 29/812,869, filed on Oct. 25, 2021, now Pat. No. Des. 1,020,965.

(60) Provisional application No. 63/238,757, filed on Aug. 30, 2021.

(58) Field of Classification Search
USPC ..... 89/14.2–14.4; 181/223
See application file for complete search history.

(56) References Cited

U.S. PATENT DOCUMENTS 2,351,037 A 6/1944 Green
4,375,136 A * 3/1983 Pedgonay ..... F41A 21/48 42/75.02
4,530,417 A 7/1985 Daniel
4,813,333 A 3/1989 Garris et al.
4,893,426 A 1/1990 Bixler
5,305,677 A 4/1994 Kleinguenther et al.
5,559,302 A 9/1996 Latka
RE35,381 E 11/1996 Rose
5,596,161 A * 1/1997 Sommers ..... F41A 21/34 89/14.3
5,631,438 A 5/1997 Martel
D384,389 S 9/1997 Cyktich
5,685,102 A 11/1997 Latka
D415,812 S 10/1999 Andrews, Jr. et al.
D415,813 S 10/1999 O'Quinn et al.
D425,184 S 5/2000 Lidgett
D435,623 S 12/2000 Andrews, Jr. et al.
6,374,718 B1 4/2002 Rescigno et al.
6,425,310 B1 7/2002 Champion
6,516,698 B1 2/2003 Poff, Jr.
6,722,254 B1 * 4/2004 Davies ..... F41A 21/36 42/1.06
6,820,530 B2 11/2004 Vais
D507,619 S 7/2005 Shiloni
D594,082 S 6/2009 O'Quinn
7,677,150 B2 3/2010 Dater et al.
D632,751 S 2/2011 Bowers et al.
7,891,282 B1 2/2011 DeGroat
7,905,171 B1 * 3/2011 Brittingham ..... F41A 21/30 89/14.4
D641,450 S 7/2011 Ding
D642,650 S 8/2011 Oliver
D643,087 S 8/2011 Oliver
7,987,944 B1 8/2011 Brittingham et al.
8,015,908 B2 9/2011 Kline et al.
D651,680 S 1/2012 DeGroat
8,087,338 B1 1/2012 Hines
8,096,222 B2 1/2012 Silvers
D657,012 S 4/2012 Woodell
8,156,855 B2 4/2012 Anderson
8,186,261 B2 5/2012 McNeill et al.
8,272,306 B1 9/2012 Smith
8,291,805 B1 10/2012 Quilligan
8,307,946 B1 11/2012 Johnston
D677,357 S 3/2013 Dueck et al.
8,387,299 B1 3/2013 Brittingham et al.
8,424,441 B2 4/2013 Brittingham et al.
D682,384 S 5/2013 Jaureguizar
D682,974 S 5/2013 Honigmann
D685,874 S 7/2013 Andrews et al.
8,474,361 B2 7/2013 Brittingham
8,505,431 B2 8/2013 Hines
8,505,680 B2 8/2013 Dueck
D694,355 S 11/2013 Hormann
8,714,300 B2 5/2014 Johansen
D709,140 S 7/2014 Coulter
D712,997 S 9/2014 Proske
8,820,473 B1 * 9/2014 White ..... F41A 21/34 89/14.4
8,881,862 B1 11/2014 Messer, Jr.
D719,646 S 12/2014 Melo
8,950,546 B2 2/2015 Shults et al.
D723,647 S 3/2015 Oliver
8,973,481 B2 3/2015 Dueck
8,978,818 B2 3/2015 Proske
D728,058 S 4/2015 Cheney
8,997,621 B1 4/2015 Dater et al.
D741,443 S 10/2015 Cheney
D743,007 S 11/2015 Kimura
9,175,919 B2 11/2015 Russell et al.
9,207,033 B2 * 12/2015 Vais ..... F41A 21/30
9,239,201 B1 1/2016 Green
D761,373 S 7/2016 Lessard
D764,621 S 8/2016 Dueck et al.
9,410,761 B2 8/2016 Morris et al.
D767,076 S 9/2016 Bebee
D767,706 S 9/2016 Shults et al.
D773,587 S 12/2016 Underwood
9,513,078 B1 12/2016 Fulton et al.
D776,226 S 1/2017 Green
D778,386 S 2/2017 Farthing et al.
D778,387 S 2/2017 Farthing
D779,618 S 2/2017 Farthing
D782,598 S 3/2017 Faxon
9,658,019 B2 5/2017 Smith
D788,873 S 6/2017 Wiley
D789,480 S 6/2017 Olsen
D790,647 S 6/2017 Miller, III
D790,648 S 6/2017 Pezeshk
D792,545 S 7/2017 Green et al.
9,709,354 B2 7/2017 Larue
9,739,559 B2 8/2017 Bush
9,739,560 B1 8/2017 Salvador
9,746,267 B2 8/2017 Smith
9,791,247 B2 10/2017 Parker
D802,699 S 11/2017 Shults
D802,700 S 11/2017 Shults
D807,461 S 1/2018 Cheng et al.
D808,490 S 1/2018 Meinert
D810,224 S 2/2018 Lessard
D811,513 S 2/2018 Payton
9,933,224 B2 4/2018 Dorne et al.
9,958,227 B2 5/2018 Whitson
10,024,617 B1 7/2018 Moore et al.
D825,845 S 8/2018 Dittmer et al.
10,060,695 B2 8/2018 Slack
10,119,779 B1 11/2018 Miele
10,156,411 B2 12/2018 Thompson et al.
D837,922 S 1/2019 McDonald et al.
10,184,744 B2 1/2019 Young et al.
10,184,745 B1 1/2019 Fulton
D842,419 S 3/2019 Edminster et al.
10,228,210 B2 3/2019 Parker
10,281,228 B1 5/2019 Marfione
10,330,417 B2 6/2019 Reis Green et al.
10,330,419 B1 6/2019 HIderby
10,345,070 B1 7/2019 Lepka
10,393,463 B1 * 8/2019 Sanders ..... F41A 21/34
D860,372 S 9/2019 Riley
10,480,884 B2 11/2019 Smith
10,480,888 B2 11/2019 Barrett
10,598,458 B1 3/2020 Cler
10,605,558 B1 3/2020 Marfione et al.
10,619,962 B1 4/2020 Hatfield
10,663,246 B1 5/2020 Gelernter
D886,230 S 6/2020 Green et al.
10,724,569 B2 7/2020 Windfeldt et al.
10,724,817 B2 7/2020 Miele
10,753,699 B2 * 8/2020 Klett ..... F41A 21/30
10,801,796 B2 10/2020 Kras
10,809,032 B1 * 10/2020 Thomas ..... F41A 21/44
10,969,187 B2 4/2021 DeJessa
10,996,015 B2 5/2021 Lee
11,035,637 B2 6/2021 Barney
11,041,687 B2 6/2021 Wheeler et al.
11,085,725 B2 8/2021 Moore
11,092,399 B2 8/2021 Washburn, III et al.
11,156,423 B2 10/2021 Winterseth
11,221,189 B1 1/2022 Couvillion

(56) References Cited

U.S. PATENT DOCUMENTS

| | | | | |
|---|---|---|---|---|
| 11,243,040 | B2 | 2/2022 | Honigmann et al. | |
| 11,255,623 | B2 | 2/2022 | Kras | |
| 11,287,207 | B2 | 3/2022 | DeJessa | |
| D953,470 | S | 5/2022 | Windfeldt et al. | |
| 11,326,849 | B2 | 5/2022 | Edminster | |
| D955,524 | S | 6/2022 | Spector et al. | |
| D963,100 | S | 9/2022 | Green et al. | |
| D969,258 | S | 11/2022 | DeJessa | |
| D972,476 | S | 12/2022 | Gromova | |
| 11,530,890 | B2 | 12/2022 | Wheeler et al. | |
| 11,609,058 | B2 * | 3/2023 | Petersen | F41A 21/325 |
| 11,614,297 | B2 | 3/2023 | Wheeler et al. | |
| 11,680,764 | B1 | 6/2023 | Bray | |
| 11,686,547 | B2 | 6/2023 | Kras | |
| 11,725,897 | B2 | 8/2023 | Washburn, III et al. | |
| 11,774,205 | B1 | 10/2023 | Kunsky | |
| D1,019,868 | S | 3/2024 | Grob | |
| D1,020,965 | S | 4/2024 | Bundy et al. | |
| D1,035,816 | S | 7/2024 | Bundy et al. | |
| D1,036,611 | S | 7/2024 | Bundy et al. | |
| D1,057,070 | S | 1/2025 | Bundy et al. | |
| D1,069,018 | S | 4/2025 | Bundy et al. | |
| 12,298,096 | B2 | 5/2025 | Bundy et al. | |
| 12,313,360 | B2 * | 5/2025 | Sjögren | F41A 21/30 |
| 2007/0107590 | A1 * | 5/2007 | Silvers | F41A 21/34 89/14.4 |
| 2008/0148928 | A1 | 6/2008 | McClellan | |
| 2009/0139795 | A1 * | 6/2009 | Brittingham | F41A 21/30 181/223 |
| 2010/0294118 | A1 | 11/2010 | Hortobagyi | |
| 2010/0313743 | A1 | 12/2010 | Dueck et al. | |
| 2011/0072958 | A1 * | 3/2011 | Brittingham | F41A 21/34 89/14.2 |
| 2011/0186377 | A1 | 8/2011 | Kline et al. | |
| 2011/0271575 | A1 | 11/2011 | Overbeek Bloem et al. | |
| 2012/0048100 | A1 * | 3/2012 | Davies | F41A 21/34 89/14.2 |
| 2012/0103176 | A1 | 5/2012 | Latka | |
| 2012/0167749 | A1 * | 7/2012 | Young | F41A 21/30 89/14.3 |
| 2012/0228052 | A1 | 9/2012 | Findlay | |
| 2012/0272818 | A1 * | 11/2012 | Dueck | F41A 21/30 29/896.2 |
| 2012/0279381 | A1 | 11/2012 | Landolt | |
| 2013/0312592 | A1 | 11/2013 | Storrs et al. | |
| 2014/0237881 | A1 | 8/2014 | Mack | |
| 2014/0262604 | A1 | 9/2014 | Proske | |
| 2014/0262605 | A1 | 9/2014 | Washburn, III et al. | |
| 2015/0260473 | A1 | 9/2015 | Barney | |
| 2016/0003570 | A1 | 1/2016 | Tonkin | |
| 2016/0054086 | A1 * | 2/2016 | Westlake | F41A 21/30 89/14.4 |
| 2016/0109205 | A1 | 4/2016 | Coppinger | |
| 2016/0161203 | A1 * | 6/2016 | Wilson | B23K 35/0272 89/14.3 |
| 2016/0370157 | A1 | 12/2016 | Parker | |
| 2017/0067711 | A1 * | 3/2017 | Slack | F41A 21/30 |
| 2017/0102201 | A1 | 4/2017 | Bush | |
| 2017/0160034 | A1 | 6/2017 | Parker | |
| 2017/0205175 | A1 | 7/2017 | Garst et al. | |
| 2017/0261281 | A1 | 9/2017 | Salvador | |
| 2017/0321984 | A1 * | 11/2017 | Palu | F41A 21/34 |
| 2018/0031346 | A1 | 2/2018 | Washburn, III et al. | |
| 2018/0058789 | A1 * | 3/2018 | Dorne | F41A 21/30 |
| 2018/0120045 | A1 | 5/2018 | Rost | |
| 2018/0128566 | A1 | 5/2018 | Reis Green | |
| 2018/0252489 | A1 | 9/2018 | Parker | |
| 2018/0299222 | A1 | 10/2018 | Albino | |
| 2018/0299223 | A1 | 10/2018 | Barrett | |
| 2018/0321008 | A1 | 11/2018 | Barney | |
| 2019/0063860 | A1 * | 2/2019 | Walker | F41A 21/30 |
| 2019/0072354 | A1 | 3/2019 | Lee | |
| 2019/0078852 | A1 | 3/2019 | Peknik | |
| 2019/0128632 | A1 | 5/2019 | Christanl et al. | |
| 2019/0226787 | A1 | 7/2019 | Orne | |
| 2019/0249942 | A1 | 8/2019 | Dunham | |
| 2019/0293376 | A1 | 9/2019 | Crown | |
| 2019/0353446 | A1 * | 11/2019 | Kras | F41A 21/325 |
| 2020/0064099 | A1 * | 2/2020 | Young | F41A 21/28 |
| 2020/0072571 | A1 | 3/2020 | Washburn, III et al. | |
| 2020/0116450 | A1 * | 4/2020 | Ellison | F41A 21/30 |
| 2020/0224989 | A1 * | 7/2020 | Bundy | F41A 21/325 |
| 2020/0232740 | A1 | 7/2020 | Honigmann | |
| 2020/0232741 | A1 | 7/2020 | Hood, II | |
| 2020/0240736 | A1 | 7/2020 | Moore | |
| 2020/0248980 | A1 | 8/2020 | Bragais | |
| 2020/0284540 | A1 | 9/2020 | Doerr | |
| 2020/0284541 | A1 | 9/2020 | Poling | |
| 2021/0003360 | A1 | 1/2021 | Kras | |
| 2021/0018287 | A1 * | 1/2021 | Kada | F41A 21/30 |
| 2021/0254921 | A1 * | 8/2021 | Spector | F41A 21/34 |
| 2021/0310761 | A1 | 10/2021 | Sogaard | |
| 2021/0381792 | A1 | 12/2021 | Young | |
| 2021/0389074 | A1 | 12/2021 | Green et al. | |
| 2021/0389077 | A1 | 12/2021 | Turnblom | |
| 2022/0049920 | A1 | 2/2022 | Kras | |
| 2022/0057160 | A1 | 2/2022 | Johns | |
| 2022/0397361 | A1 | 12/2022 | DeJessa | |
| 2022/0397362 | A1 | 12/2022 | DeJessa | |
| 2022/0397363 | A1 | 12/2022 | DeJessa | |
| 2023/0175802 | A1 | 6/2023 | Bundy et al. | |
| 2024/0328738 | A1 | 10/2024 | Bundy et al. | |

FOREIGN PATENT DOCUMENTS

| | | |
|---|---|---|
| CH | 146859-0003 | 7/2022 |
| CH | 146859-0004 | 7/2022 |
| DE | 202022100864 U1 | 4/2022 |
| EM | 008962419-0001 | 4/2022 |
| EM | 008962427-0001 | 4/2022 |
| EM | 008962435-0001 | 4/2022 |
| EM | 009085772-0001 | 7/2022 |
| EM | 009085772-0002 | 7/2022 |
| GB | 6204550 | 4/2022 |
| GB | 6204551 | 4/2022 |
| GB | 6204552 | 9/2022 |
| GB | 6219496 | 10/2022 |
| IL | 68599 | 2/2022 |
| IL | 69107 | 5/2023 |
| IL | 69110 | 5/2023 |
| NO | 2022000000645-0003 | 7/2022 |
| NZ | 430784-0001 | 7/2022 |
| WO | WO 2017/102012 A1 | 6/2017 |
| WO | WO 2017/102132 A1 | 6/2017 |
| WO | WO 2023/064649 A2 | 4/2023 |
| WO | WO 2023/220485 A2 | 11/2023 |

OTHER PUBLICATIONS

Written Opinion of the International Searching Authority, International Application No. PCT/US2022/075711; mailed Aug. 4, 2023; pp. 7.

* cited by examiner

FIREARM SUPPRESSOR AND SELF-TORQUING FEATURE

CROSS REFERENCE TO RELATED APPLICATIONS

This application claims the benefit of U.S. Provisional Application No. 63/238,757 filed Aug. 30, 2021. This application is a continuation-in-part of U.S. patent application Ser. No. 29/812,869 filed Oct. 25, 2021. This application is a continuation-in-part of U.S. patent application Ser. No. 29/812,871 filed Oct. 25, 2021. The entire disclosure of each of the U.S. Patent applications mentioned in this paragraph is incorporated by reference herein.

FIELD OF THE INVENTION

The invention generally relates to firearm suppressors and a method of regulating gas flow during firearm operation. More particularly, the invention relates to a suppressor which may be threaded onto a barrel of a machine gun and which may further include a self-torquing feature. The self-torquing feature may interact with gas flow from operation of the firearm to torque the suppressor in a tightening direction with respect to the barrel to promote a secure and operable suppressor-muzzle interface.

BACKGROUND

Firearms may be operated by energy that is released from the firing of an ammunition cartridge. More particularly, detonation of a propellant within an ammunition cartridge may release energy that is transformed into mechanical work to induce a firearm's cycle of operation (feeding, chambering, locking, firing, unlocking, extracting, ejecting, cocking). Peak sound pressure level, spreading of pressure wave and other physical characteristics of the impulse noise from operating firearms may pose a hearing damage risk to an operator. Also, the audible signature of the firearm may enable detection of the presence and location of the operator. Accordingly, a need exists for new suppressors which may decrease the audible signature of a firearm.

SUMMARY

Hence, the present disclosure is generally directed toward a suppressor for a machine gun and a method for maintaining an operable muzzle-suppressor interface. More particularly, exemplary embodiments of a suppressor are disclosed which may include one or more self-torquing features. The self-torquing feature(s) may be configured and dimensioned to define one or more flow path(s) for firearm discharge gasses exiting the muzzle. The flow path(s) defined by the self-torquing feature(s) may generate a moment couple about the central axis of the suppressor. The torque or force of moment generated by the discharge gases transiting the device may be used to torque a threaded barrel-suppressor interface in a tightening direction to promote a secure and operable connection between the muzzle and the suppressor. For instance, a suppressor for a firearm may include a core having a first longitudinal axis, the core including a first proximal end, a first distal end spaced from the first proximal end along the first longitudinal axis, and a first end cap disposed adjacent to the first proximal end. The first end cap may include a proximal end wall. Additionally, the core may include an opening for receiving a barrel of a firearm, the opening extending from the first proximal end to a first interior end wall, the first interior end wall being disposed between the first proximal end and the proximal end wall. The core further may include a bore which is aligned with the first longitudinal axis, the bore extending from the first interior end wall to the proximal end wall. Moreover, the core may include a first static vane spaced from the proximal end wall along the first longitudinal axis, and an array of baffles aligned with the bore, the array of baffles being arranged between the first static vane and the distal end. The first static vane may include a first control surface and a second control surface for generating a moment torque about the first longitudinal axis. Also, the suppressor may include a tube arranged around the core.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
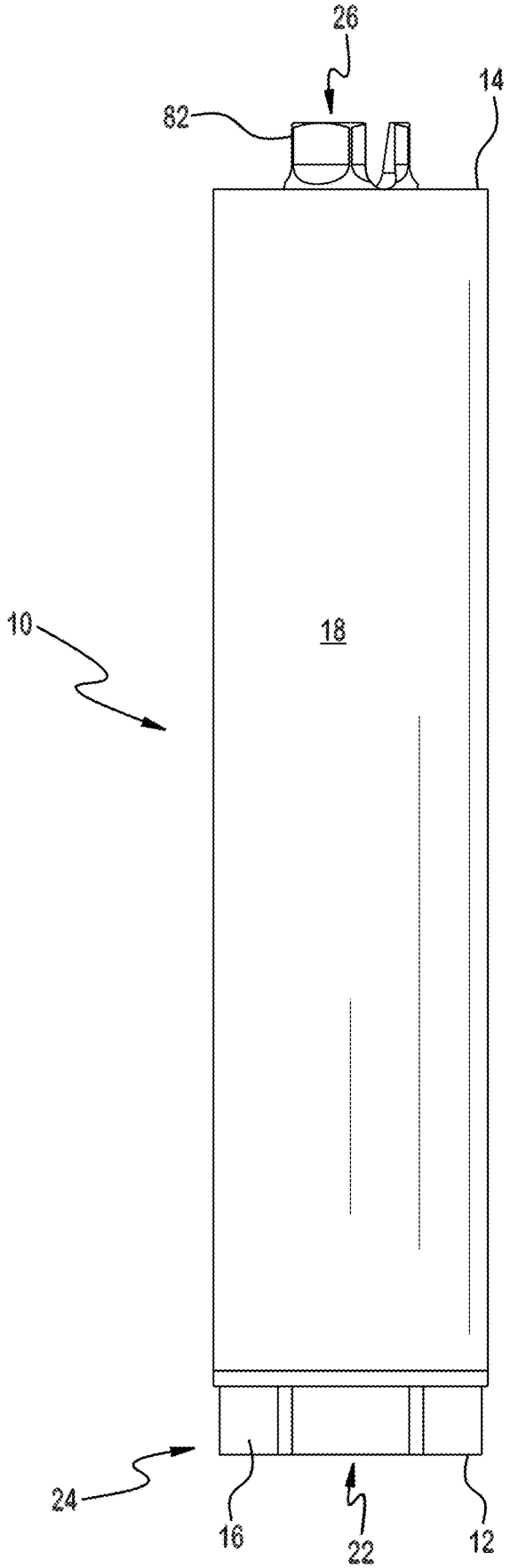
FIG. 1 is a plan view of a first exemplary embodiment of a suppressor.

FIG. 1 shows an exemplary embodiment of a suppressor 10. The suppressor 10 may include a proximal end 12 and a distal end 14. The proximal end 12 may include an endcap 16. The endcap may be connected to a tube 18. The tube may define a housing for internal baffles 20 (see e.g., FIG. 2) which may be configured and dimensioned to dissipate kinetic energy and reduce blast intensity of firearm discharge gasses. The endcap 16 may include an opening 22 for receiving the muzzle of a firearm. The surfaces of the endcap 16 may form a fitting 24 for a tool (e.g., a hex fitting). The distal end 14 of the suppressor may further include a discharge port 26. Also, a utility tool (e.g., a drive fitting, a wire cutter or both) 82 may be located around the discharge port.

Figure 2:
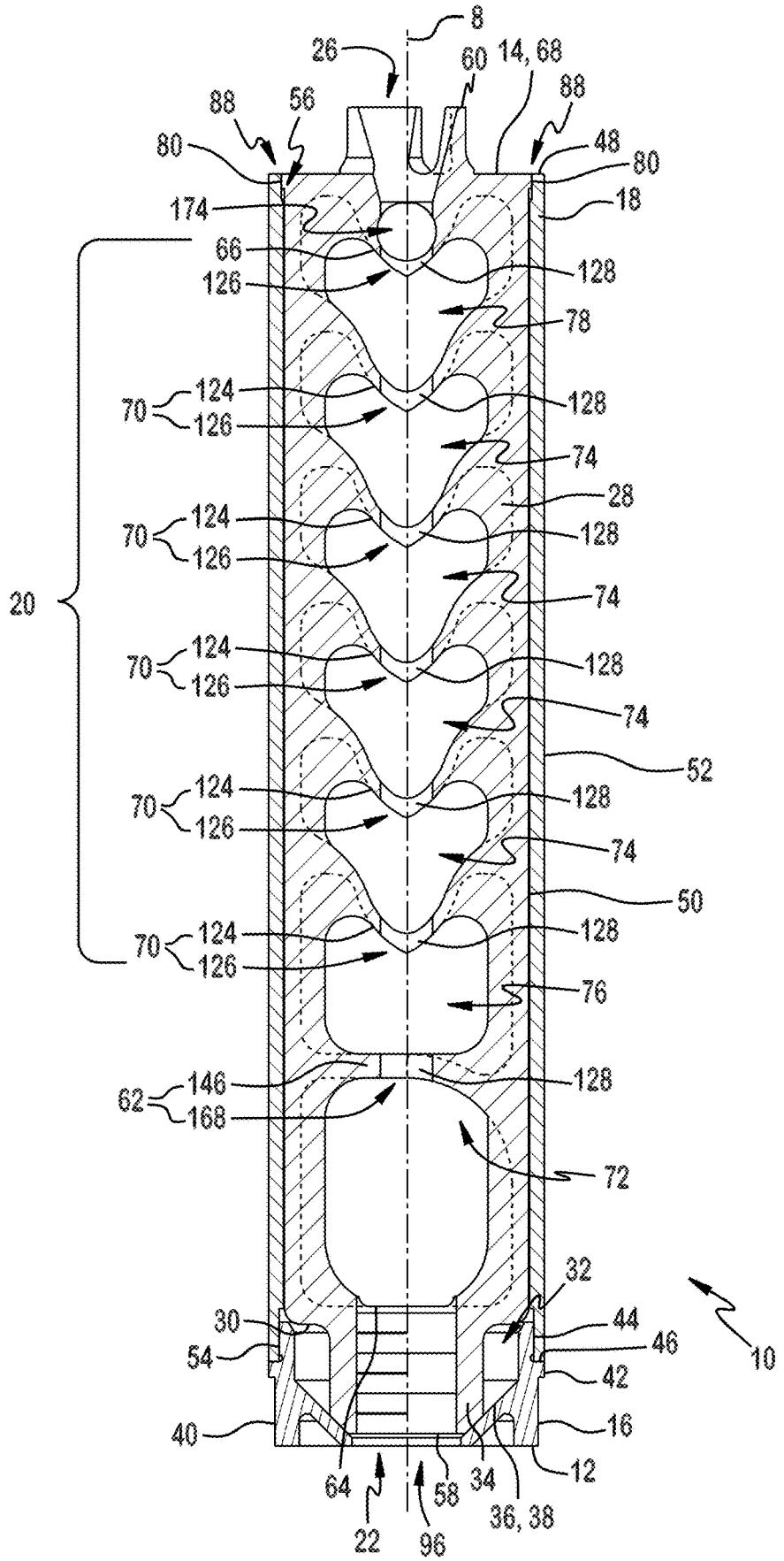
FIG. 2 is a cross-sectional view of FIG. 1 along a longitudinal axis of the suppressor.

As shown in FIG. 2, the suppressor 10 may include an endcap 16, a tube 18 connected to the endcap, and a core 28 arranged in the endcap and the tube. The endcap 16 may be tubular. The proximal end 12 may include a proximal opening 22 for receiving the muzzle end of a barrel. The distal end 30 of the endcap may include a distal opening 32 for receiving a proximal end portion 34 of the core 28. The endcap further may include an inner side wall 36 that extends from the proximal opening 22 to the distal opening 32. A portion of the inner sidewall 36 may define a frusto-conical surface 38. The endcap 16 further may include an exterior side wall 40 that extends from proximal end to the distal end of the endcap. The exterior side wall 40 may include a circumferential ledge 42. A segment 44 of the exterior side wall 40 between the distal end and the ledge may include a screw thread.

Additionally, the tube 18 may include a proximal end 46 and a distal end 48 and a longitudinal axis extending from the proximal end to the distal end. The tube 18 further may include an inner surface 50 extending from the proximal end 46 to the distal end 48, and an outer surface 52 extending from the proximal end 46 to the distal end 48. Generally, the outer surface may possess a maximum outer dimension, and the inner surface may possess a minimum inner dimension. For example, the outer surface may include a maximum outer diameter and the inner surface may include a minimum diameter. Moreover, a segment of the inner surface of the tube adjacent the proximal end may include a screw thread 54. The screw thread 54 may be configured and dimensioned to mate with the screw thread 44 on the endcap. Another segment of the inner surface of the tube 18 adjacent to the distal end 48 may include a notch or a taper 56.

Figure 3:
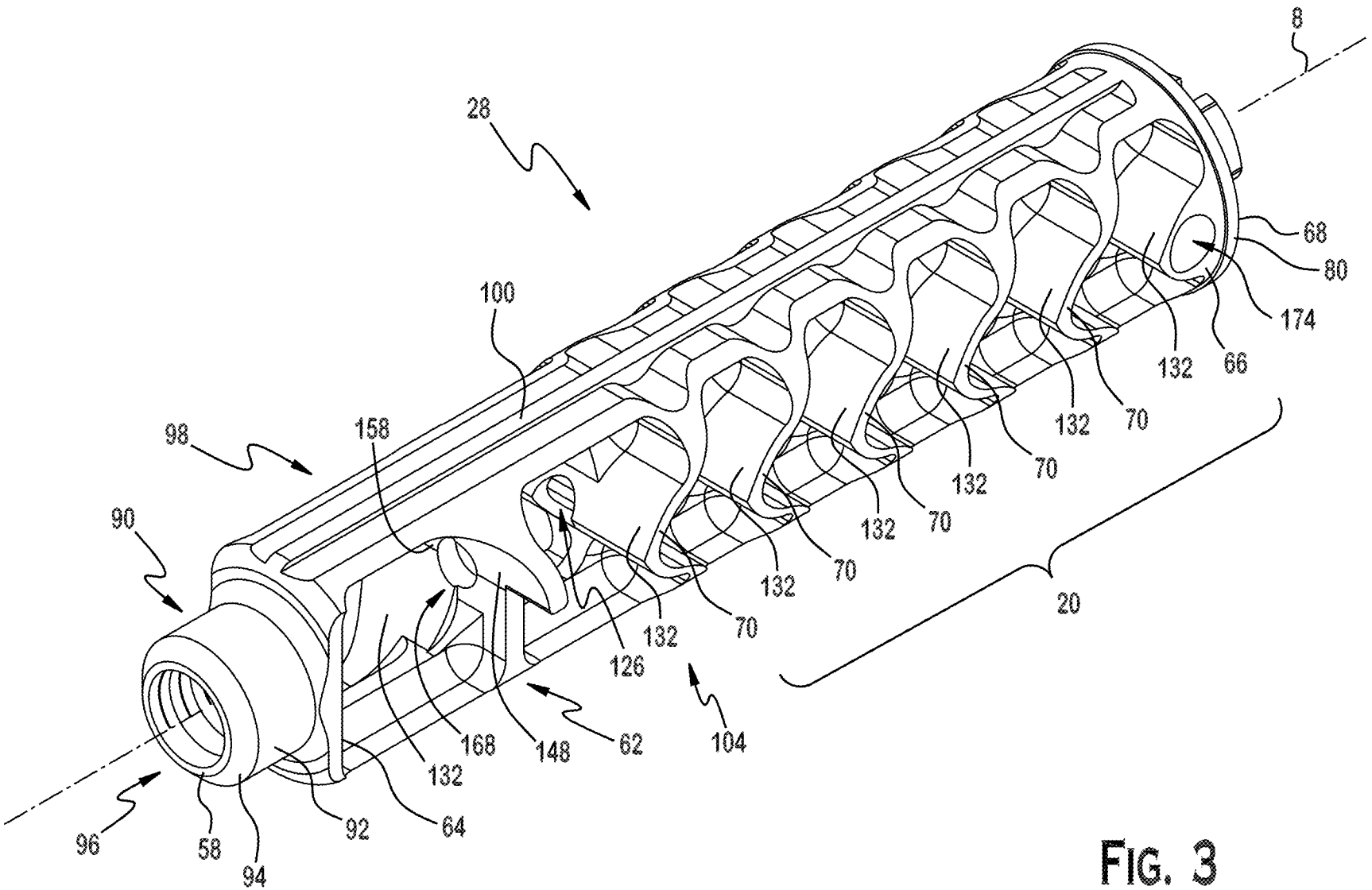
FIG. 3 is a perspective view of a first embodiment of a core for the suppressor of FIG. 1.

Referring to FIG. 3, internal components of the suppressor 10 may be formed from the core 28. For example, the core my be formed from a unitary structure (e.g., a mono-core). Generally, the core 28 may include a proximal end 58 that is configured and dimensioned to mate with the muzzle end of a firearm barrel and a distal end 60 which includes a discharge port 26 that allows a bullet or projectile fired from a weapon to exit the suppressor. The discharge port 26 may have a central axis. The core further may include a self-torquing feature (e.g., a torquing baffle or static vane) 62 adjacent to the proximal end wall 64, a quarter baffle 66 adjacent the distal end 68 wall, and a plurality of pressure modulation baffles 70 disposed between the self-torquing feature 62 and the quarter baffle 66. Referring to FIG. 2, The core 28, tube 18 and endcap 16 may be assembled to form a suppressor 10 that includes a blast chamber 72 between the proximal end wall 64 and the self-torquing feature 62, a series of pressure modulation chambers 74 between the respective baffles 70, 66 of the baffle array 20, an intermediate chamber 76 between the self-torquing feature 62 and the baffle array 20, and an exit chamber 78 between the last baffle of the baffle array and the distal end cap, including the quarter baffle. In this embodiment, the suppressor 10 may include four pressure modulation chambers 74. Although, the core 28 may be a unitary structure, the core may be formed from multiple parts or combined with other parts, including M-baffles K-baffles, or other baffle types. Hence, the self-torquing feature 62 may be incorporated into other suppressor designs and configurations.

Figure 4:
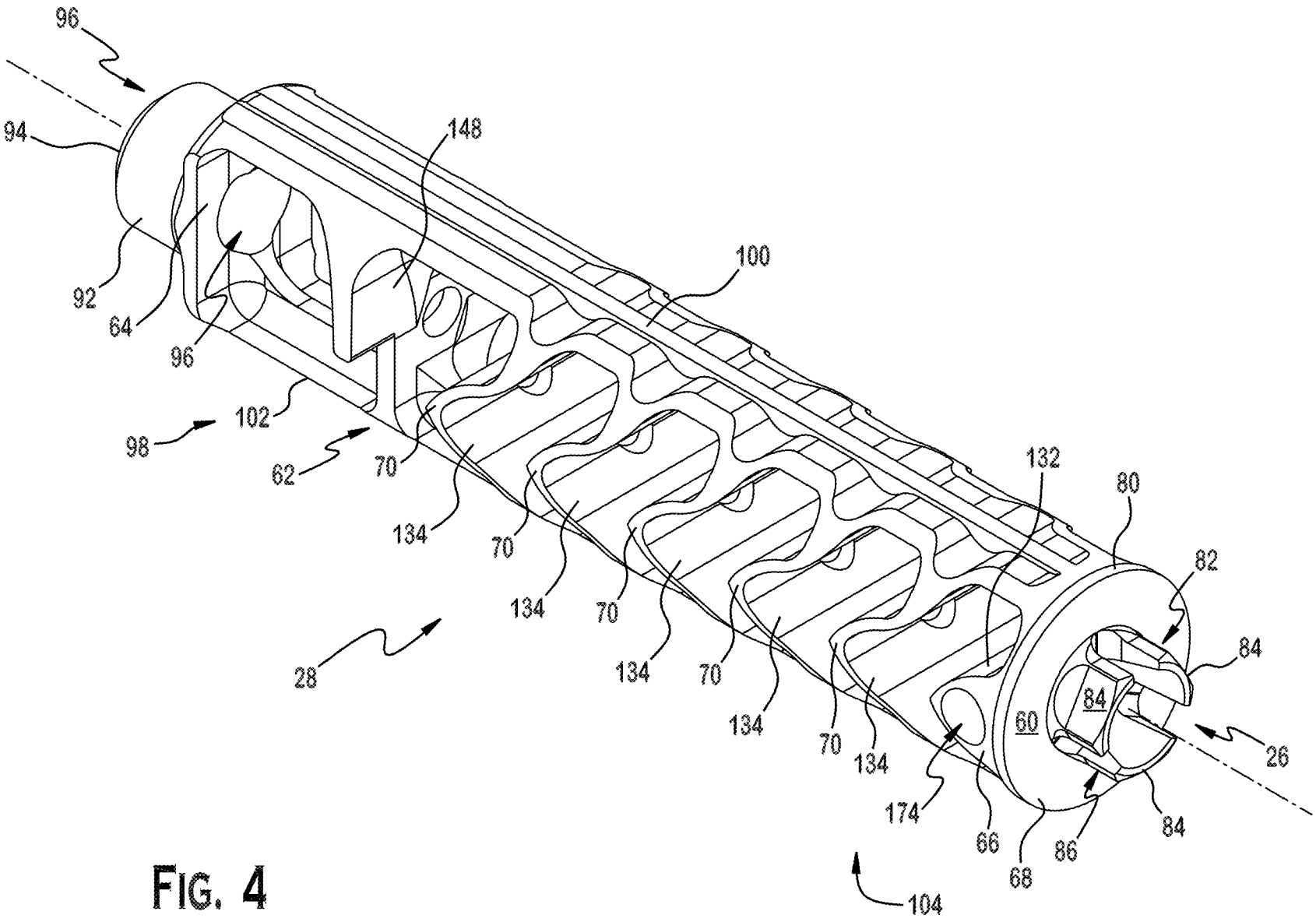
FIG. 4 is another perspective of the core of FIG. 3.

Furthermore, referring to FIG. 4, the suppressor 10 may include an exterior utility tool 82 proximate to the discharge port 26. The utility tool 82 may be integrally formed with the distal end cap 80 of the core 28. The utility tool 82 may include a plurality of surfaces 84 that form as drive fitting (e.g., a square or hex fitting). Preferably, the drive fitting is a male fitting. The utility tool further may include a plurality of slots 86. The slots may allow for the utility tool 82 to be used as a wire cutter. The utility tool 82 also may include an accessory attachment site.

As shown in FIG. 2, the proximal end cap 16 may be connected to the tube 18 by mating screw threads 44, 54. When fully seated on the endcap 16, the proximal end 46 of the tube may rest on the circumferential ledge 42. This connection may be secured by welding the tube 18 and endcap 16 together at the interface between the proximal end of the tube 46 and the circumferential ledge 42. Additionally, the proximal end of the core 58 may be telescopically received in the distal end 48 of the tube 18. Generally, the core 28 may be inserted into the tube 18 and endcap assembly 16 until the proximal end 58 of the core seats against the endcap 16. More particularly, the proximal end 58 of the core 28 may seat against the frusto-conical sidewall 38 of the endcap. Further, the tube 18 and the core 28 may be configured and dimensioned to form a snug fit such that the inner surface of the tube 50 and the core 28 may cooperate to isolate spaces between the baffles 20 and create a series of chambers for regulating discharge gasses from a firearm. In this embodiment, the core structure may include a self-torquing feature 62, five pressure modulation baffles 70, a quarter baffle 66, a distal end cap 80, and a discharge port 26 in the distal cap. A gap 88, however, may be maintained between the distal end cap 80 and tube 18. For example, the radial gap 88 between the core and the tube may range from approximately 0.004 inches to approximately 0.0075 inches. Preferably, the radial gap measures approximately 0.0075 inches.

Referring to FIG. 3, FIG. 4, FIG. 5, and FIG. 6, the core 28 generally may include a first segment 90 adjacent to the proximal end 58. The first segment may include a circular cylindrical projection 92 that includes a frusto-conical surface 94 adjacent to the proximal end 58. The frusto-conical surface 94 may be configured and dimensioned to seat against the frusto-conical surface 38 of the endcap 16. The first segment 90 further may include a central bore 96 that is aligned with the longitudinal axis of the suppressor and the central axis of the discharge port. Referring to FIG. 4, the core 28 may further include a second segment 98 adjacent to the first segment 90. The second segment 98 may include a proximal end wall 64 near the circular cylindrical projection 92 and a distal end wall 68 that includes the discharge port 26. The second segment 98 may further include a superior longitudinal member 100 and an inferior longitudinal member 102. The inferior longitudinal member 102 may be disposed opposite to the superior longitudinal member. The superior and inferior longitudinal members 100, 102 may each extend from the proximal end wall 64 to the distal end wall 68. The superior and inferior longitudinal members 100, 102 and the proximal and distal end walls 64, 68 may form a frame 104. Additionally, the central bore 96 may extend from the proximal end 58 of the core through the proximal end wall 64 of the core. The central bore 96 may include a screw thread (not shown). The screw thread may be configured and dimensioned to mate with the muzzle end of a firearm barrel. For example, without limitation, the central bore 96 and associated crew threads may be configured and dimensioned to mate with a barrel of a M240 machine gun. In other embodiments, the suppressor 10 may be configured and dimensioned for other firearms (e.g., pistols, carbines, rifles and others) or types of ammunition cartridges (e.g., 7.62×39 mm and 5.56 NATO, 300 BLK, or others).

Figure 6:
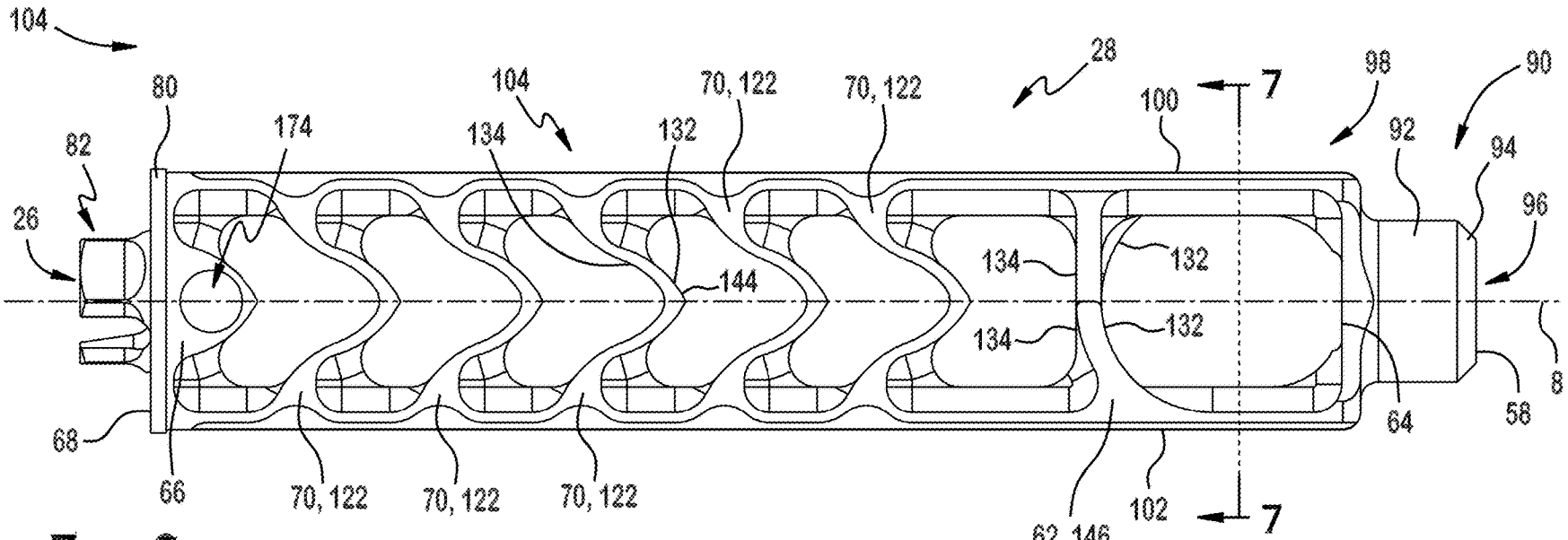
FIG. 6 is a right side view of the core of FIG. 3.
Figure 7:
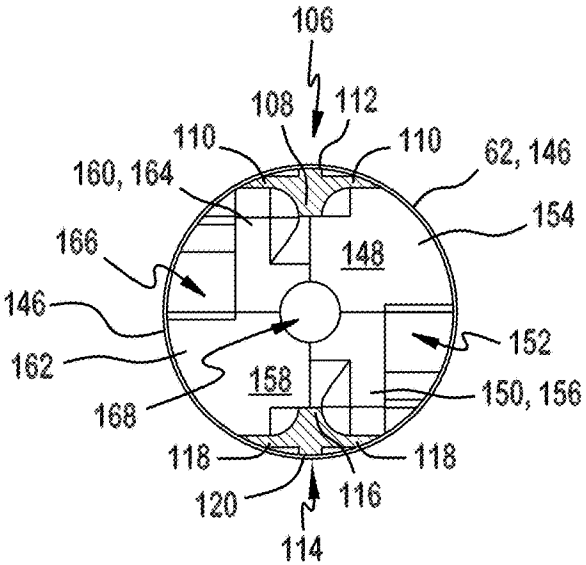
FIG. 7 is a sectional view of the core of FIG. 6 along line 7-7.

Referring to FIG. 7, the superior longitudinal member 100 may include a cross-section 106 perpendicular to the longitudinal axis of the frame 104. The cross-section of the superior longitudinal member generally may include a beam portion 108, a flanged portion 110, and an exterior rib portion 112. Similarly, the inferior longitudinal member 102 may include a cross-section 114 perpendicular to the longitudinal axis of the frame 104. The cross-section 114 of the inferior longitudinal member generally may include a beam portion 116, flange portion 118, and an external rib portion 120. Although the superior and inferior cross-sections 106, 114 sections generally may have substantially the same shape, these sections may be different. Moreover, the cross-section of the superior longitudinal member 106 and the cross-section of the inferior longitudinal member 114 may vary along the length of the frame 104. For example, referring to FIG. 6, the frame 104 further may include a plurality of transverse plates (below) 122. Each transverse plate 122 may extend from the superior longitudinal member 100 to the inferior longitudinal member 102. Structurally, the superior longitudinal member 100 may resemble an upper spar cap, the inferior longitudinal member 102 may resemble a lower spar cap, and the partial transverse plate and-transverse plates 122 may resemble ribs in a wing frame.

Figure 8:
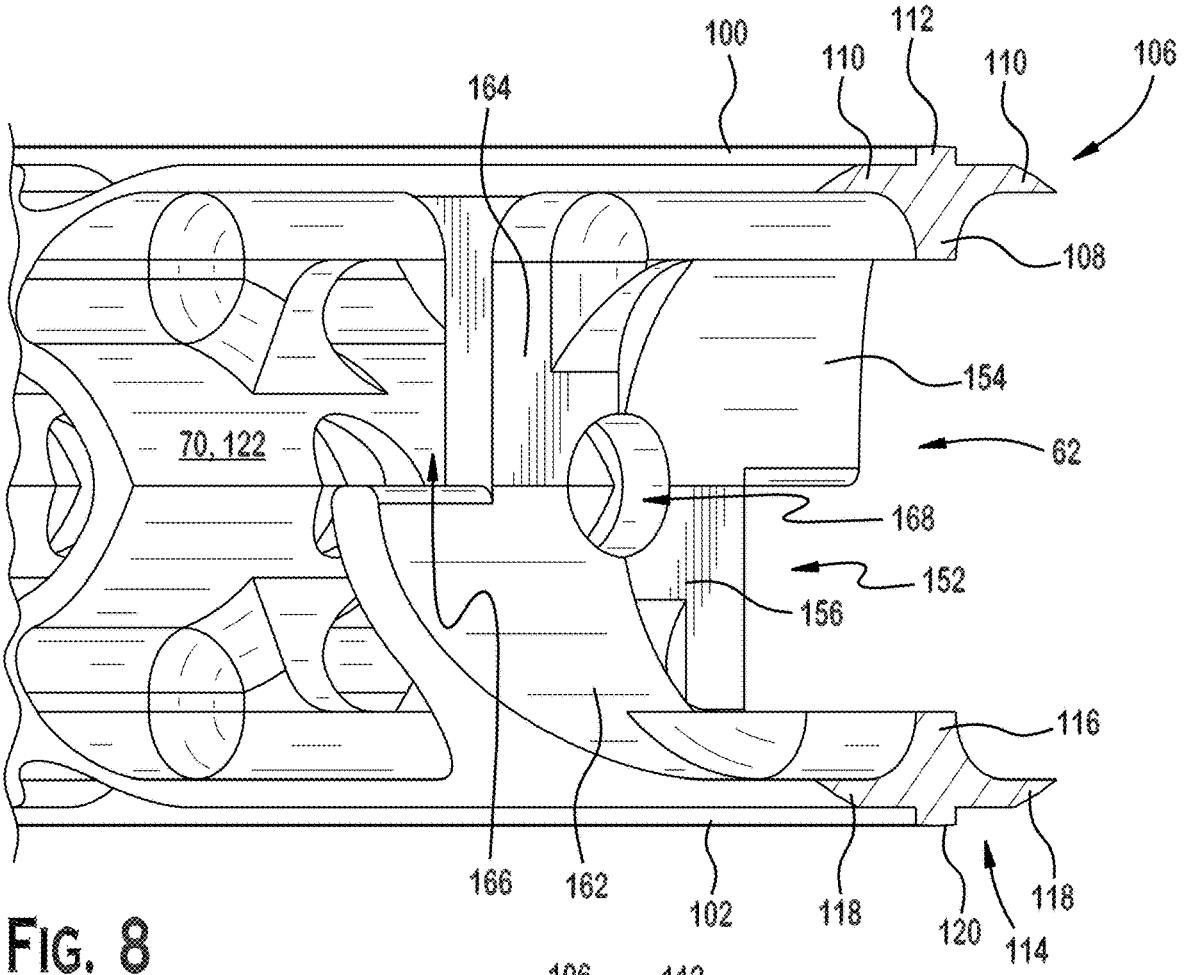
FIG. 8 is a perspective view of FIG. 7.

A transverse plate 122 which extends from the superior longitudinal member 100 to the inferior longitudinal member 102 may be referred to as a frame web 124. Referring to FIG. 2, each frame web 124 may include an aperture 126 that extends from one side of the frame web to the opposite side of the frame web. The array of apertures 126 may be configured and dimensioned to allow a bullet that was fired from a specific type of ammunition cartridge to travel through the core 28 and exit the suppressor via the discharge port 26. Generally, an aperture 126 in a frame web may be bounded by an inner sidewall 128. Each aperture 126 may further include a longitudinal axis which is aligned with the central axis 8 of the barrel receiving bore 96 of the first segment. Each aperture 126 further may include a cross-section 130 perpendicular to the longitudinal axis of the aperture. For example, referring to FIGS. 7, 8 and 9, the cross-section 130 of the aperture 126 may present a circular shape. The circular shape may present a minimum outer diameter. Generally, the minimum outer diameter presented by the aperture 126 may be approximately 0.172 inches larger than the caliber of the bullet that will travel through the suppressor. For instance, an aperture may have a diameter ranging from approximately 0.02 inches to approximately 0.172 inches greater than the caliber of the bullet. In the disclosed embodiment, the aperture 126 may have a diameter of approximately 0.400 inches. Preferably, however, the aperture 126 may have a diameter of approximately 0.480 inches. Additionally, referring to FIG. 3, one side of the frame web 124 nearest to the proximal end wall 64 may be referred to as a leading side 132 of the frame web. By contrast, referring to FIG. 4, the side of the frame 124 web furthest from the proximal end wall 64 may be referred to as a trailing side 134 of the frame web 122.

Referring to FIG. 2, a baffle 20 may include a frame web 124 and an aperture 126 through the frame web. For example, in FIG. 5, a pressure modulation baffle 70 may be formed from a frame web 124 which is curved toward the proximal end wall 64. More particularly, the curved frame web may include a compound curved surface. For instance, the compound curved surface 136 may include a superior concave segment 138 adjacent to the superior longitudinal member 100, an inferior concave segment 140 adjacent to the inferior longitudinal member 102, and a convex segment 142 between the superior concave segment 138 and the inferior concave segment 140 As shown in FIG. 2, the aperture 126 may be disposed in the convex segment 142. Moreover, referring to FIG. 5, the apex 144 of the convex segment 142 may form a leading surface of the baffle. In this embodiment, the apex 144 may lie in a plane that coincides with the central axis 8.

Figure 5:
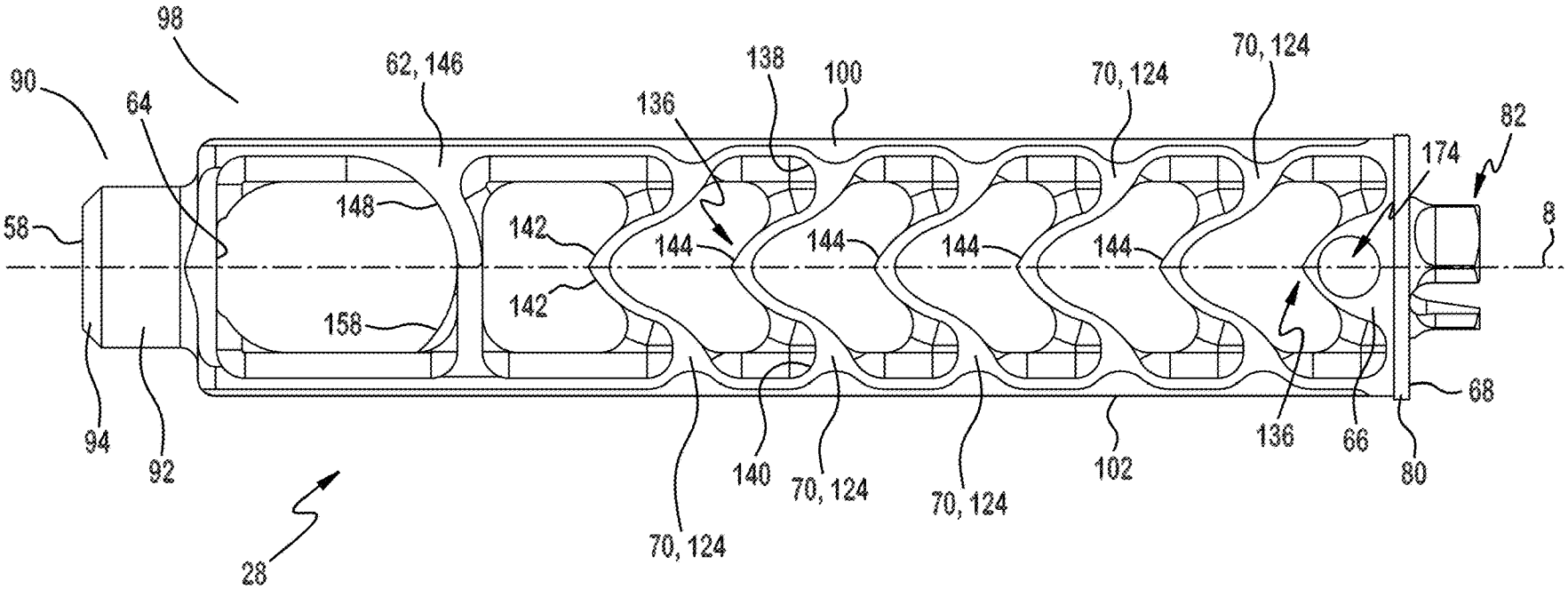
FIG. 5 is a left side view of the core of FIG. 3.

As shown in FIGS. 3, 5 and 6, the core 28 may include a generally uniform arrangement of five pressure modulation baffles 70 between the quarter-baffle 66 and the self-torquing feature 62. In a preferred embodiment, referring to FIG. 3 and FIG. 6, the leading surface 132 of the five pressure modulation baffles 70 may be spaced at an interval measuring approximately 1.01 inches.

Referring to FIG. 7, FIG. 8, FIG. 11, FIG. 12, FIG. 13, and FIG. 14, the core 28 may further include a self-torquing feature 62. Referring to FIG. 6, the self-torquing feature 62 may be arranged adjacent to the proximal end wall 64. In this embodiment, the self-torquing feature 62 may be positioned between the proximal end wall 64 and the leading pressure modulation baffle 70. The self-torquing feature 62 may be configured and dimensioned to define a flow path for firearm discharge gases exiting the muzzle. The flow path defined by the self-torquing feature 62 being such that a moment about the central axis 8 of the muzzle receiving bore 96 is generated by discharge gases transiting the blast chamber. Preferably, the self-torquing feature 62 may be configured and dimensioned such that a moment couple about the central axis 8 is generated by discharge gases transiting the blast chamber. The torque or force of moment generated by the discharge gases transiting the blast chamber may be used to controllably torque the threaded muzzle-suppressor interface during operation of the firearm. This process may promote a secure and robust connection between the muzzle and the suppressor. Also, this process may deter overtightening of the threaded muzzle-suppressor interface. Accordingly, the self-torquing feature 62 may prevent damage to the barrel and suppressor 10 during operation, and thus enhance operational performance, reliability and survivability of a suppressed weapon under extreme operating conditions. Moreover, a muzzle-barrel interface which fails to maintain a particular degree of tightness despite the presence of the self-torquing feature may provide an early indication that the equipment requires a higher level of maintenance or replacement which may prevent equipment failure in the field.

Referring to FIG. 5 and FIG. 6, the self-torquing feature 62 may include a partial transverse plate or fractional frame web 146 extending from the superior longitudinal member 100 to the inferior longitudinal member 102. Referring to FIG. 7, the fractional frame web 146 may include a first vane 148 offset from the central axis 8. For example, the first vane 148 may be positioned on one side of the central axis 8. The first vane 146 may include a control surface 150 opposite the proximal end wall and a vent 152 adjacent to the control surface. The control surface 150 may include a curved surface segment 154 which extends from the superior longitudinal member toward the inferior longitudinal member. The curved surface segment 154 may possess constant curvature. The curved surface segment 154 may be concave with respect to the proximal end wall 64. The control surface 150 may further include a planar segment 156 which extends from the inferior longitudinal member to the curved surface segment. The planar segment 156 may be substantially perpendicular to the inferior longitudinal member 102. The curved segment 154 and the planar segment 156 may abut a void 152 that extends from the proximal side of the control surface 150 to the distal side of the control surface.

The fractional frame 146 web may further include a second vane 158. The second vane 158 may be positioned on the other side of the central axis 8. The second vane 158 may include a second control surface 160 opposite the proximal end wall 64 and a second vent 166 adjacent to the second control surface. The second control surface 160 may include a second curved surface segment 162 which extends from the inferior longitudinal member 102 toward the superior longitudinal member 100. The second curved surface segment 162 may possess constant curvature. The second curved surface segment 162 may be concave with respect to the proximal end wall 64. The second control surface 160 may further include a second planar segment 164 which extends from the superior longitudinal member 100 to the second curved surface segment 162. The second planar segment 164 may be substantially perpendicular to the superior longitudinal member 100. The second curved segment 162 and the second planar segment 164 may abut a second void 166 that extends from the proximal side of the second control surface 160 to the distal side of the control surface.

Figure 9:
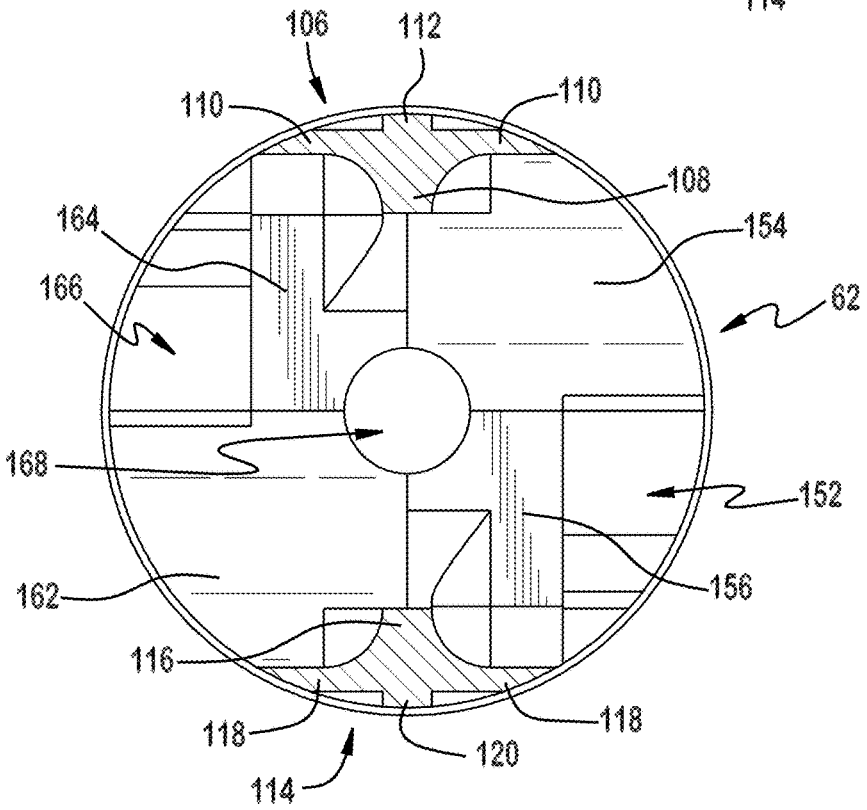
FIG. 9 is a front view of FIG. 8.
Figure 10:
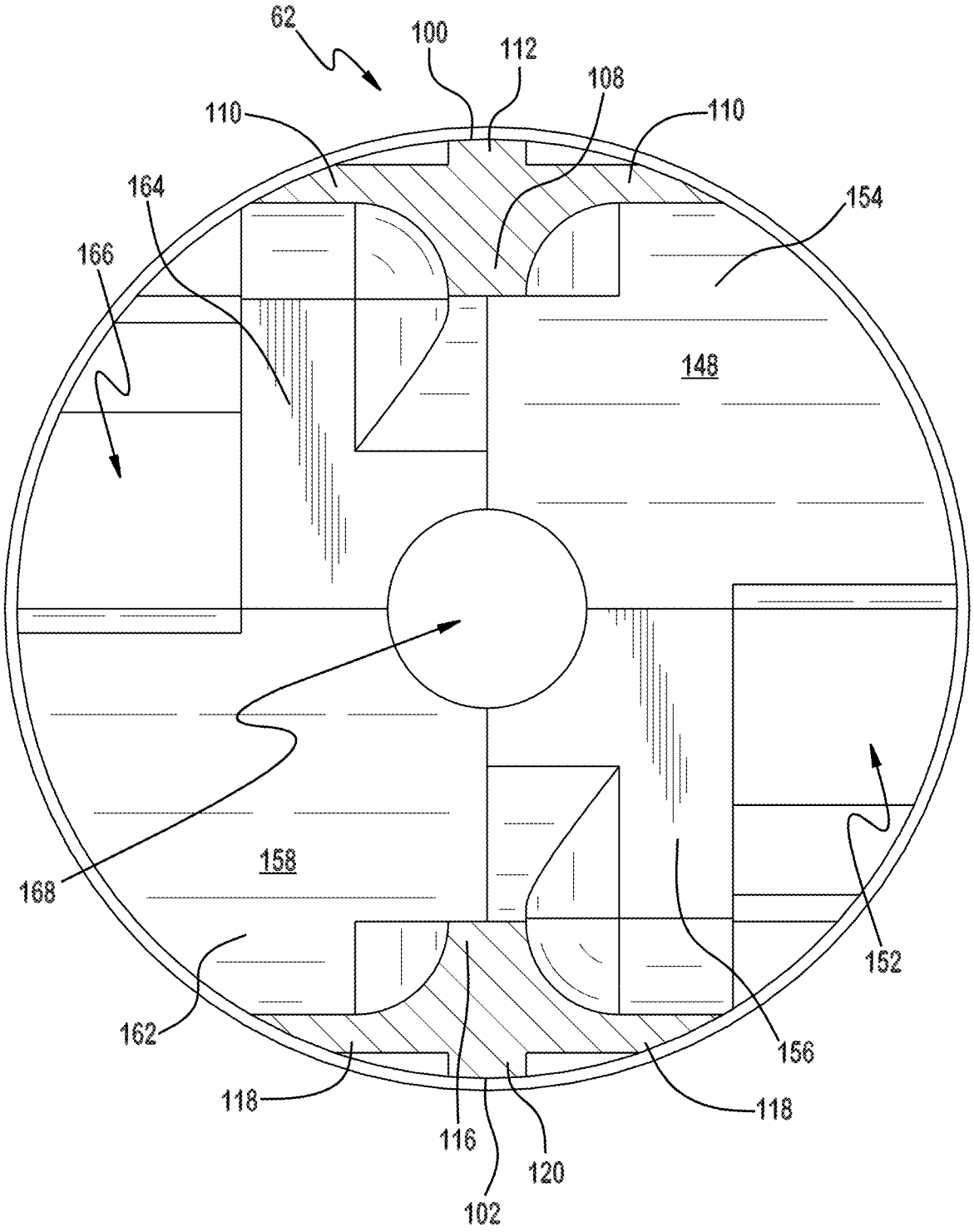
FIG. 10 is an enlarged view of FIG. 9.

In the embodiment disclosed in FIG. 7, FIG. 8, FIG. 9, and FIG. 10 the first curved surface 154, the second planar surface 164, and second void 166 are situated above the central axis 8; whereas the second curved surface 162, the first planar surface 156, and the first void 152 are situated below the central axis 8. The self-torquing feature 62 may further include an aperture 126 extending from the proximal side of the fractional frame web to the distal side of the fractional frame web. Referring to FIG. 7, FIG. 9, and FIG. 10, the aperture 126 may include a cross-section 130 perpendicular to the central axis 8. The cross-section may have circular shape. The inner diameter of the cross-section may be dimensioned based on the caliber and type of ammunition cartridge for which the barrel is chambered.

Referring to FIG. 10, in the exemplary embodiment, the second curved surface 162 may have a surface area of approximately 0.77 square inches, the second planar area 164 may have a surface area of approximately 0.20 square inches, and the second void may provide an opening having a surface area of approximately 0.24 square inches. Accordingly, the ratio of the area of the second curved surface divided by the area of the second planar area may be approximately 3.85 or (0.77 $in^2$/0.20 $in^2$), and the ratio of the surface area of the second void opening divided by the sum of the areas of the second curved surface and the second planar surface may be approximately 0.25 or (0.24 $in^2$/(0.77 $in^2$+0.20 $in^2$)).

In one configuration, the diameter of the aperture 168 of the self-torquing feature 62 (148, 158), the diameter of the apertures 126 in the baffle array 20, and the diameter of the discharge port 26 may be substantially equal. For example, the diameter of the aperture 168 of the self-torquing feature 62 (148, 158), the diameter of the apertures of the baffle array 20, and the diameter of the discharge port 26 may be approximately equal to 0.400 inches.

In another configuration, however, the diameter of the aperture 168 of the self-torquing feature 62 (148, 158), may be approximately equal to 0.400 inches; whereas the diameter of the respective apertures 126 in the baffle array 20, and the diameter of the discharge port 26 may be substantially equal to 0.480 inches. Thus, the ratio of the diameter of the discharge port 26 divided by the diameter of the aperture 168 of the self-torquing feature 62 (148, 158) may be greater than 1. More particularly, the ratio of the diameter of the discharge port 26 divided by the diameter of the aperture of self-torquing feature 62 (148, 158) may be approximately 1.20.

Figure 11:
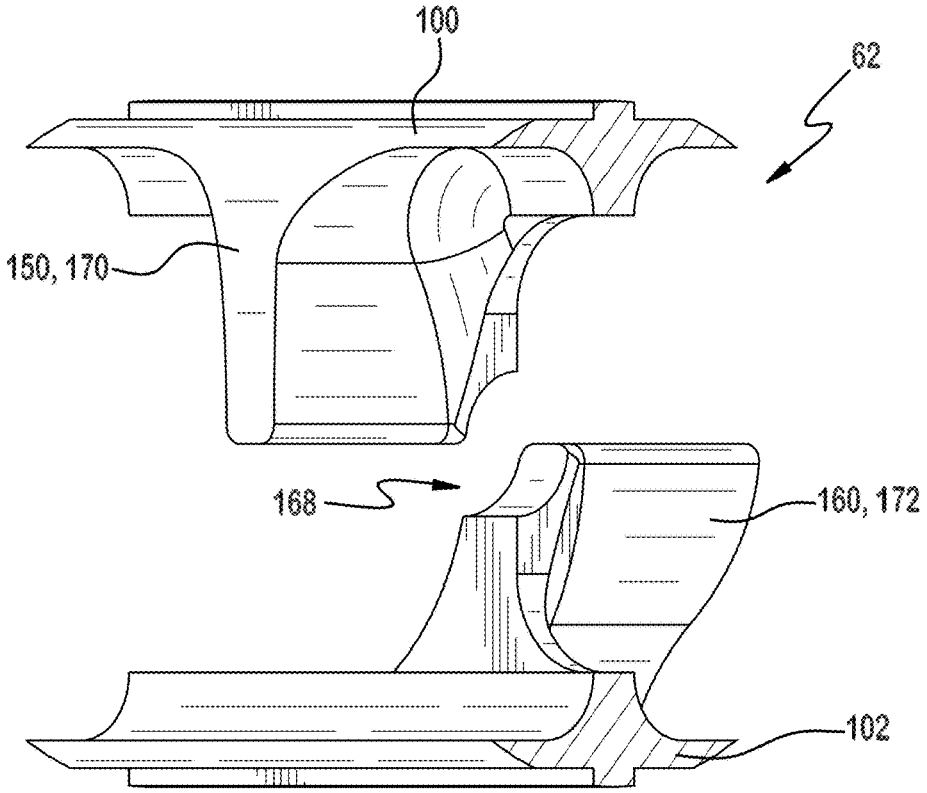
FIG. 11 is a perspective view of another embodiment of a self-torquing feature.
Figure 12:
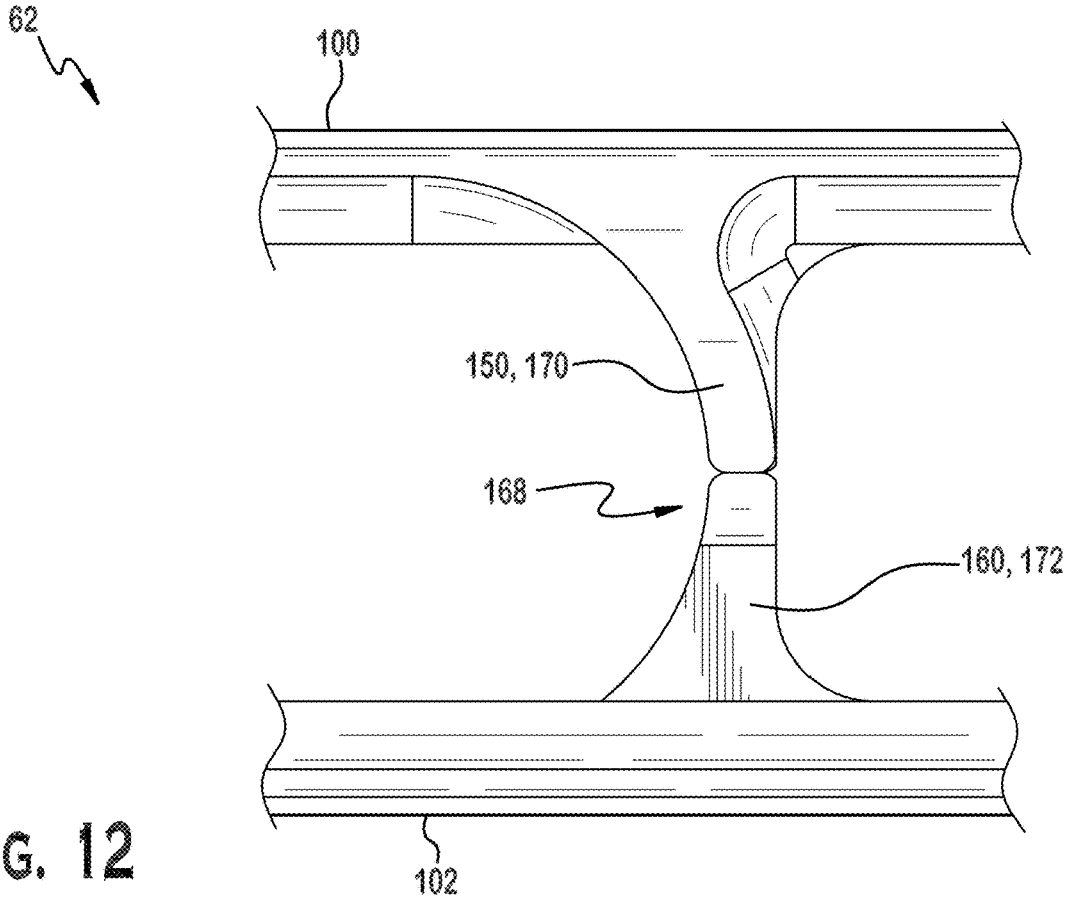
FIG. 12 is a side view of the self-torquing feature of FIG. 11.

Additionally, another embodiment of a self-torquing feature 62 is disclosed in FIG. 11 and FIG. 12. In this embodiment, the first control surface 150 may include a curved half-baffle 170 positioned on one side of the central axis 8. The curved half-baffle 170 may extend from the superior longitudinal member 100. By contrast, the second control surface 160 may include a second curved half-baffle 172 positioned on the other side of the central axis 8. The second curved half-baffle 172 may extend from the inferior longitudinal member 102. The first curved half-baffle 170 and the second curved half-baffle 172 may be configured to allow a bullet to traverse the self-torquing feature 62, array of baffles 70, and quarter-baffle 66 before exiting the core 28 via the discharge port 26.

Referring to FIG. 3, FIG. 4, FIG. 5, and FIG. 6, the distal end wall 68 may be circular. The outer diameter of the distal end cap 80 may be slightly larger than the maximum outer diameter of the adjacent quarter-baffle 66 and the array or stack of pressure modulation baffles 70. The quarter-baffle 66 may be an integral to the distal endcap. More particularly, the proximal side of the quarter-baffle 66 may possess the same shape as the proximal side of a pressure modulation baffle 70. The aperture 126 in the quarter-baffle may be aligned with the central axis 8 and may further connect to one or more transverse vent(s) 174 and the discharge port 26. The transverse vent 174 may extend from one side of the quarter-baffle 66 to the opposite side of the quarter-baffle. For instance, solid areas of the core surrounding the transverse vents 174 may enhance structural properties of the frame 104 and provide support for the tube 18. Moreover, referring to FIG. 2, the discharge port 26 may taper outwardly and coincide with the inner surface of a circumferential wall that circumscribes the discharge port. In the disclosed embodiment, the exterior surfaces 84 of the circumferential wall may form a fitting, such as a rectangular or hex shape. The circumferential wall may further include a plurality of slots 86. One or more of the plurality of slots 86 may form a tool. For example, a wall with two opposing slots may be used to cut wire.

Referring to FIG. 5 and FIG. 6, exemplary dimensions for the disclosed embodiment may include a distance measured between the self-torquing feature 62 and the leading end of the first baffle 70 of approximately 1.411 inches. Additionally, the apex 144 of each respective baffle 70 in the baffle array 20 may be uniformly spaced by a distance of approximately 1.01 inches. The spacing between the apex of the last baffle in the baffle array and the apex of the quarter baffle may be a distance of approximately 1.01 inches. Moreover, the self-torquing feature 62 may be spaced from the proximal end wall 64 by a distance of approximately 1.7 inches. Additionally, the maximum outer dimension of the baffles 70 may be approximately 1.825 inches, the minimum inner diameter of the tube 18 may be approximately 1.840 inches, and the length of the suppressor 10 (not including the exterior tool) may be approximately 9.875 inches.

Referring to FIG. 2, the diameter of the aperture 168 in the self-torquing feature 62 may be substantially equal to 0.400 inches. Preferably, the diameter of the plurality of apertures 126 in the baffles 70 and quarter baffle 66 may be substantially equal to 0.480 inches. Generally, the chamber ratio (exit chamber volume/blast chamber volume) may range approximately 0.50 to 1.00. In this embodiment, the chamber ratio may be approximately 0.50 or (1.63 cubic inches/3.33 cubic inches).

Generally, the proximal endcap and tube assembly of FIG. 2 may be slipped over the muzzle of a barrel. The barrel may include a shoulder proximate to the muzzle, as well as a screw thread between the shoulder and the muzzle. The proximal end cap may seat on the shoulder of the barrel. The central bore of the core may be advanced on to the threaded muzzle until the frusto-conical surface adjacent the proximal end of the core seats against frusto-conical side wall of the proximal end cap. The core may be rotated to clamp the proximal endcap between the core and the barrel shoulder. In this manner, the endcap-tube assembly and core may be fitted and secured to the barrel of a firearm. After the suppressor has been secured to the barrel, an operator may then load, target and fire the weapon.

Operational data for a prototype suppressor of FIG. 1 which was secured to a M240L machine gun (short barrel chambered in 7.62×51 mm NATO) measured a peak sound level measurement of 136.62 dB at the shooter's left ear with a C-weighting on the meter. Measurement of the peak sound level was conducted in accordance with MIL-STD-1474D (12 Feb. 1997).

Figure 13:
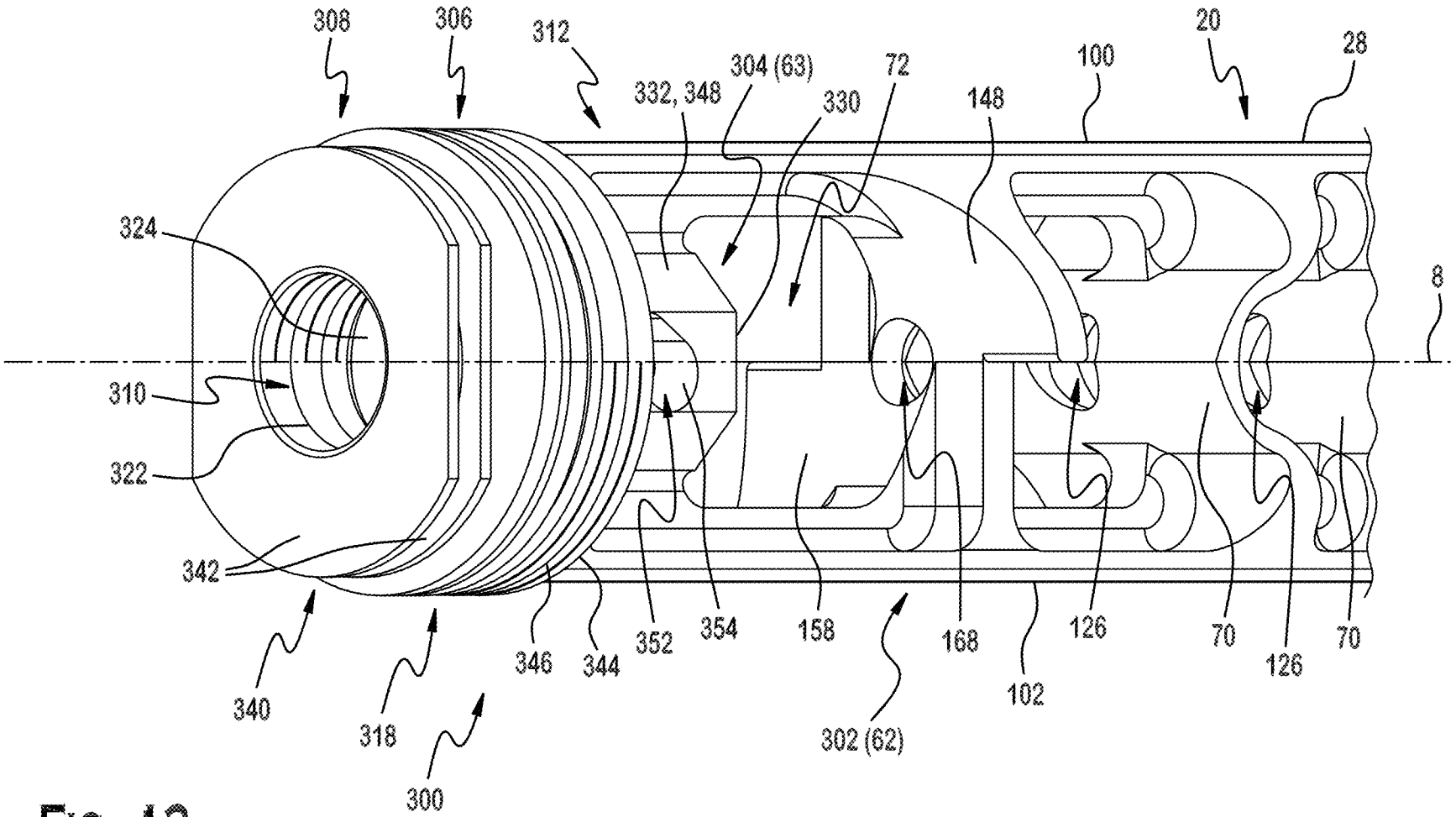
FIG. 13 is a partial perspective view of another embodiment of a core for a suppressor.
Figure 14:
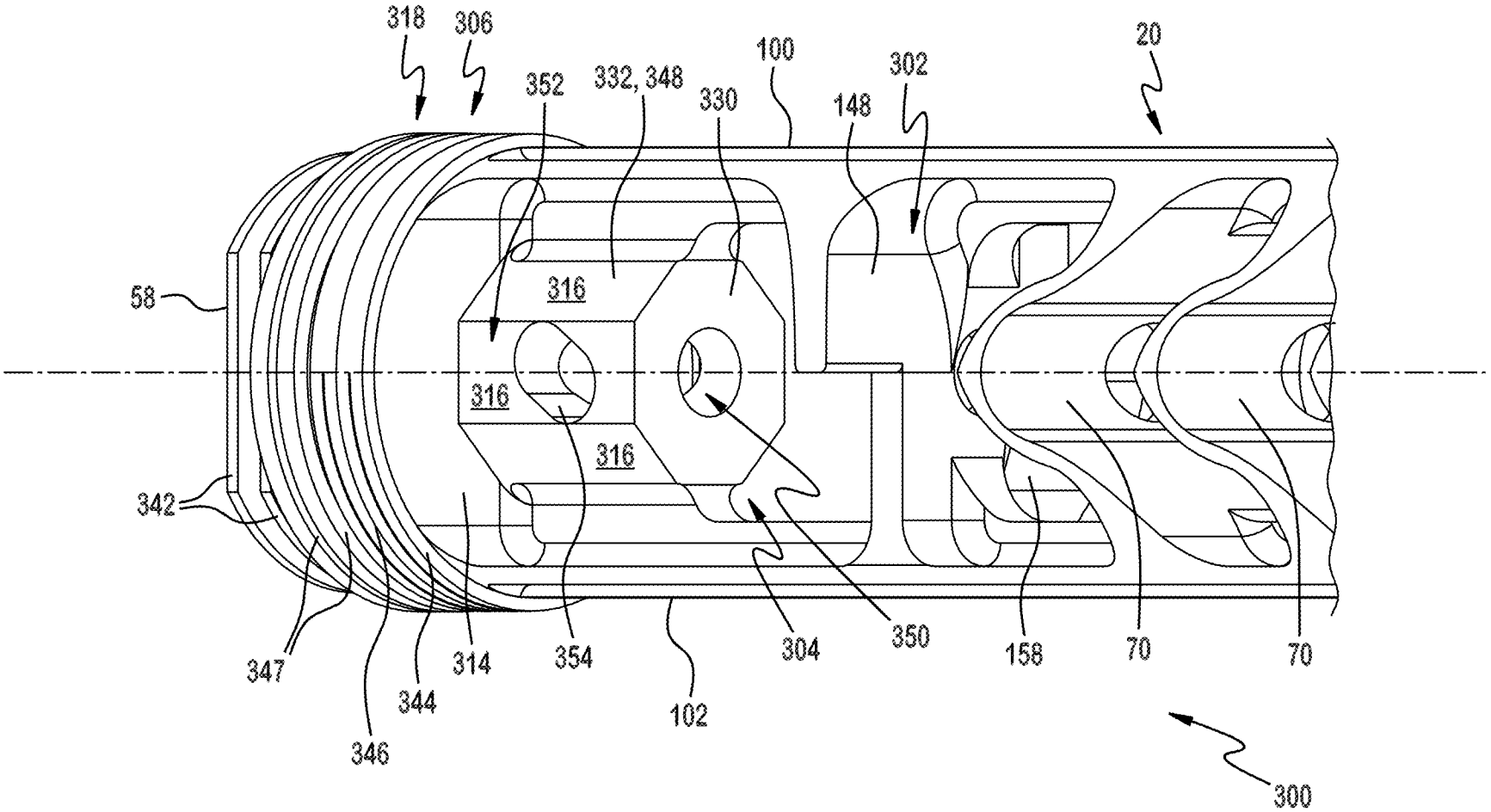
FIG. 14 is another perspective view of the core of FIG. 13.

As shown in FIG. 13, FIG. 14, FIG. 15, FIG. 16, and FIG. 17, a core 300 for a suppressor may include more than one self-torquing feature. For instance, the core 300 may include a self-torquing feature 302 (62 as disclosed in FIG. 3), along with another (or secondary) self-torquing feature 304. The other (or secondary) self-torquing feature 304 may be disposed in the blast chamber 72 opposite the self-torquing feature 302 (see e.g., FIGS. 13, 14 and 15). For instance, referring to FIG. 13 and FIG. 15, the core 300 may include a first segment 308 which includes an opening 310 for receiving the muzzle of a firearm. The opening 310 may be centrally aligned with the central axis 8 of the discharge port 26. The core 300 further may include a second segment 312 adjacent to the first segment 308. Referring to FIG. 14, the second segment 312 may include a proximal end wall 314, one or more self-torquing features 302, 304, one or more baffles 20, and a distal end wall 68 that includes the discharge port 26.

More particularly, one self-torquing feature 304 may include a nozzle 316 and another self-torquing feature 302 may include a static vane 148, 158. Preferably, each self-torquing feature 302, 304 may be configured and dimensioned to apply a moment torque about the central axis 8.

Most preferably, one self-torquing feature 304 may be configured and dimensioned to apply a moment torque about the central axis in a vertical plane, and another self-torquing feature 302 may be configured and dimensioned to apply a moment torque about the central axis 8 in a horizontal plane. Accordingly, the configuration of the self-torquing feature 302 and the baffle array 20 may be substantially the same as in the core 28 of the embodiment disclosed in FIG. 3.

In this embodiment—referring to FIG. 5, FIG. 13, FIG. 16 and FIG. 17—, however, the core 300 may be integrally formed with a proximal end cap 306 such that the core may connect to a barrel without an intervening shroud or tube. Instead, as described below, the core 300 may be configured and dimensioned to seat against the muzzle of the barrel. Moreover, referring to FIG. 14 and FIG. 15, the core 300 further may include a gas block (e.g., a mechanical seal or other sealing system) 318 which may be adapted to prevent ammunition cartridge discharge gasses from exiting the suppressor 10 proximate to the interface between the proximal end cap 306 and the tube 18.

Figure 16:
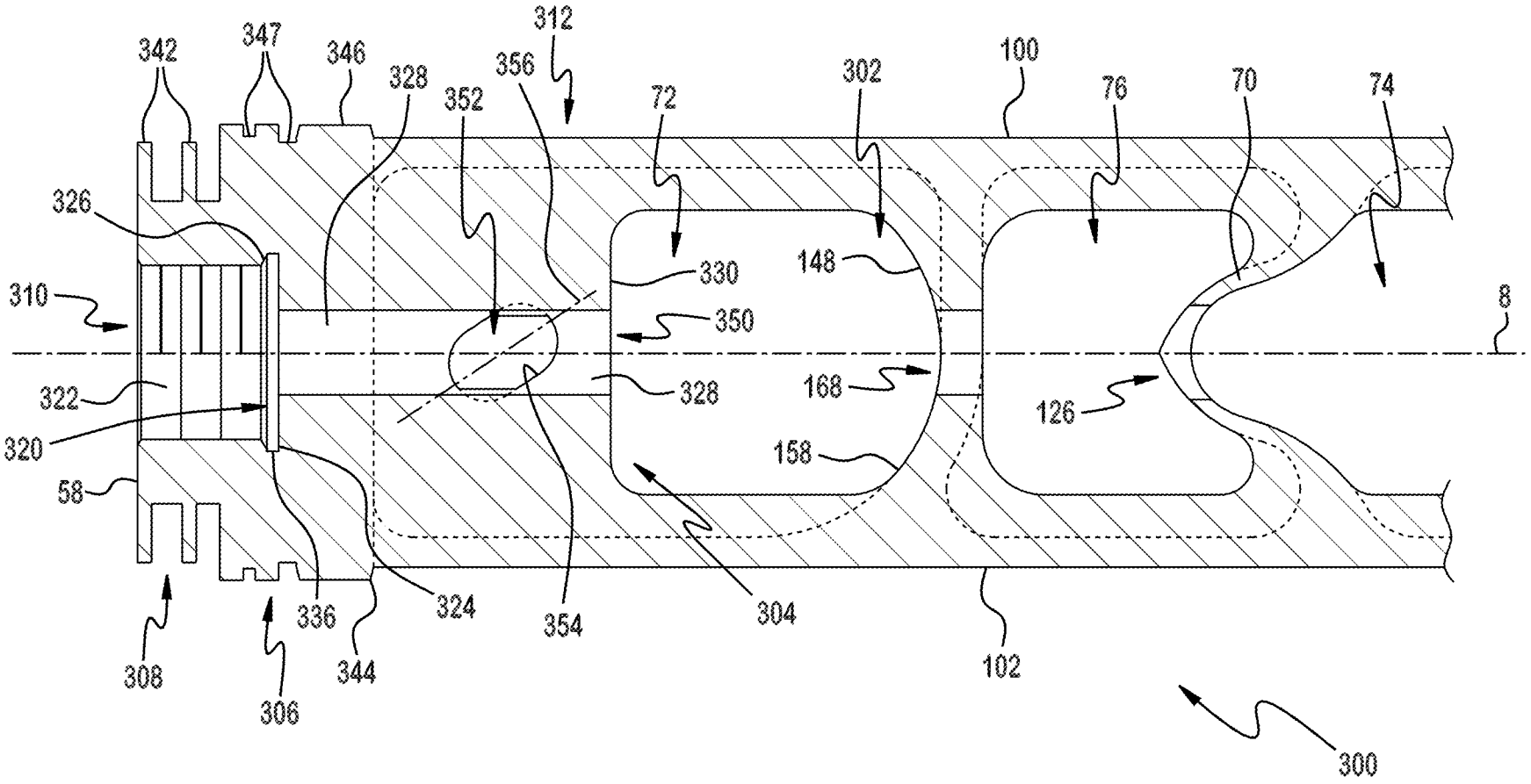
FIG. 16 is a cross-sectional view of the core of FIG. 13 along a longitudinal axis of the suppressor.
Figure 17:
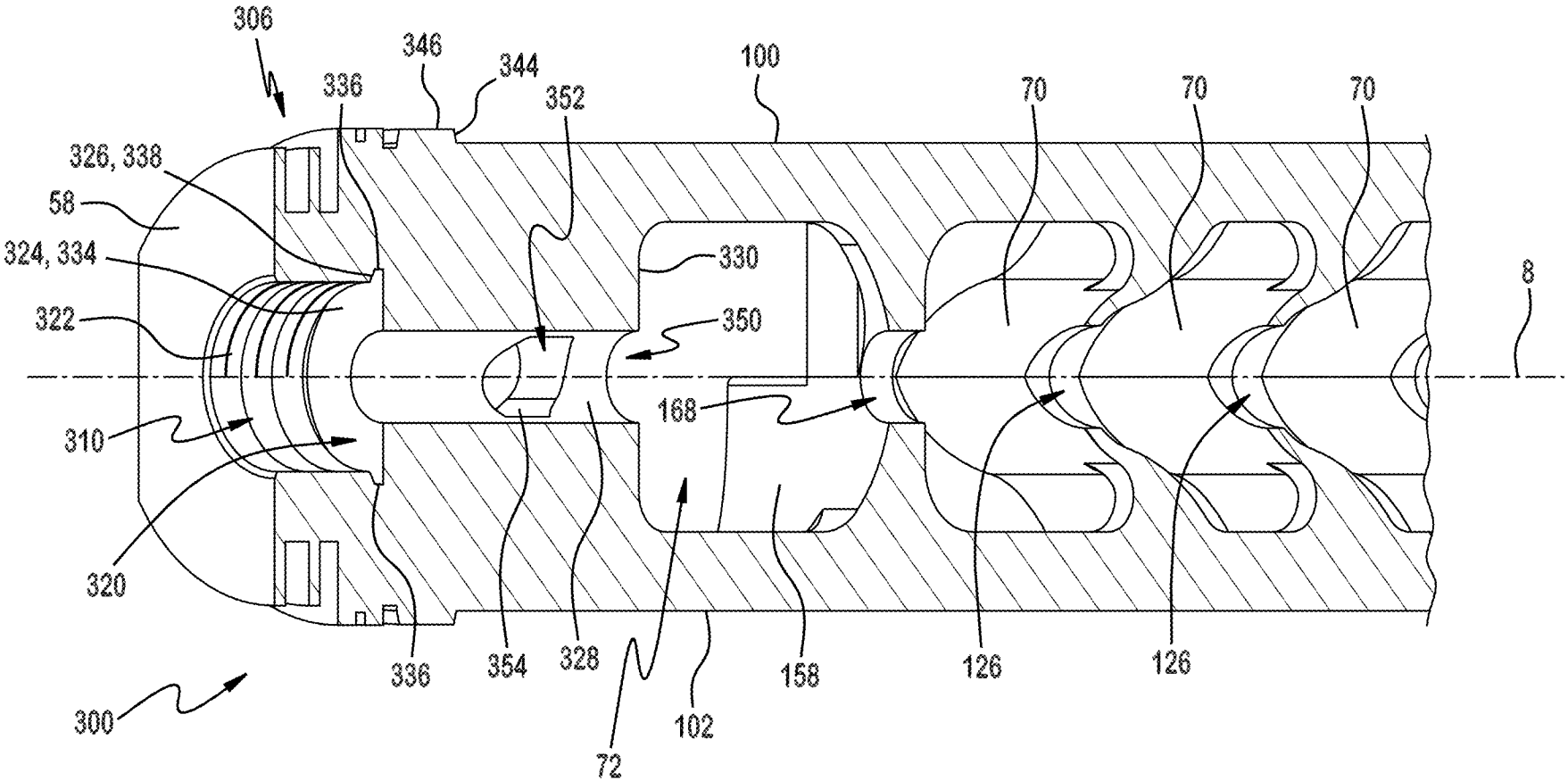
FIG. 17 is a perspective view of FIG. 16.

Referring to FIGS. 16, and 17, the opening 310 for receiving the muzzle of a firearm may extend from the proximal end 58 of the core to a muzzle seating chamber 320 inside the proximal end cap 306. The opening 310 further may include a side wall 322 and a cross-section perpendicular to the central axis 8. Referring to FIG. 17, the cross-section of the opening 310 may have a circular shape. The circular shape may possess a diameter. Generally, the diameter may range from approximately 5/8 to approximately 25/32. In this embodiment, the diameter may be approximately 25/32.

The side wall 322 of the opening further may include a screw thread. The screw thread may be configured and dimensioned to mate with a screw thread on a firearm barrel adjacent to the muzzle. In this embodiment, the opening 310 and screw thread may be configured and dimensioned to receive and mate with the barrel of a M240 variant machine gun (e.g., M240L, M240B). In other configurations, the opening 310 may be sized and adapted to receive and mate with the muzzle end of barrels of other firearms or small arms weapons.

The muzzle seating chamber 320 may abut an end wall 324. The muzzle seating chamber 320 may include a cross-section perpendicular to the central axis 8. The outer profile of the cross-section of the muzzle seating chamber may have a circular shape. The circular shape may possess a maximum outer diameter. Generally, the maximum outer diameter of the muzzle seating chamber 320 may be greater than the diameter of the opening 310. For example, the maximum outer diameter of the muzzle seating chamber may be approximately 0.84 inches. Accordingly, the proximal wall 326 of the muzzle seating chamber 320 may be a proximal annular surface.

In this embodiment, referring to FIG. 17, the muzzle seating chamber 320 may be in fluid communication with the blast chamber 72. For example, a bore 328 may extend from the end wall 324 to the distal end 330 of a projection (or body) 332 in the blast chamber 72. The bore 328 may be configured and dimensioned to allow passage of a bullet from a specific type of ammunition cartridge for which the barrel to be received in the opening is chambered. Hence, the bore 328 may be aligned with the central axis 8 of the discharge port 26, and thus the end wall 324 may form a distal annular surface 334. In use, the distal annual 334 surface may form a seat for the muzzle of a host barrel. For example, a threaded barrel may be advanced through the opening 310 until the muzzle abuts the distal annular surface 334. Further, the threaded barrel may be tightened against the distal annular surface 334 to further secure the barrel-core interface.

In this embodiment, the bore 328 may be configured and dimensioned to allow passage of a bullet from a 7.62×51 NATO ammunition cartridge. Although, in this embodiment the diameter of the bore 328 may be approximately 0.400 inches, the diameter of the bore 328 may possess a different diameter for a host barrel chambered for another type of ammunition cartridge (e.g., 7.62×39 mm and 5.56 NATO, 300 BLK, or others).

Moreover, a side wall surface 336 may extend from the proximal annular surface 338 to the distal annular surface 334. The proximal annular surface 338, side wall surface 336, and distal annular surface 334 may bound the muzzle seating chamber 320. In use, the muzzle seating chamber 320 may form a shelf for the host barrel. For example, the threaded barrel may be seated against the distal annual surface 334 as described above. During operation of the host firearm, the barrel—which is secured in the opening 310 and seated against the distal annular surface 334—may further expand radially into void space that is present between the proximal annular surface 338 and the distal annular surface 334, as the barrel is heated by ammunition discharge gasses. In this manner, the barrel may interlock with the muzzle seating chamber 320, and thus the muzzle seating chamber 320 may form an auxiliary attachment site (or shelf) for the host barrel.

Additionally, referring to FIG. 13, the first segment 308 further may include an exterior fitting 340 adjacent to the proximal end 58 of the core. The fitting 340 may be used to advance the opening 310 for receiving the muzzle of a firearm on to a barrel having mating screw threads. In this embodiment, the fitting 340 may be manipulated by a tool (e.g., a torque wrench), and thus the fitting 340 may be configured and dimensioned to mate with a wrench or spanner. For example, the fitting 340 may have a cross-sectional profile that includes two parallel linear segments. In another example, the fitting 340 may have a cross-sectional profile that includes four linear segments. See, e.g., FIG. 49. The linear segments may be connected by curved segments.

The fitting 340 may be formed from one or more fins 342 which extend radially from the core. For example, without limitation, the fitting 340 may be formed from two fins 342 (see e.g., FIGS. 14 and 16). The fin(s) 342 may be disposed around the first segment 308 of the core 300 proximate to the barrel receiving opening 310. The fin(s) 342 may be integral to the core. The fin(s) 342 may be spaced from each other and from the second segment 312 of the core. The fin(s) 342 may be configured and dimensioned to radiate heat from the barrel-core interface to the surrounding ambient air, and thus may form a heat sink. The heat sink may protect the structural integrity of the screw threads on the barrel and the core, and hence may further promote a secure and operable connection between the barrel and the suppressor. Preferably, the one or more fins 342 may possess a maximum outer dimension which is less than the maximum outer dimension of an adjacent portion of the second segment 312 of the core. Hence, the fin(s) 342 may present a recessed profile with respect to the tube 18, and thus be less prone to snagging, inadvertent contact with the operator, or interference in targeting the weapon.

Figure 15:
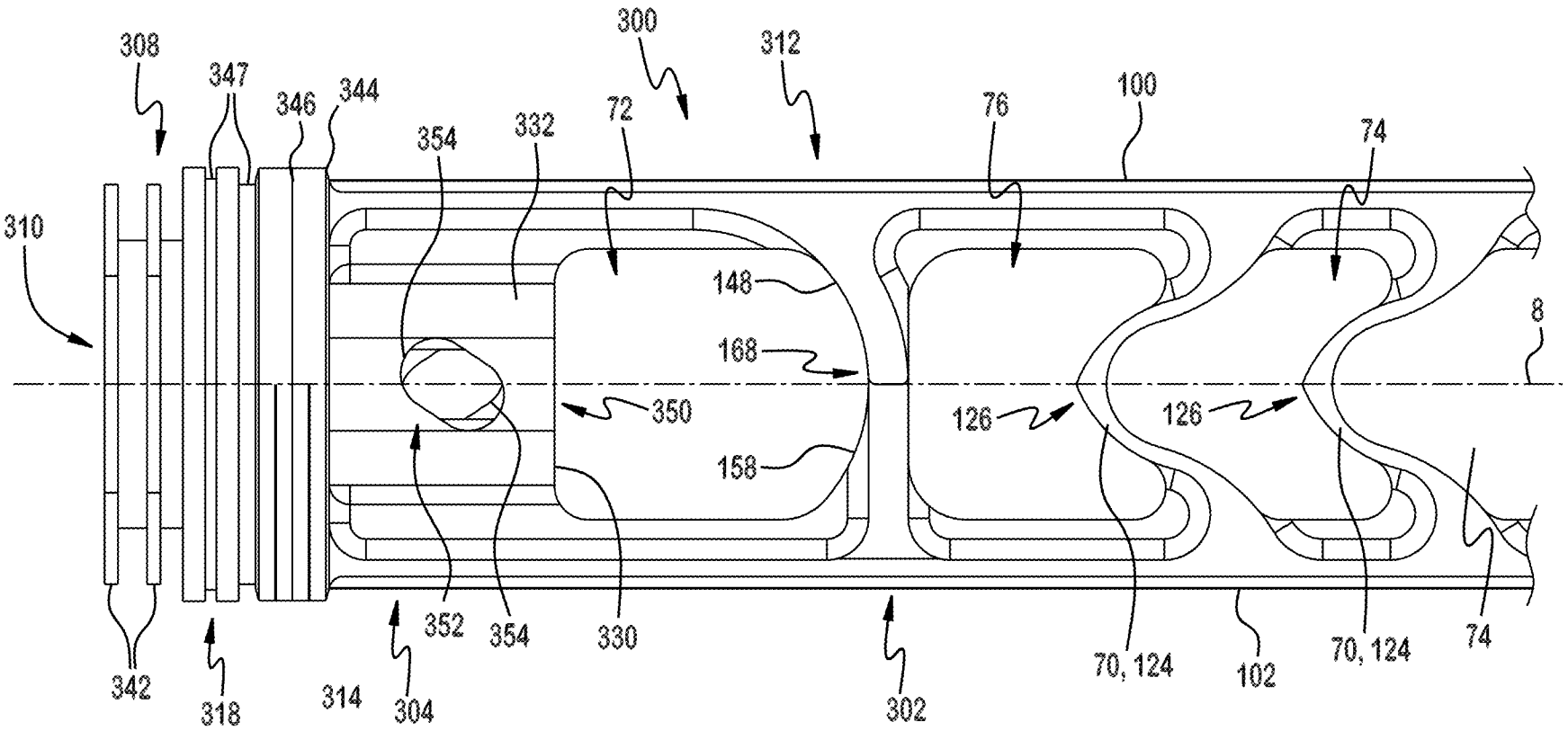
FIG. 15 is a side view of the core of FIG. 13.

Referring to FIG. 14, the proximal end cap 306 further may include a proximal end wall 314 and a side wall 344 disposed about the periphery of the proximal end wall. The superior longitudinal member 100 of the core 300 may be integrally formed with or connected to the proximal end wall 314. Also, the superior longitudinal member 100 may be integrally formed with or connected to the side wall 344. Similarly, the inferior longitudinal member 102 may be integrally formed with or connected to the proximal end wall 314 and may be integrally formed with or connected to the side wall 344. The side wall 344, moreover, may include an outer surface 346. Referring to FIG. 15, the outer surface 346 of side wall 344 may possess a cross-section perpendicular to the central axis 8.

More particularly, referring to FIG. 13 and FIG. 14, the outer profile of the cross-section of the outer surface 346 may have a circular shape. The circular shape may present a maximum outer diameter. Preferably, the outer surface may include a screw thread for securing the core to the tube. The screw thread may be a trapezoidal screw thread. The screw thread may be configured and dimensioned to mate with an opposing screw thread on the inner surface of the tube.

Also, the core 300 may include a gas block (e.g., a mechanical seal or other sealing system) 318 which may be adapted to prevent ammunition cartridge discharge gasses from exiting the suppressor 10 proximate to the interface between the proximal end cap 306 and the tube 18. For instance, the proximal end cap 306 may include a gas block 318. The gas block 318 may be arranged about the proximal end of the second segment 312. More particularly, the gas block 318 may be configured and dimensioned to mechanically seal the proximal end of the core 300 and tube 18. For example, referring to FIG. 15 and FIG. 16, a pair of circumferential grooves 347 on the proximal end cap 306 may interact with the tube 18 to seal gas flow from the interior of the suppressor.

Referring to FIG. 14, a self-torquing feature 304 may be integrally formed with the proximal end cap 306 between the superior longitudinal member 100 and the inferior longitudinal member 102. The self-torquing feature 304 may include a nozzle 316. The nozzle may include a body 332 with a distal end 330 and one or more side surfaces 348 extending between the proximal end wall 314 and the distal end 330. The body 332 may form a projection extending from the proximal end wall 314. Additionally, referring to FIGS. 16, the body 332 may include a bore 328 that extends from the end wall 324 to the distal end 330 of the body. The bore 328 may be aligned with the central axis 8 of the discharge port 26. The body 332 may include a cross-section perpendicular to the central axis 8. Referring to FIG. 14, the exterior profile of the cross-section of the body 332 may have a generally hexagonal shape. Also, referring to FIG. 16, the bore 328 may be of circular shape and may possess an inner diameter. Generally, the inner diameter of the bore 328 may range from approximately 0.360 inches to approximately 400 inches. In a preferred embodiment, the inner diameter of the bore 328 may be approximately 0.360 inches. For example, the inner diameter of the bore 328 may be 0.362 inches.

The bore 328 at the distal end 330 of the body 332 may form an axial orifice 350. Also, the body 332 may further include one or more radial nozzle orifices 352. Referring to FIG. 14, FIG. 15, and FIG. 16, the one or more radial nozzle orifices 352 may include an elongated slot 354 that extends from the bore 332 to a side surface 348 of the body 332. Referring to FIG. 16, the elongated slot 354 may include a longitudinal axis 356. The longitudinal axis 356 may be disposed at an angle with respect to the central axis 8.

Additionally, referring to FIG. 14, the elongated slot 354 may be oriented such that the elongated slot 354 forms a radial nozzle orifice 352 that is off-center with respect to the central axis 8. The one or more radial nozzle orifice(s) 352 may be configured and dimensioned to transfer energy from transient ammunition cartridge discharge gases to the body 332 through a torque generated by changing a generally axial flow of ammunition discharge gasses traversing the bore 328 to a generally radial flow of ammunition discharge gasses exiting the elongated slot 354. The torque applied by the gasses transiting the bore 328 and the elongated slot(s) 354 may be in the form of an impulse that occurs with each firing of the weapon. For example, the self-torquing feature 304 may be configured and dimensioned to apply a moment torque about the central axis 8 in a vertical plane.

Also, referring to FIG. 15, the axial orifice 350 may be arranged opposite another self-torquing feature 302 formed by an opposing pair of static vanes 148, 158 (above) which may transfer energy from ammunition discharge gasses exiting the axial orifice 350 to the core in the form of a torque about the central axis 8. For example, this self-torquing feature 302 may be configured and dimensioned to apply a moment torque about the central axis 8 in a horizontal plane. Moreover, the central axis of the aperture 168 of the second self-torquing feature 302 may be aligned with the central axis 8 of the discharge port 26. (See, e.g. FIG. 2). Hence, the bore 328, the aperture 168 of the second self-torquing feature 302, the apertures 126 of the pressure modulation baffles 70, and the aperture 126 of the quarter-baffle 66 may be co-aligned with the central axis 8 of the discharge port 26.

Preferably, referring to FIG. 16, the diameter of the bore 328 and the diameter of the aperture 168 of the second self-torquing feature 302 may be substantially equal. For example, the diameter of the bore 328 and the diameter of the aperture 168 of the second self-torquing feature 302 may be approximately equal to 0.400 inches. Also, the diameter of the apertures 126 of the pressure modulation baffles 70 and the diameter of the discharge port 26 may be substantially equal. For example, the diameter of the aperture 126 of the pressure modulation baffles 70 and the diameter of the discharge port 26 may be approximately equal to 0.480 inches. Accordingly, in the one embodiment, the ratio of the diameter of the discharge port 26 divided by the diameter of the aperture 126 of the second self-torquing feature 302 may be greater than 1. For instance, the ratio of the diameter of the discharge port 26 divided by the diameter of the aperture 168 of the second self-torquing feature 302 may be approximately 1.20.

Figure 25:
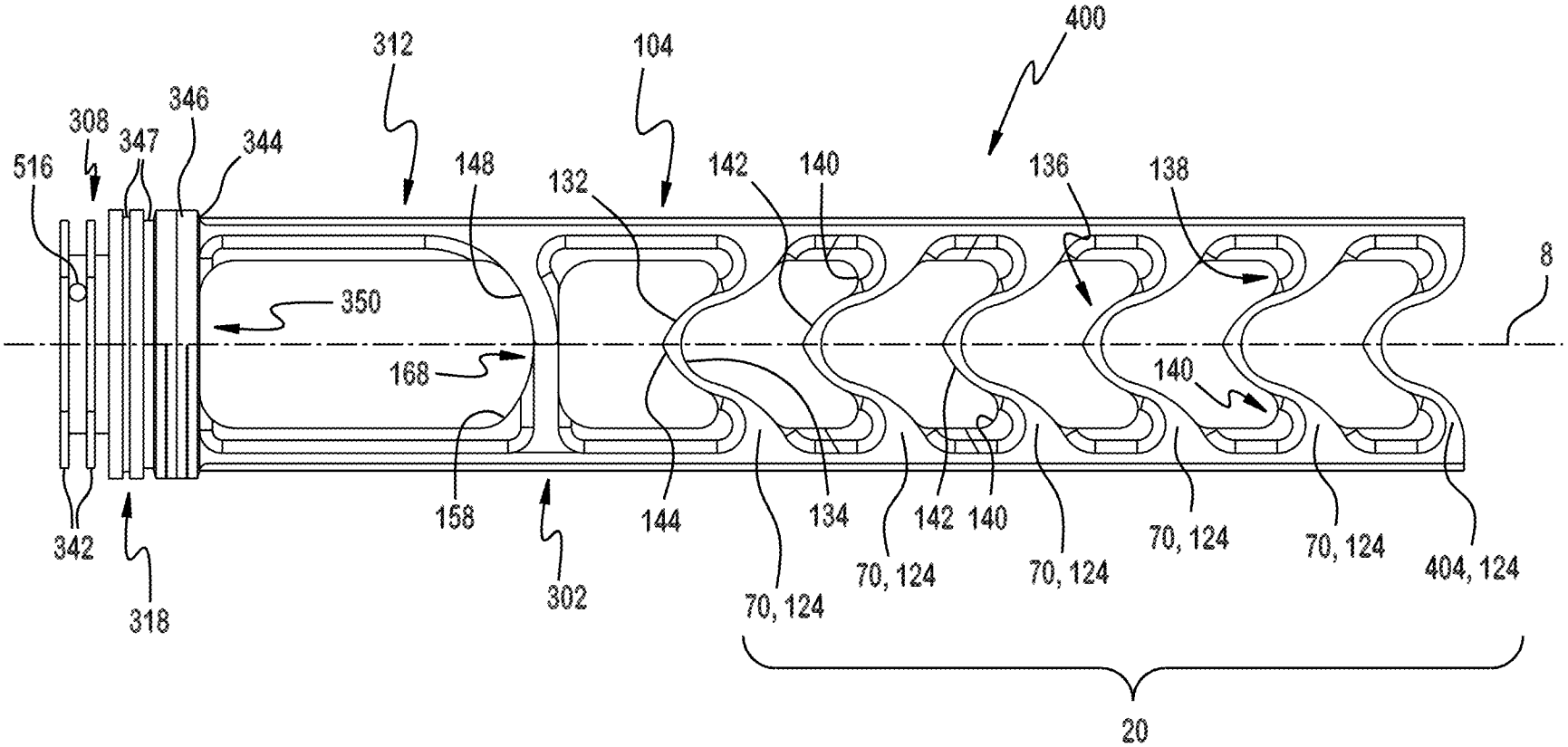
FIG. 25 is side view of the core of FIG. 20.
Figure 26:
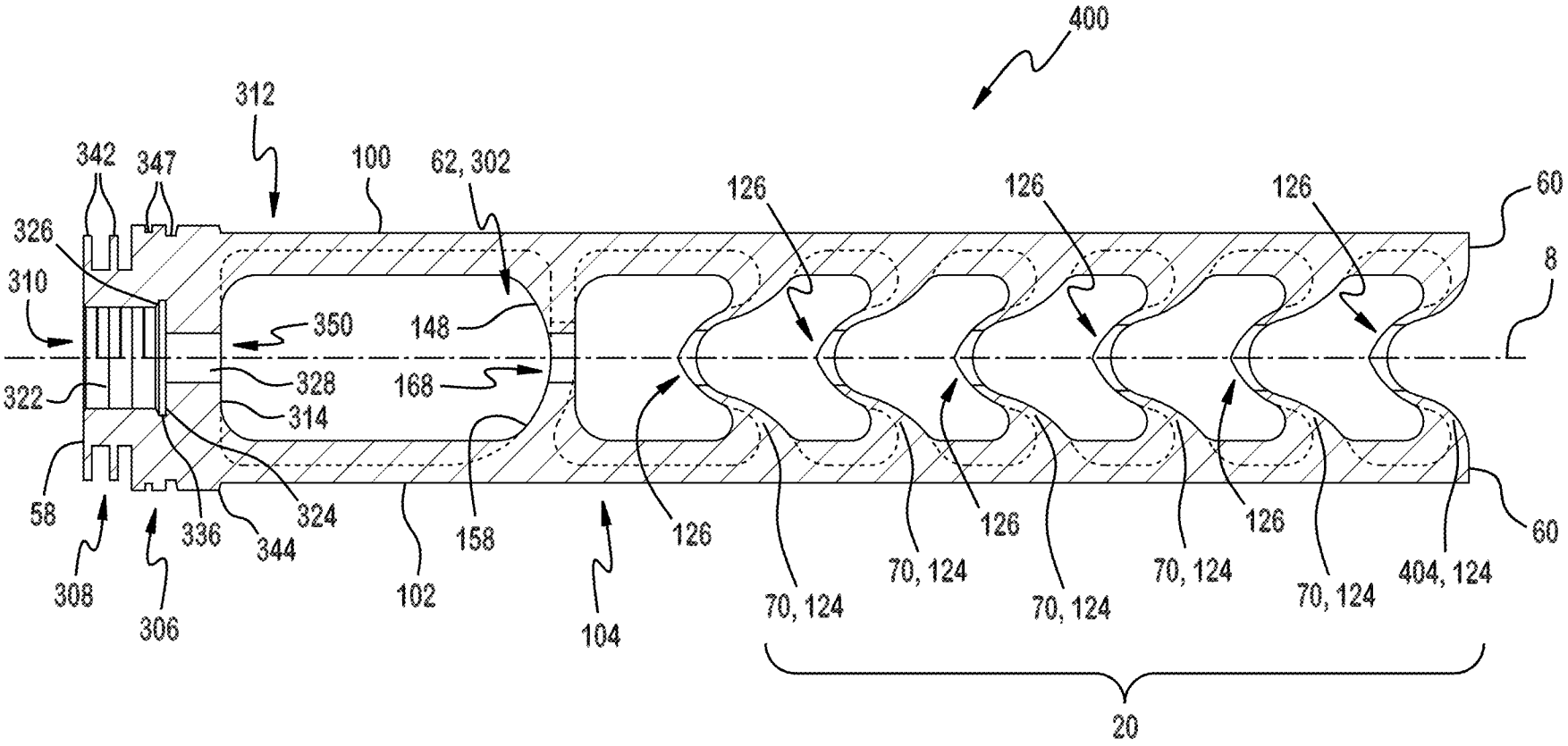
FIG. 26 is a cross-sectional view of the core of FIG. 25, along line 26-26.

Referring to FIG. 13, FIG. 18, FIG. 27, and FIG. 49, the core and tube assembly may be advanced on to a threaded muzzle of a host firearm the until muzzle rests against the distal annular surface of the muzzle seating chamber. A torque wrench may then be used to apply torque to the core at a targeted level. In this manner, as described in connection with FIG. 47 (below), the tube and core may form a pre-stressed structure which provides added structural characteristics that enhances the capability of a suppressor to operate effectively under extreme service loads. Moreover, the first segment of the core may be pinned to the barrel. For example, a positive connection between the first segment of the core and the barrel may be implemented by a barrel fixation hole 516 in the main body (see e.g., FIG. 25), along with a corresponding pin. For example, two sets of barrel fixation holes may be drilled in the main body before (or after) the muzzle booster is seated on the barrel. Preferably, each set of barrel fixation holes may be perpendicular to the bore and perpendicular to any other sets of barrel fixation holes.

Figure 18:
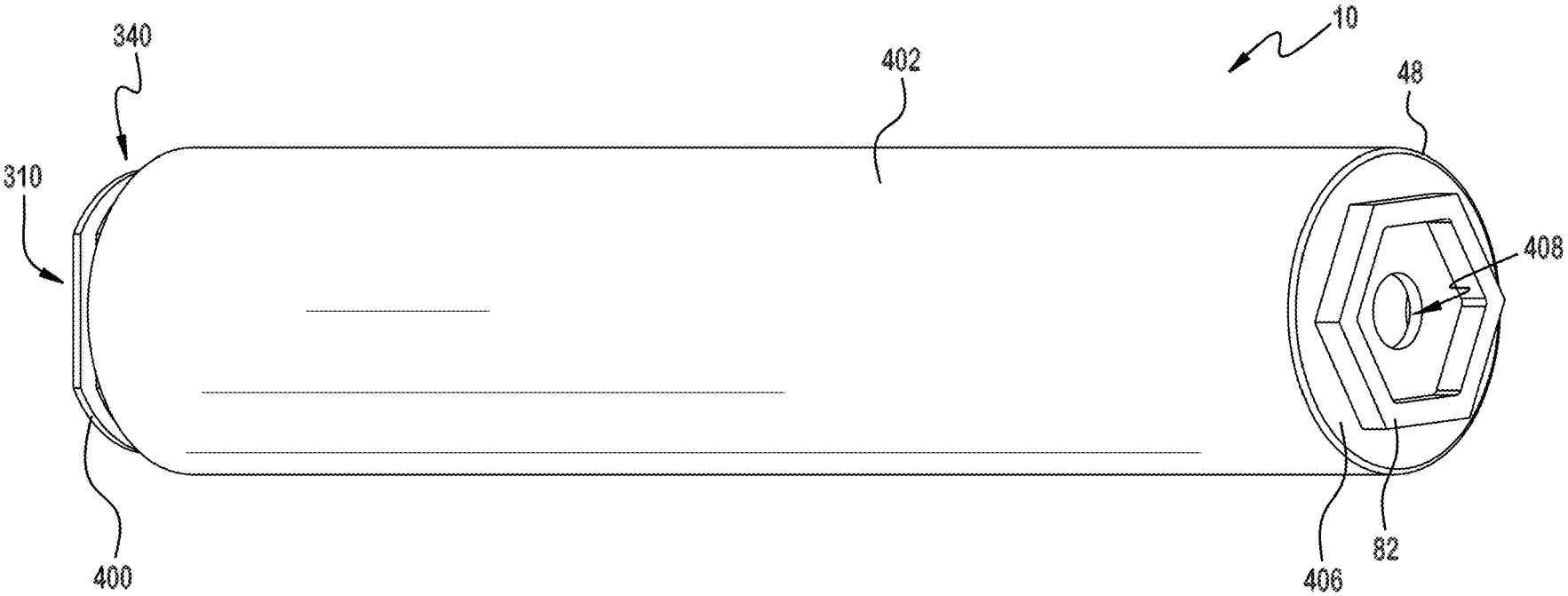
FIG. 18 is a perspective view of a second exemplary embodiment of a suppressor.
Figure 19:
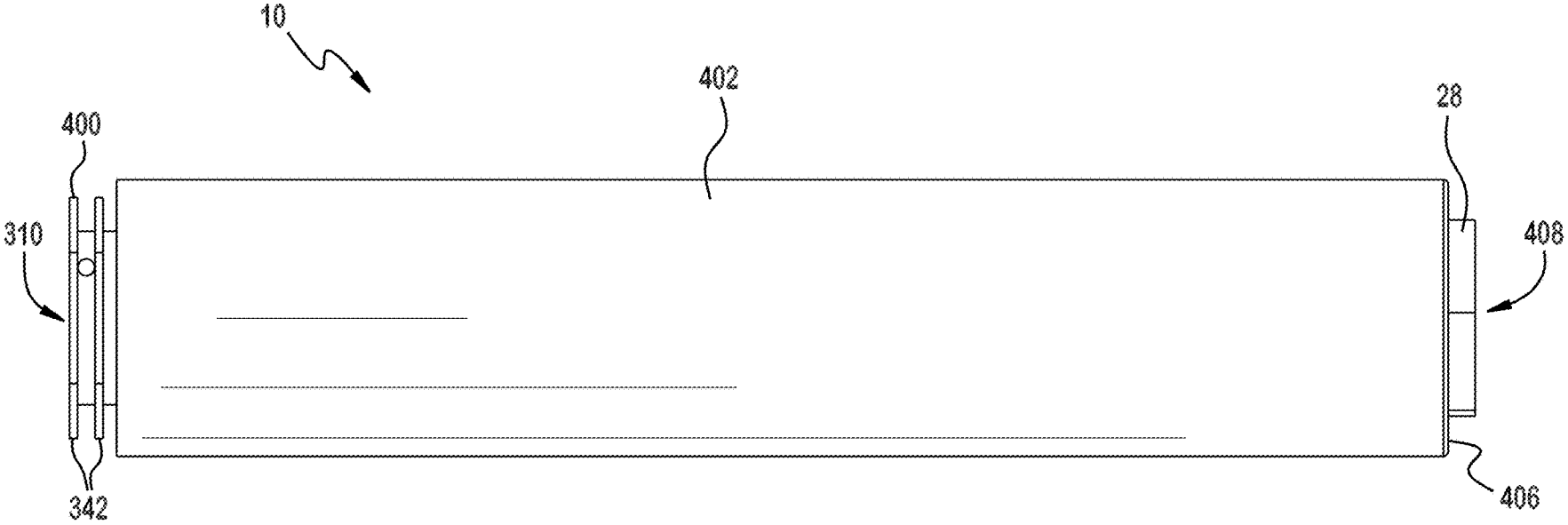
FIG. 19 is a side view of the suppressor of FIG. 18.
Figure 20:
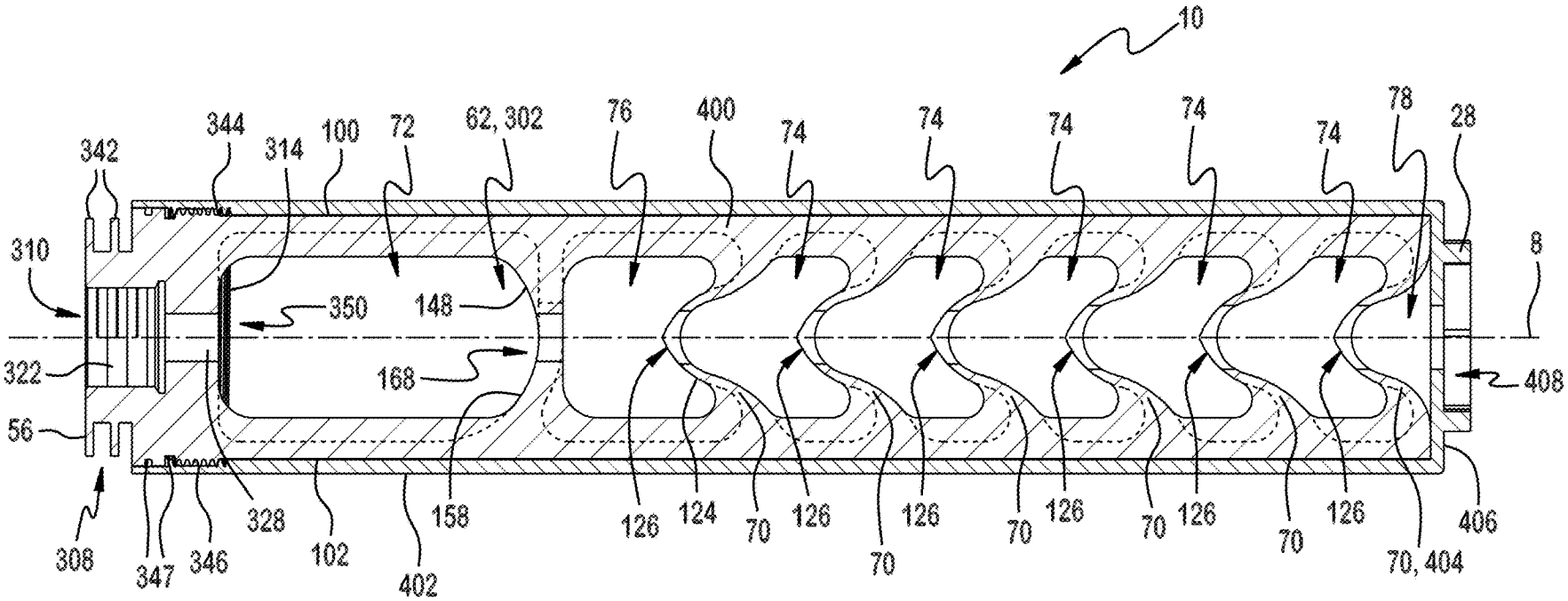
FIG. 20 is a cross-sectional view of the suppressor of FIG. 18, along line 20-20.
Figure 21:
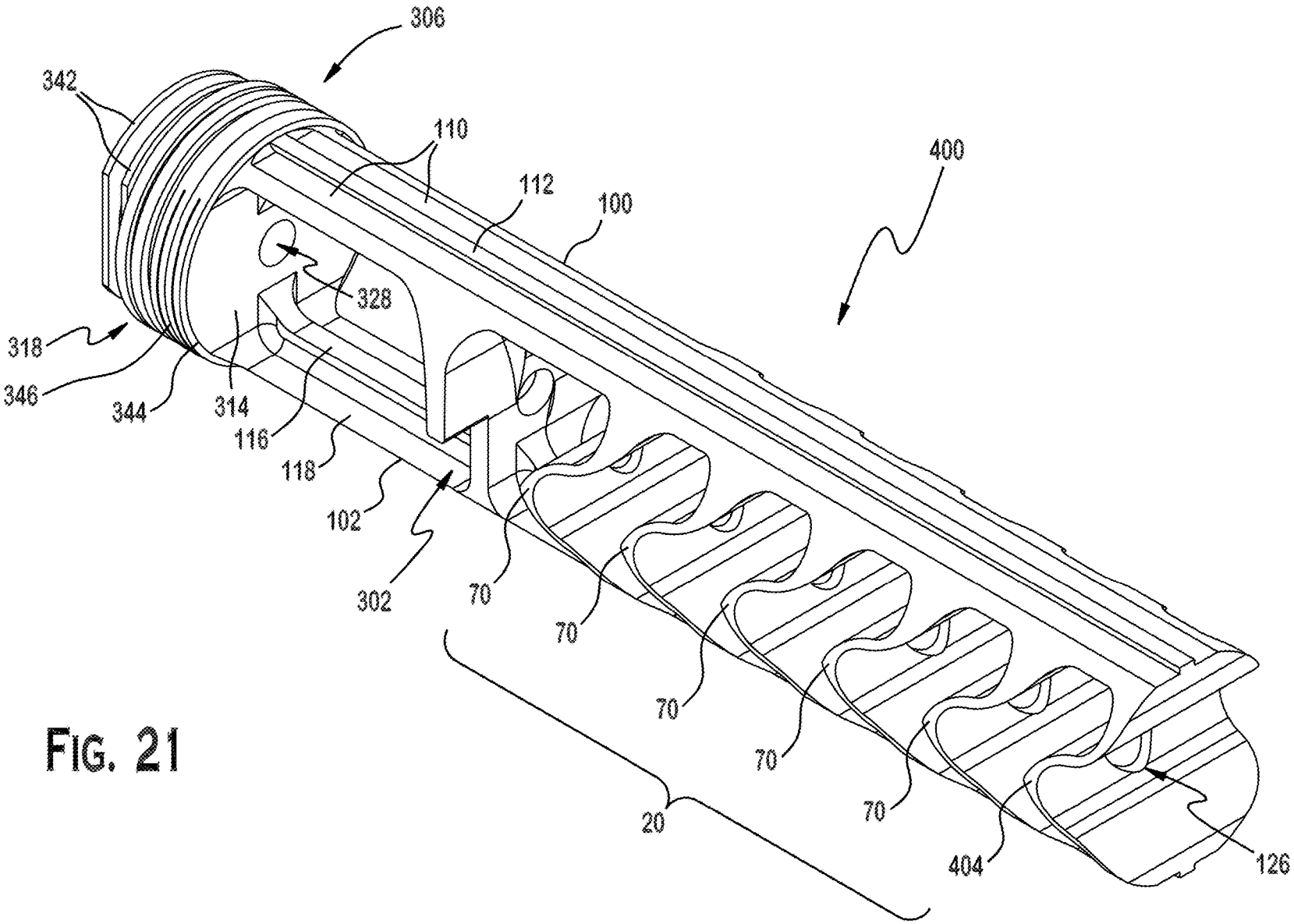
FIG. 21 is a perspective view of the core of FIG. 20.
Figure 22:
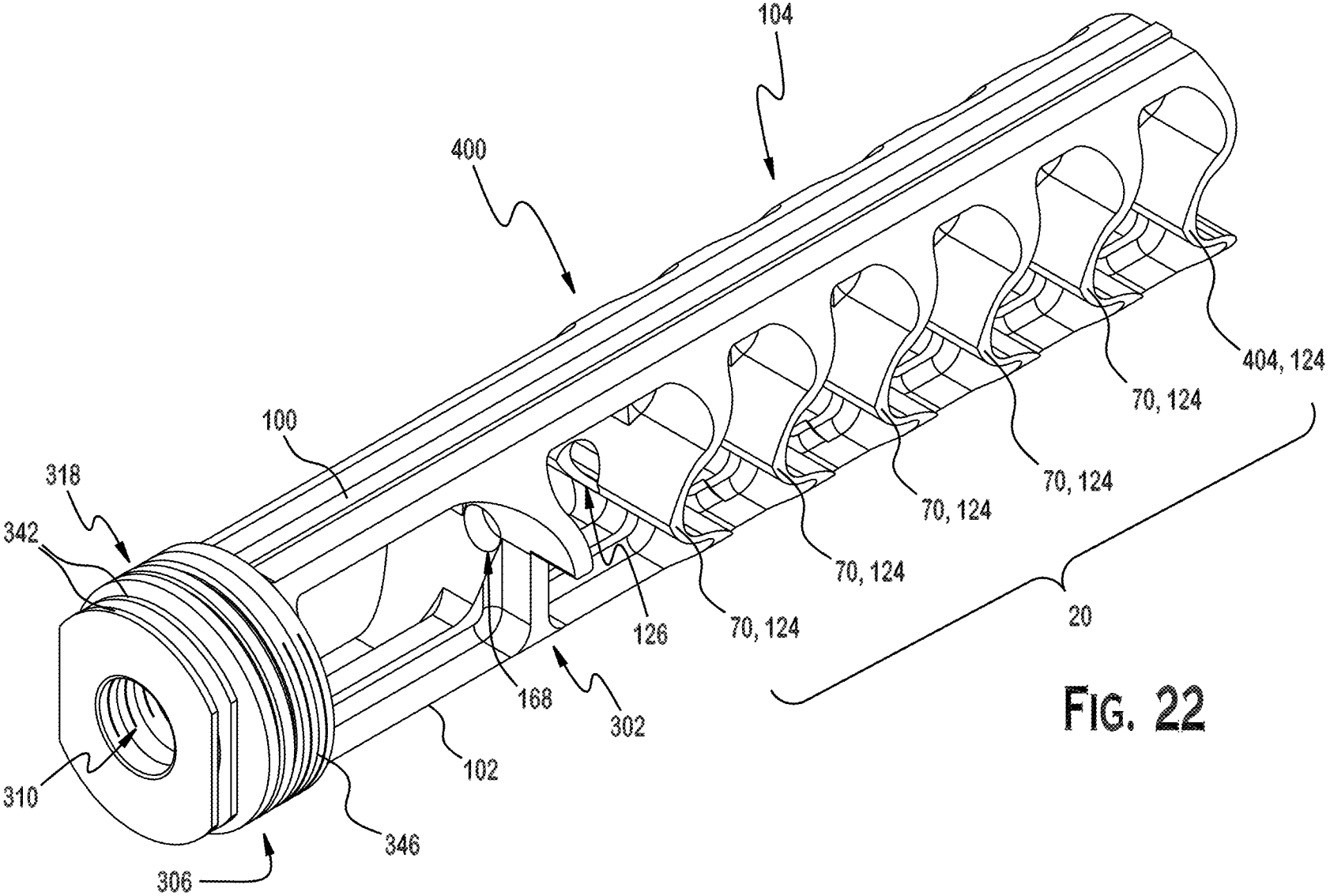
FIG. 22 is another perspective view of the core of FIG. 20.
Figure 23:
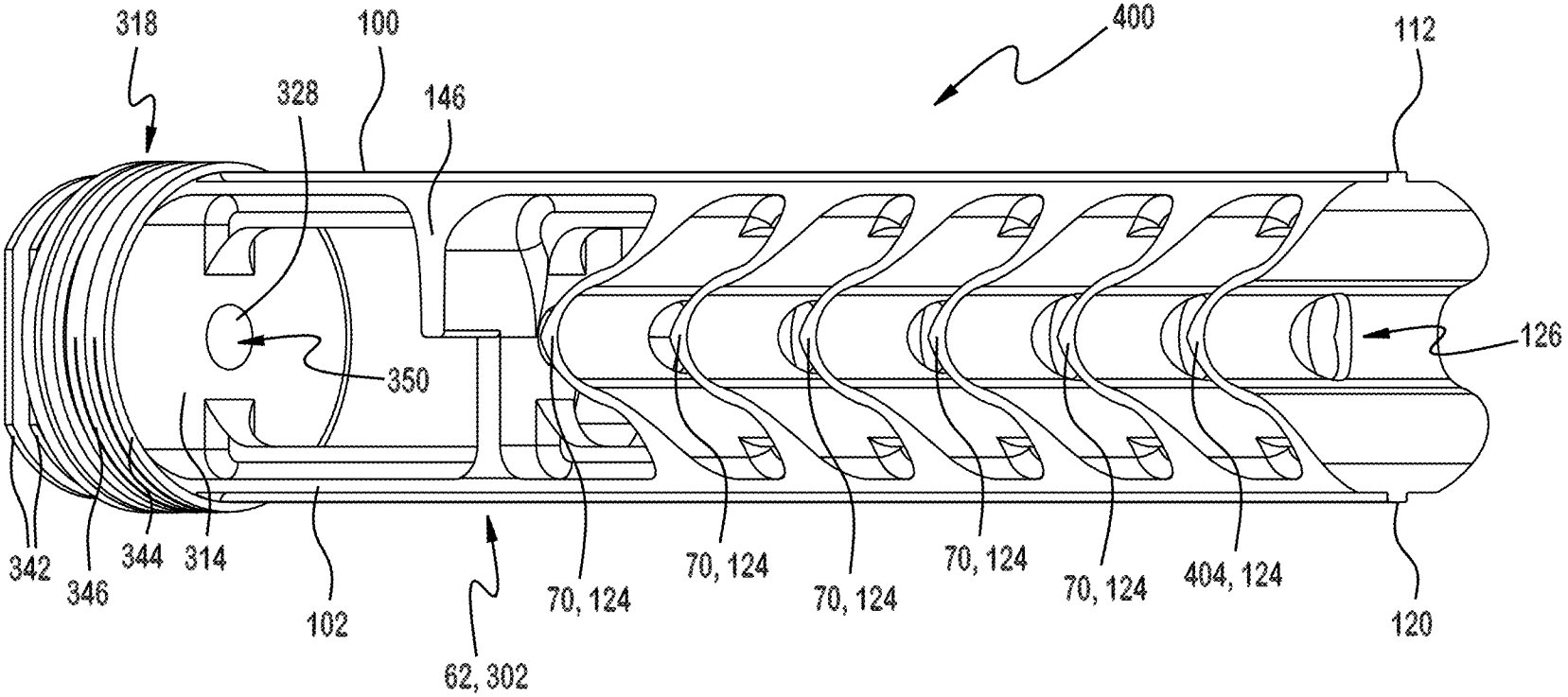
FIG. 23 is another perspective view of the core of FIG. 20.
Figure 24:
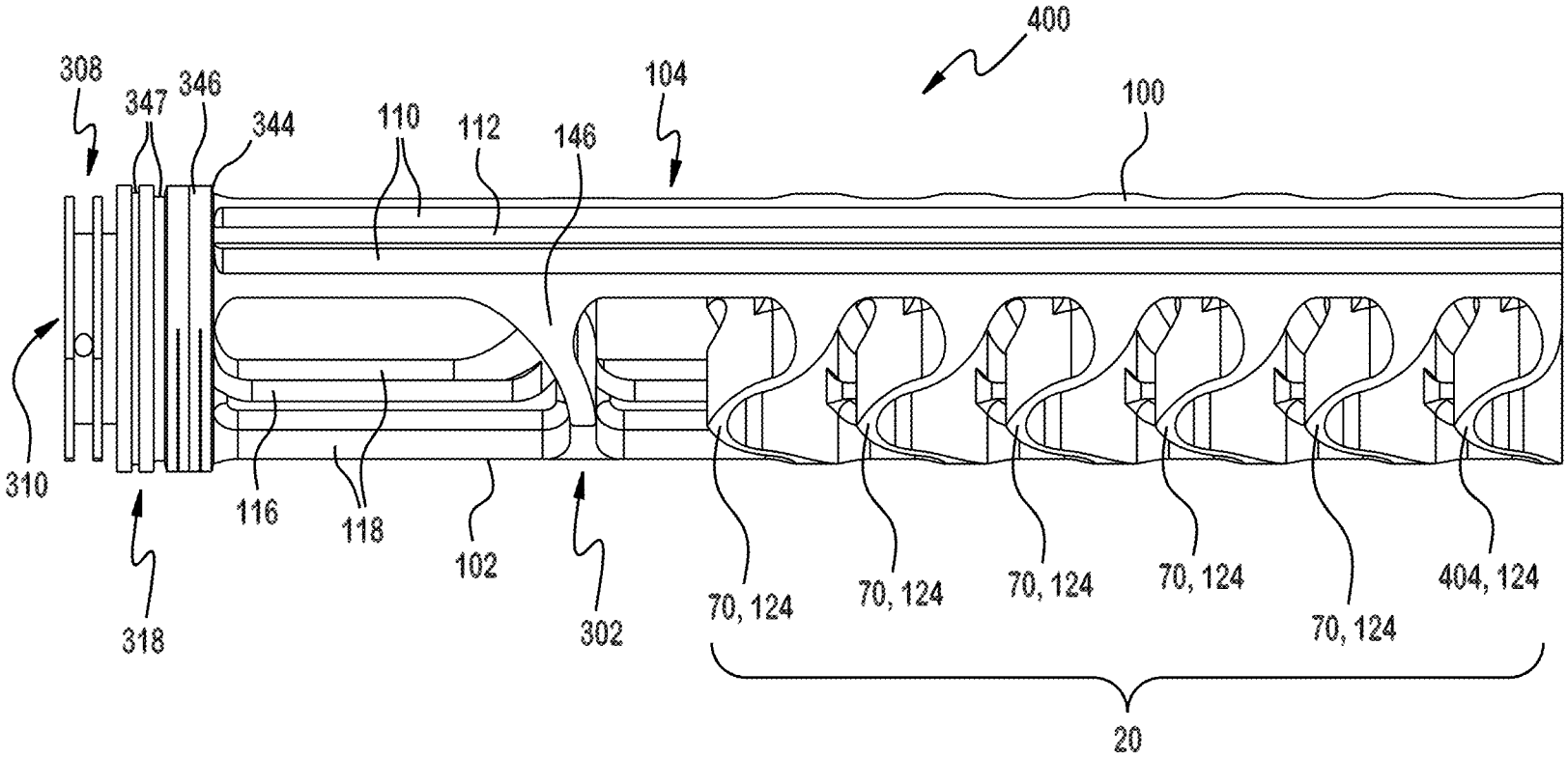
FIG. 24 is yet another perspective view of the core of FIG. 20.

Another exemplary embodiment of a suppressor is disclosed in FIGS. 18-26. Referring to FIG. 18, FIG. 19, the suppressor 10 may include a core 400 and a tube 402. As shown in FIG. 21, FIG. 22, and FIG. 23, the core 400 may include a proximal end cap 306, a self-torquing feature 302, and an array of baffles 20. More particularly, as shown in FIG. 23, FIG. 24, FIG. 25, and FIG. 26 the array of baffles 20 may include five pressure modulation baffles 70, and an exit baffle 404. Although the proximal endcap 306 may possess substantially the same features as in the embodiment of FIG. 13, the proximal endcap 306 may not include the nozzle 316. Still, the configuration, dimensions, and spacing of the self-torquing feature 302 and the pressure modulation baffles 70 may be substantially the same as in the core 28 of FIG. 2 and the core 300 of FIG. 13. In this embodiment, referring to FIG. 18, FIG. 19, and FIG. 20, the distal endcap 406 and discharge port 408 may be part of the tube 402. Referring to FIG. 20, the core 400 may be telescopically received in the tube 402 and secured by mating screw threads on the outer surface 346 of the sidewall 344 and the inner surface of the tube, respectively.

Figures 27, 28:
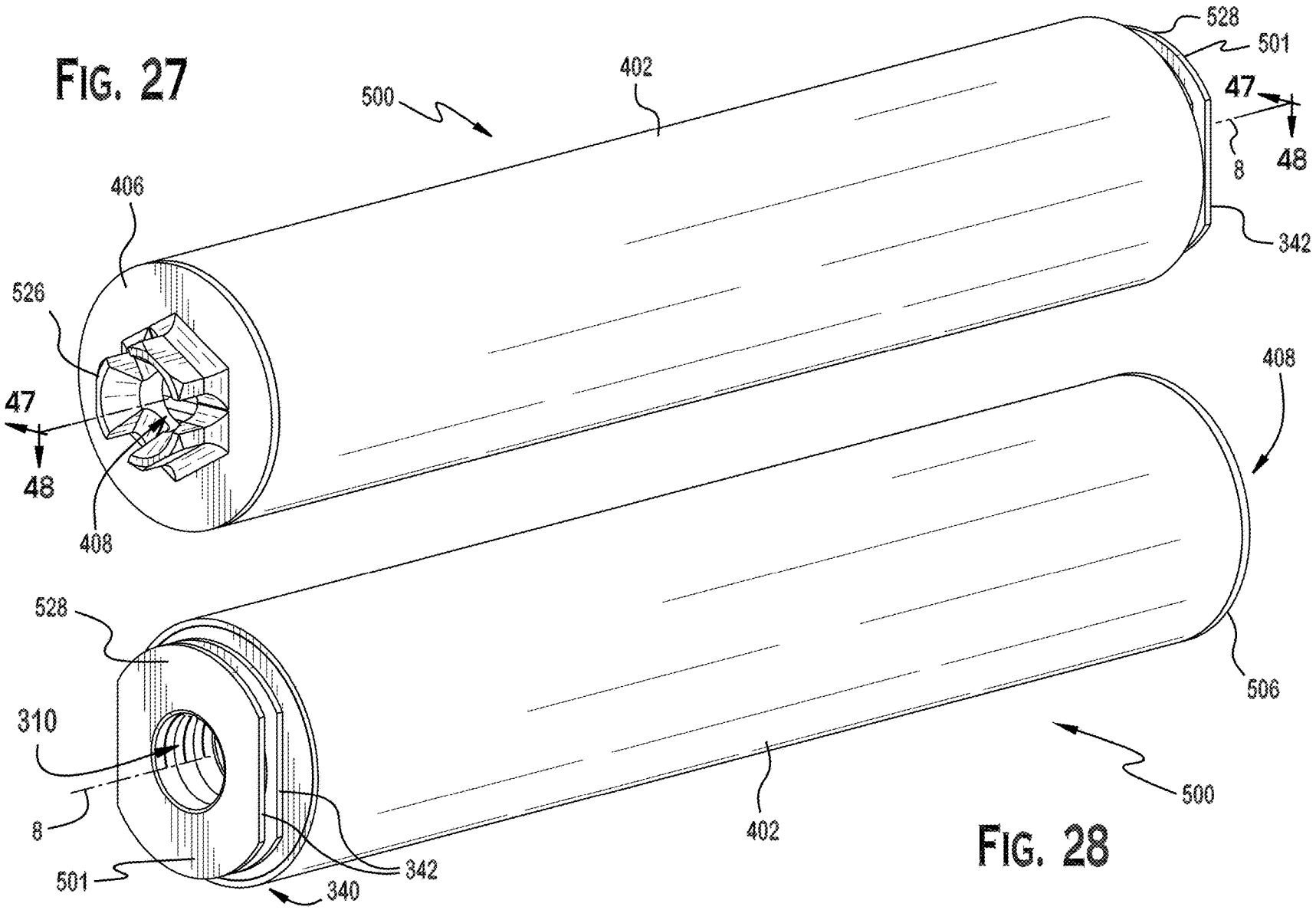
FIG. 27 is a perspective view of a preferred embodiment of a suppressor.
FIG. 28 is another perspective view of the suppressor of FIG. 27.
Figure 31:
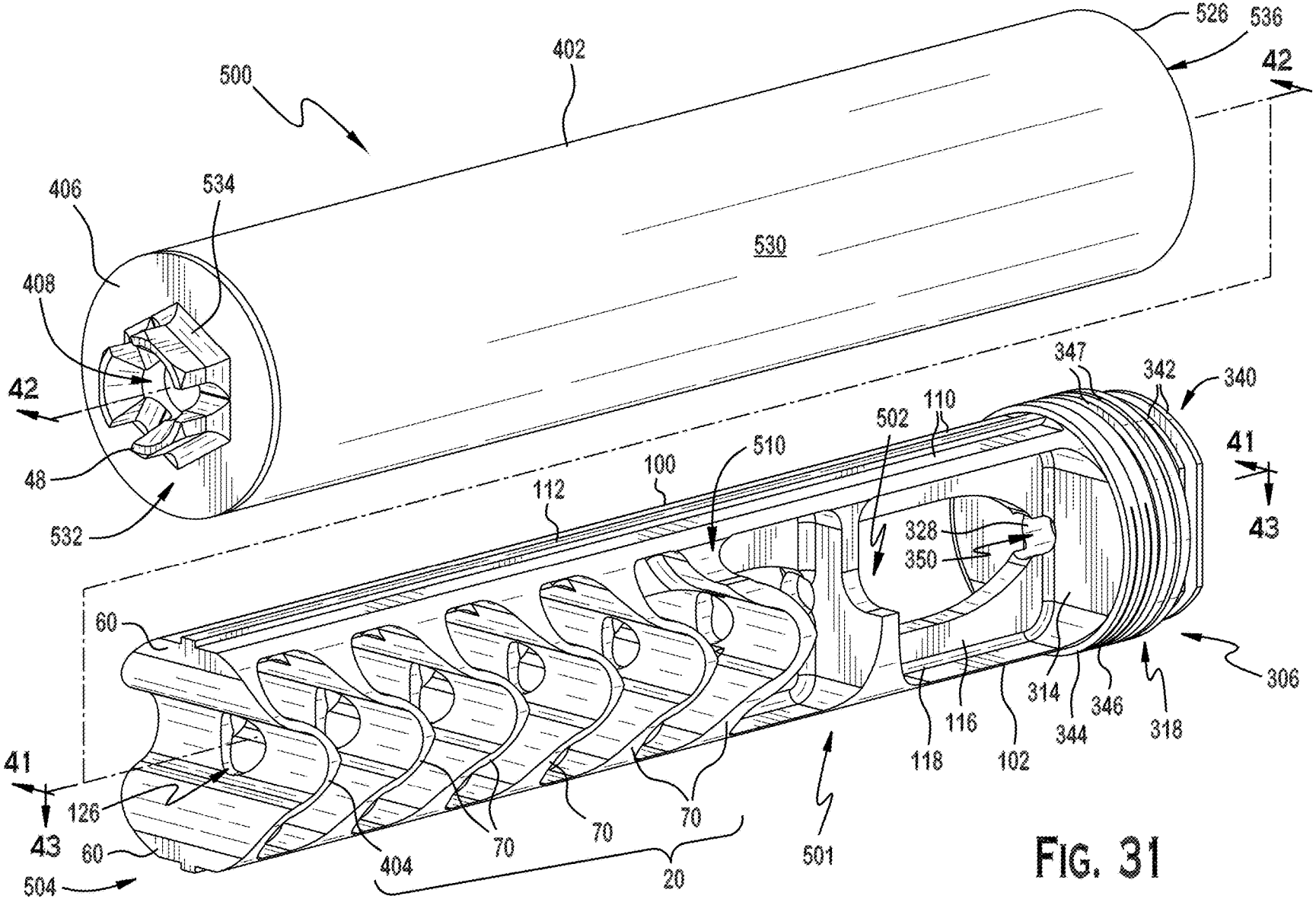
FIG. 31 is an exploded view of the suppressor of FIG. 27.
Figure 32:
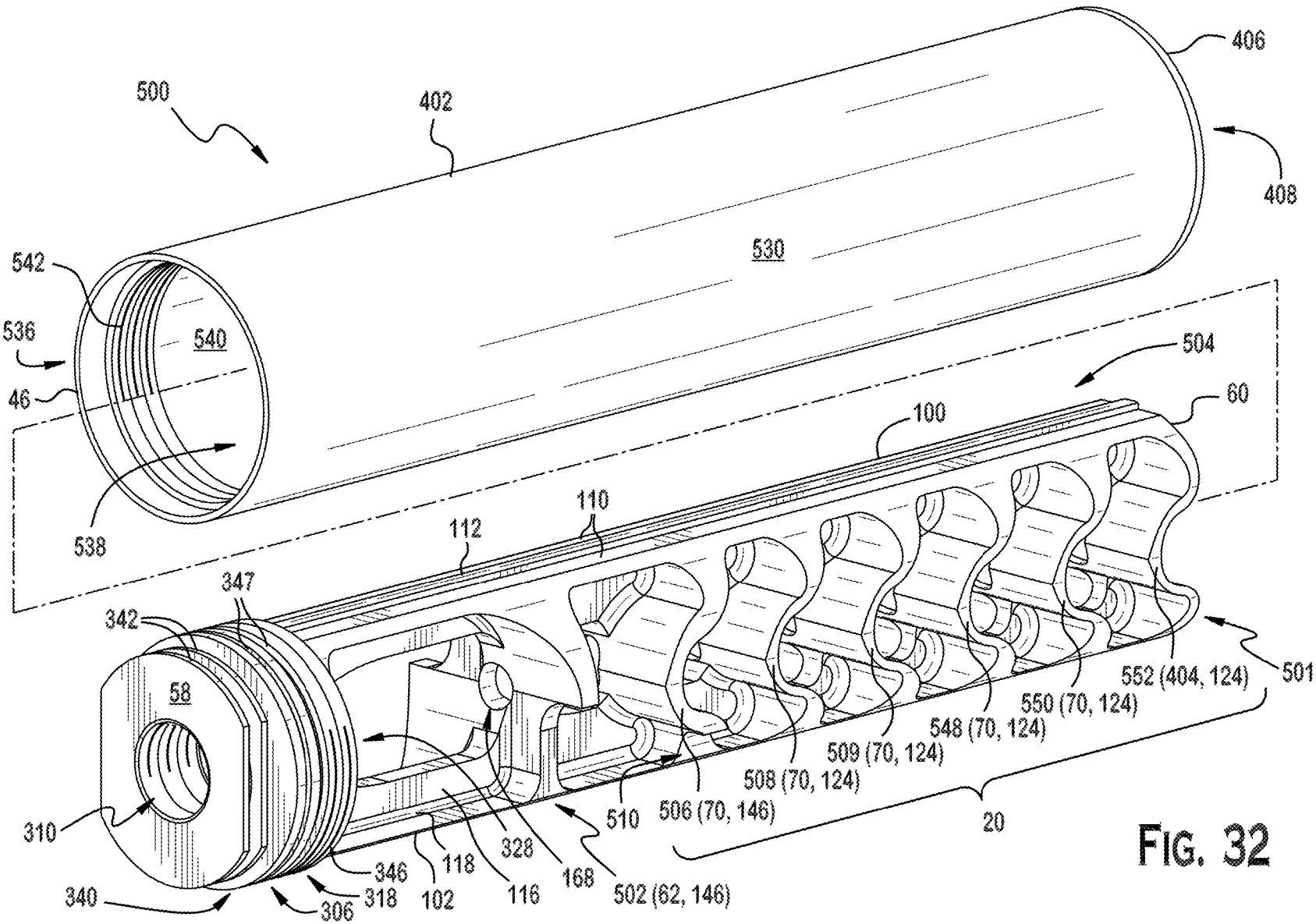
FIG. 32 is another exploded view of the suppressor of FIG. 27.

A preferred embodiment of a suppressor 500 is disclosed in FIGS. 27-50. As shown in FIG. 27 and FIG. 28, the suppressor 500 may include a tube 402 and a core 501. Referring to FIG. 31 and FIG. 32, the core 501 may be telescopically received in the tube 402. Generally, referring to FIG. 32, the configuration, dimensions, and spacing of the self-torquing feature 502, the pressure modulation baffles 70 and discharge port 408 may be the same as in the core 400 of FIG. 21, but the frame 504, self-torquing feature 502, and the lead pressure modulation baffle 506 (70, 146) may be structurally modified to accommodate dynamic forces and elevated temperatures and pressures which may be generated during use.

Exemplary dimensions for the suppressor 500 are presented in Tables 1-4 (below). More particularly, Table 1 presents exemplary length dimensions for the suppressor 500. Table 2 presents exemplary diameter dimensions for the suppressor 500. Table 3 presents exemplary area dimensions for the suppressor 500. Table 4 presents exemplary volume dimensions for the suppressor 500.

Figure 29:
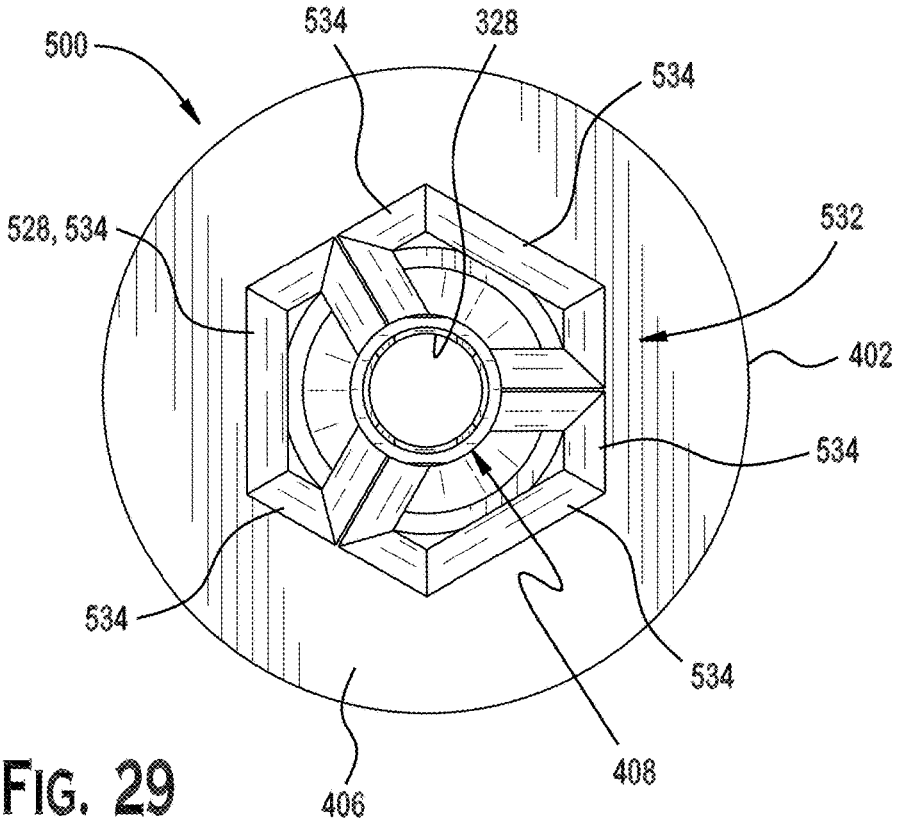
FIG. 29 is a front view of the suppressor of FIG. 27.
Figure 30:
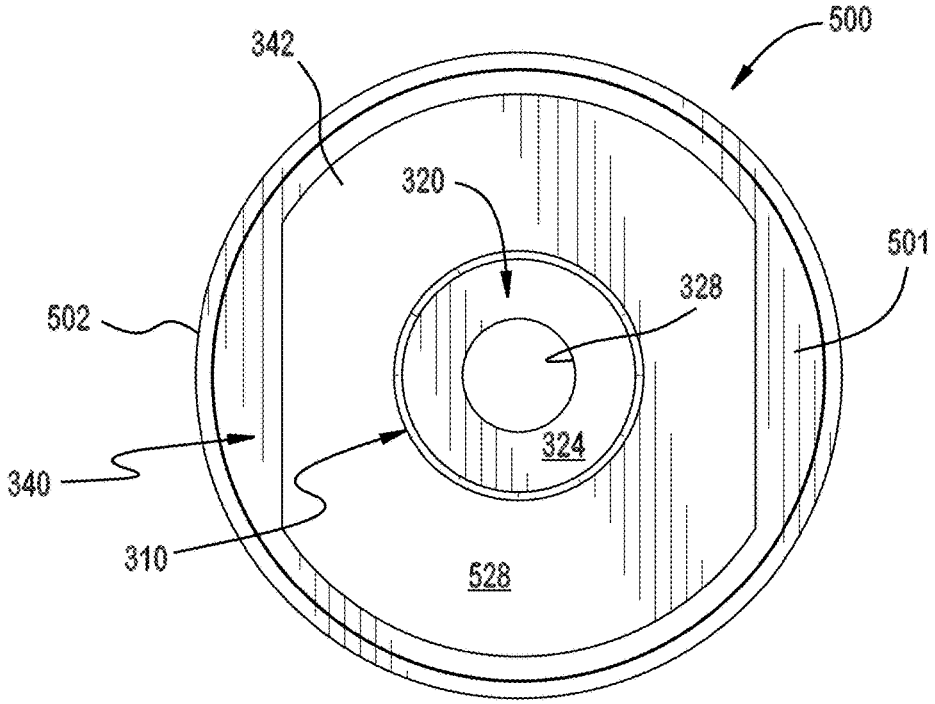
FIG. 30 is rear view of the suppressor of FIG. 27.
Figure 42:
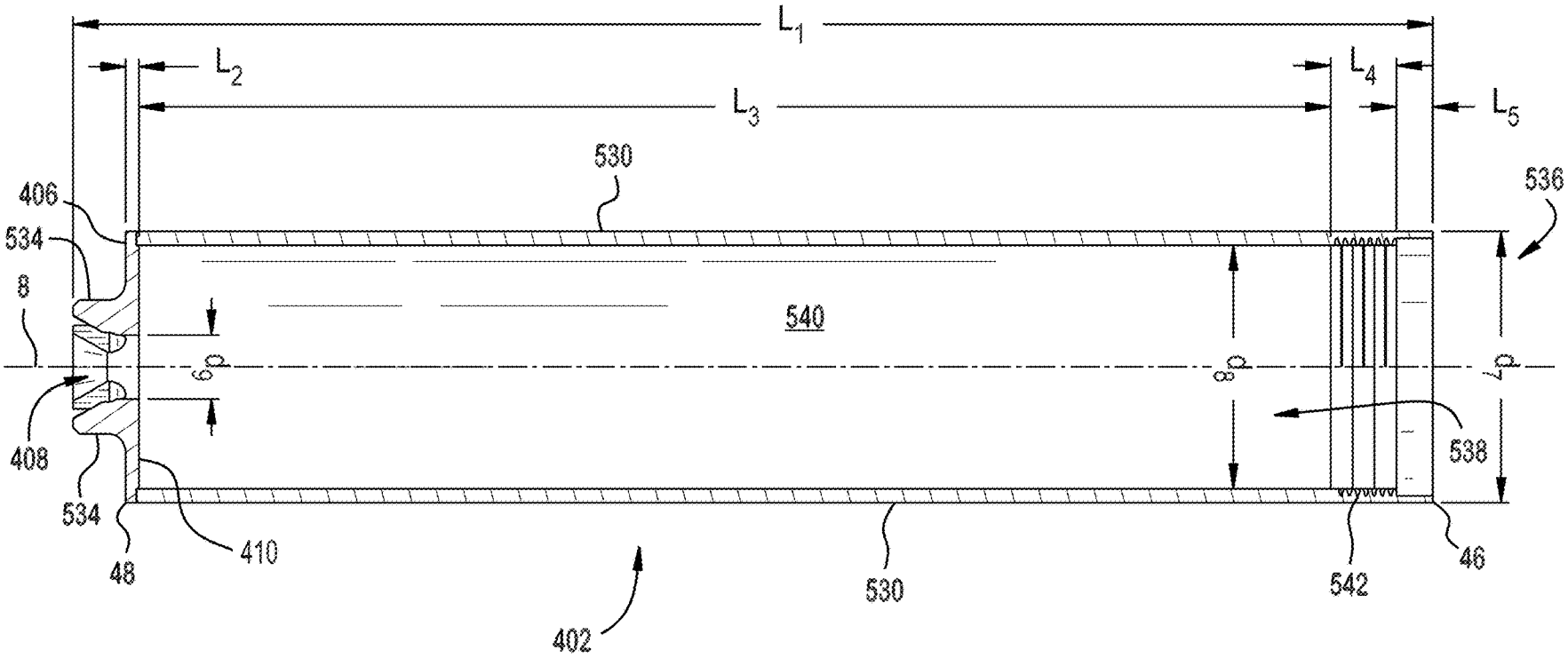
FIG. 42 is a cross-sectional view of the tube of FIG. 31, along line 42-42.

Referring to FIG. 31, FIG. 32, and FIG. 42, the tube may include a proximal end 526 and a distal end 527. The tube 402 further may include a distal end cap 406. The tube 402 may include an outer surface 530 that extends from the proximal end 526 to the distal end cap 406. The distal end cap 406 may include a tool fitting 532. Referring to FIG. 29, the tool fitting 532 may be disposed between the distal end cap 406 and the distal end 528 of the tube. The tool fitting 532 may include a plurality of facets 534. Preferably the tool fitting 532 may include six facets 534 which are arranged to form a hexagonal shaped fitting. Generally, however, the tool fitting 532 may include at least one pair of opposing facets such that an appropriately sized open end wrench may be used to hold or manipulate the tube. Further still, the distal end may include a discharge port 408.

Referring to FIG. 42, the proximal end 46 of the tube further may include a proximal opening 536. A receptacle 538 may extend from the proximal opening 536 to the distal end wall 410. The passage may be bounded by an interior side wall 540. For instance, the interior side wall 540 may include a screw thread 542 that is configured and dimensioned to mate with a screw thread on the core 501. See Table 1 and Table 2 (below) for exemplary dimensions for the suppressor tube 402.

Figure 36:
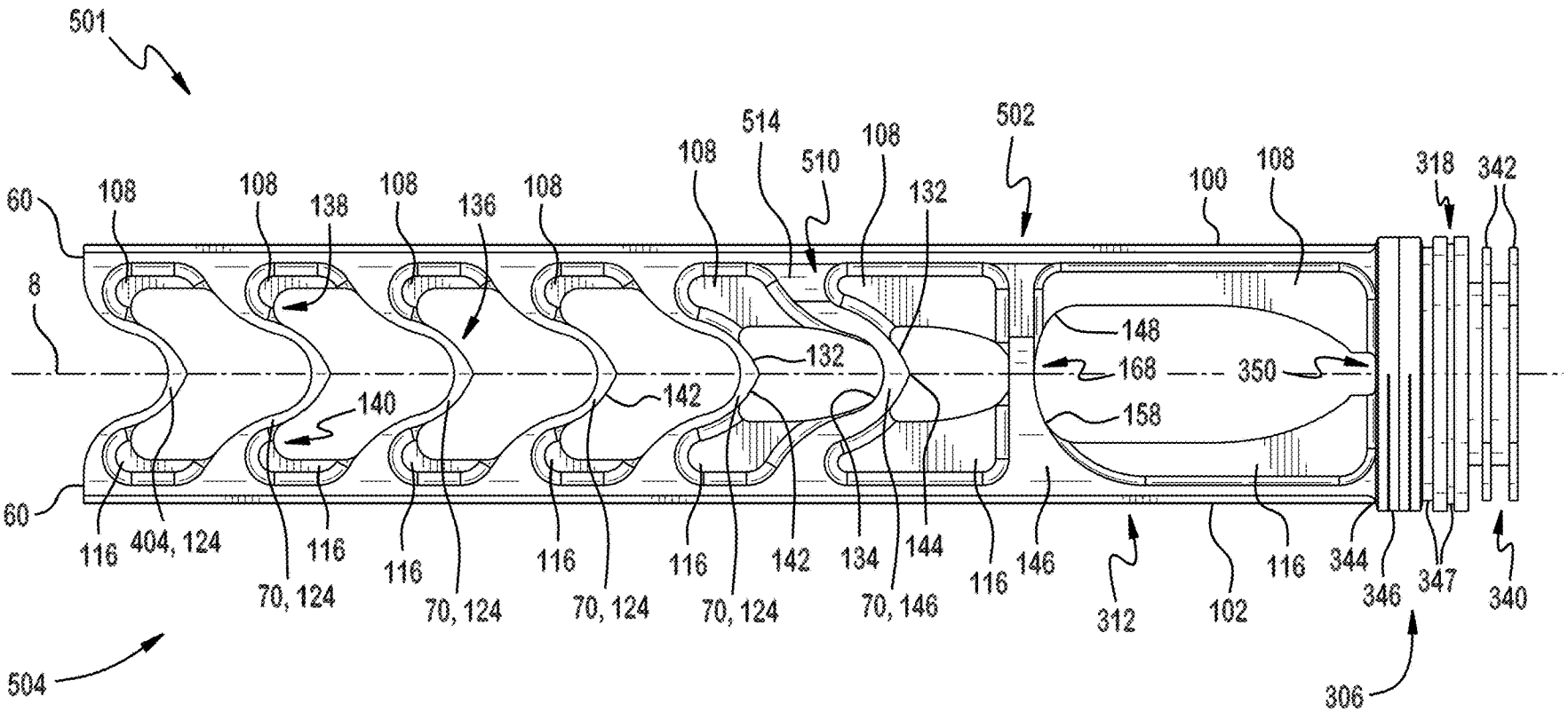
FIG. 36 is a right side view of the core of FIG. 33.
Figure 39:
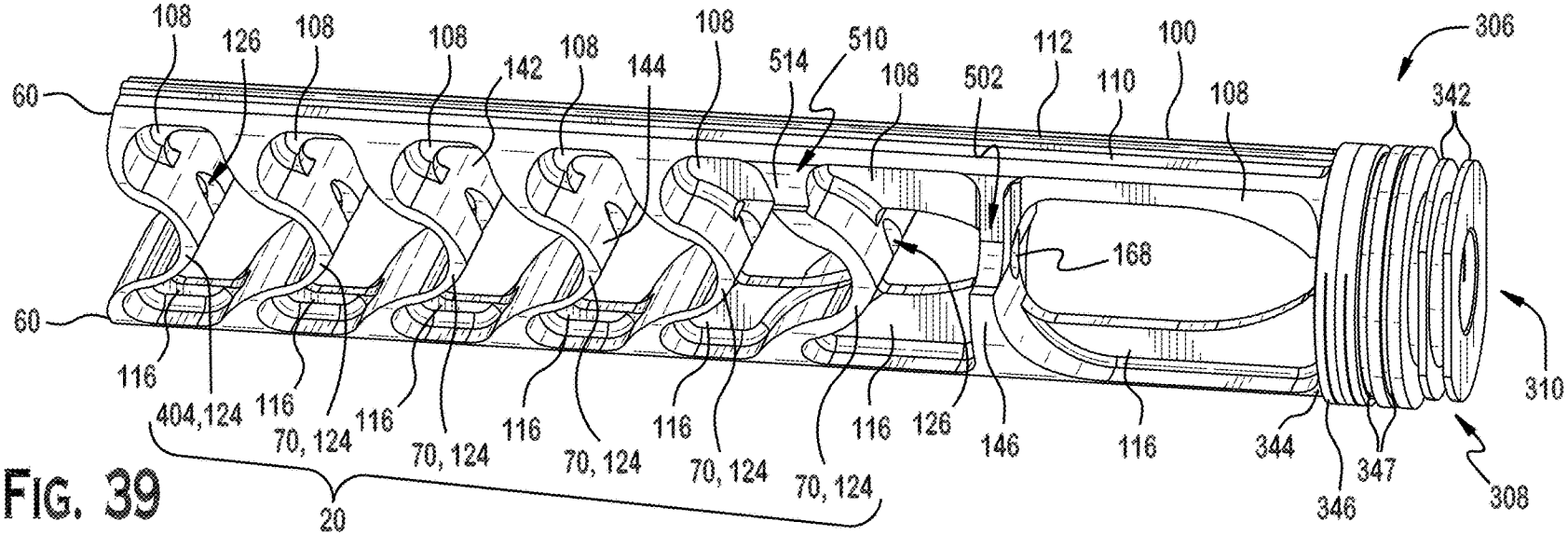
FIG. 39 is front right side perspective view of the core of FIG. 33.

As shown in FIG. 31, FIG. 36 and FIG. 39, the core 501 may include a proximal endcap 306, a self-torquing feature 502, and an array of baffles 20. More particularly, the array of baffles 20 may include five pressure modulation baffles 70, and an exit baffle 404. Referring to FIG. 42, as in the embodiment of FIG. 20, the distal endcap 406 and discharge port 408 may be part of the tube 402. Also, referring to FIG. 47 and FIG. 48, the core 501 may be telescopically received in the tube 402 and secured by mating screw threads on the outer surface 346 of the sidewall 344 and the inner surface of the tube, respectively.

TABLE 1

Exemplary Length Dimensions for Suppressor (500)

| Dimension | Description | Length (inches) | FIG. |
|---|---|---|---|
| L1 | Tube (402), overall length (including distal fitting) | 10.275 | 42 |
| L2 | Tube (402), endcap (406) thickness | 0.100 | 42 |
| L3 | Tube (402), distal endwall (410) to screw thread (542) | 9.002 | 42 |
| L4 | Tube (402), screw thread area | 0.498 | 42 |
| L5 | Tube (402), gas block area | 0.275 | 42 |
| L6 | Core (501), max. width of STF (502) | 1.648 | 43 |
| L7 | Core (501), thickness of STF (502) | 0.178 | 43 |
| L8 | Core (501), thickness of baffle 1 (506) | 0.186 | 43 |
| L9 | Core (501), thickness of baffle 2 (508) | 0.136 | 43 |
| L10 | Core (501), thickness of baffle 3 (509) | 0.136 | 43 |
| L11 | Core (501), thickness of baffle 4 (548) | 0.136 | 43 |
| L12 | Core (501), thickness of baffle 5 (551) | 0.136 | 43 |
| L13 | Core (501), thickness of baffle 6 (552) | 0.136 | 43 |
| L14 | Suppressor (500), overall length | 10.625 | 47 |
| L15 | Core (501), distance from proximal end wall (314) to Self-Torquing Feature (502) | 2.411 | 48 |
| L16 | Core (501), distance from Self-Torquing Feature (62, 168) to baffle 1 (506) | 0.878 | 48 |
| L17 | Core (501), distance from baffle 1 (506) to baffle 2 (508) | 1.060 | 48 |
| L18 | Core (501), distance from baffle 2 (508) to baffle 3 (509) | 1.010 | 48 |
| L19 | Core (501), distance from baffle 3 (509) to baffle 4 (548) | 1.010 | 48 |
| L20 | Core (501), distance from baffle 4 (548) to baffle 5 (550) | 1.010 | 48 |
| L21 | Core (501), distance from baffle 5 (550) to baffle 6 (552) | 1.010 | 48 |
| L22 | Suppressor (500), distance from baffle 6 (404, 126) to distal endwall (410) | 0.732 | 48 |

Figure 40:
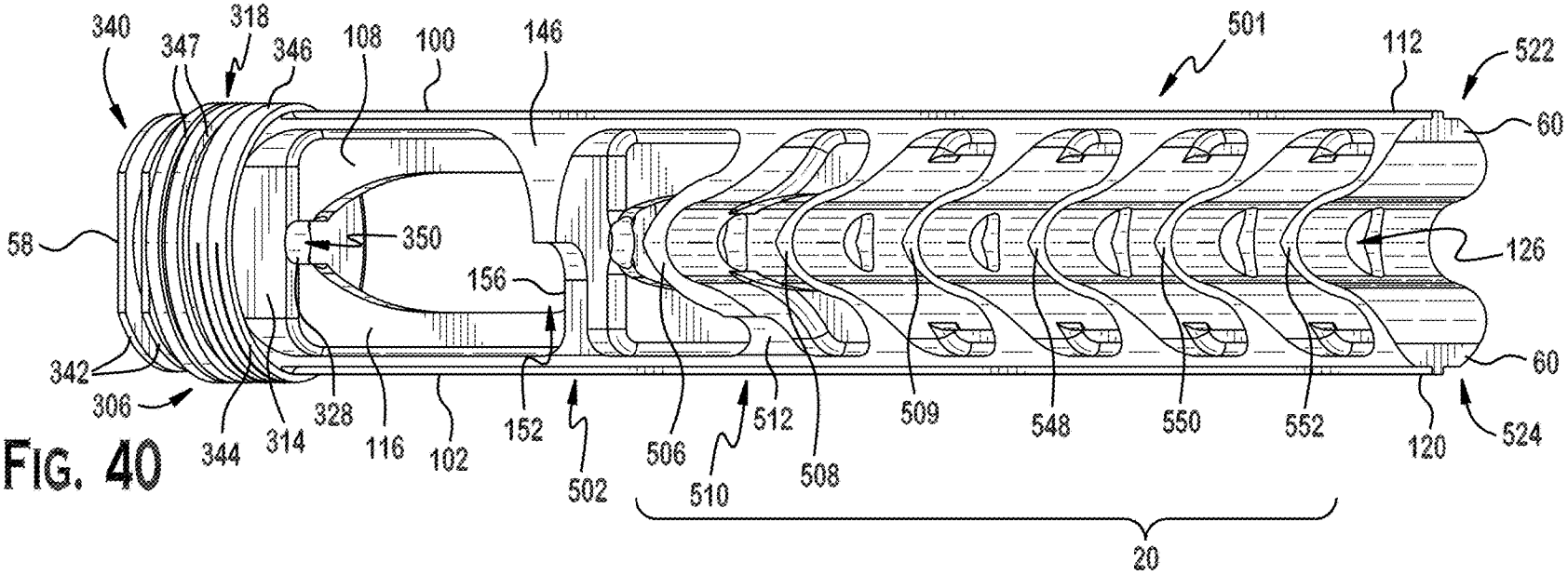
FIG. 40 is front left side perspective view of the core of FIG. 33.
Figure 49:
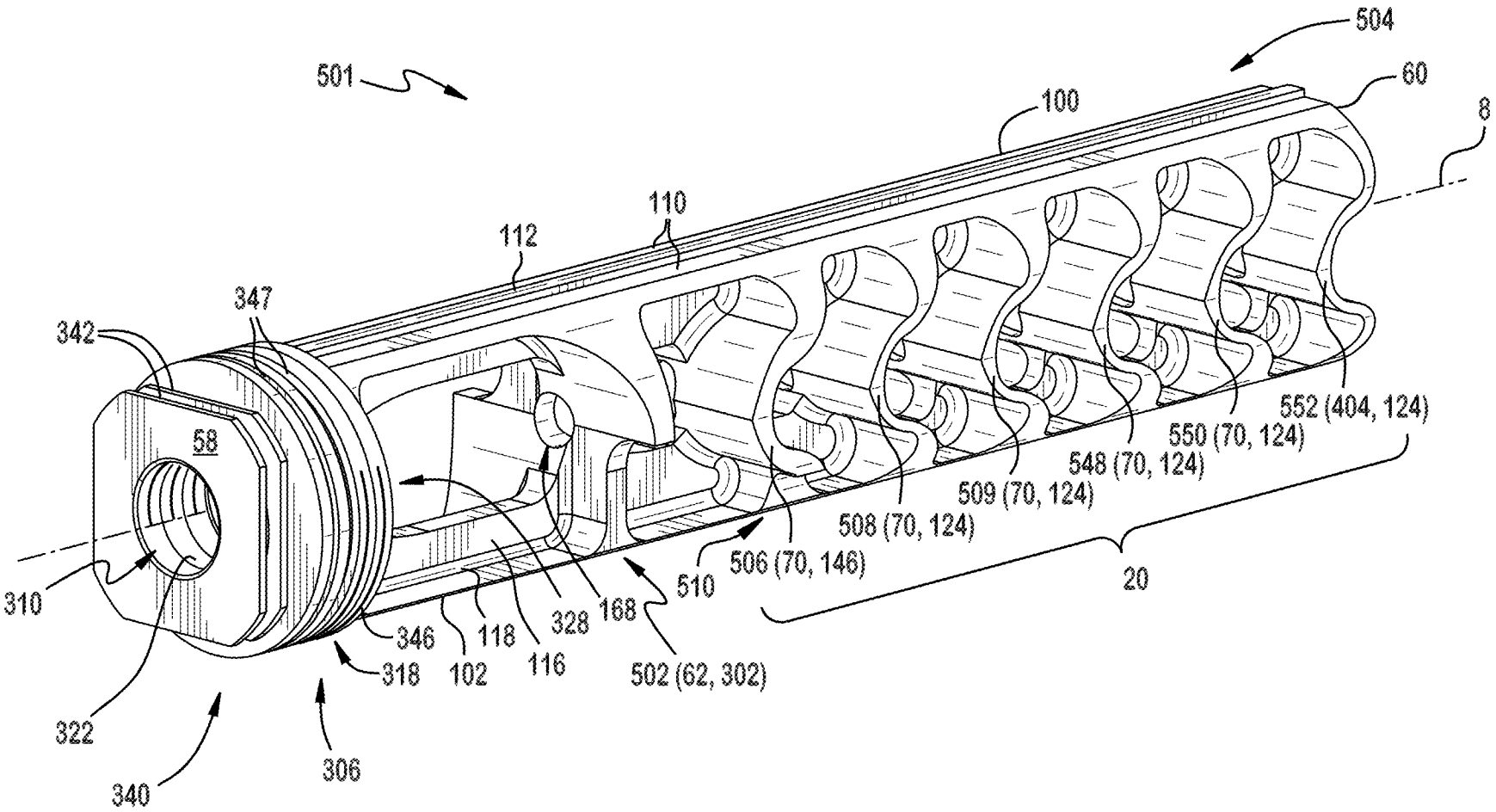
FIG. 49 is a rear left side perspective view of a core of FIG. 33, with a four sided fitting.
Figure 50:
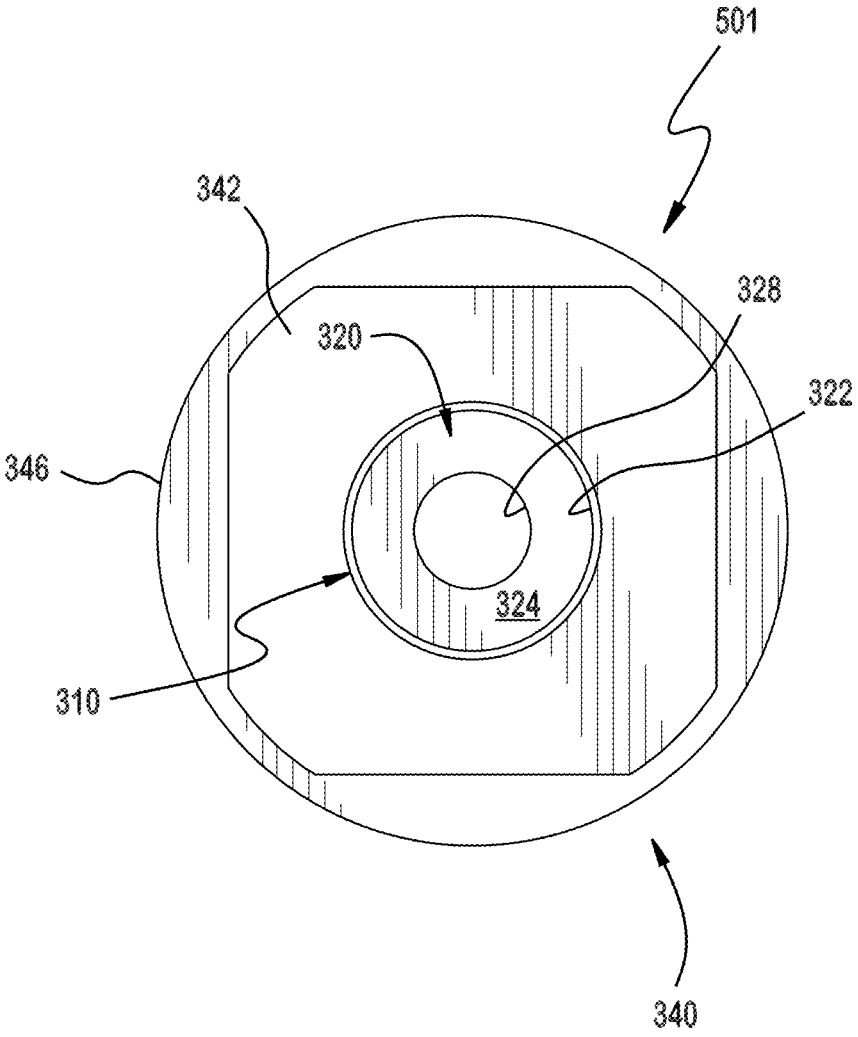
FIG. 50 is a rear view of a core of FIG. 49.

Referring to FIG. 31 and FIG. 40, the proximal cap 306 may include a proximal end wall 314 and a side wall 344 which may extend around the periphery of the proximal end wall 314. The proximal end cap further may include an outer surface adjacent to the side wall 344. The outer surface may include a screw thread. The proximal end cap 306 further may include a gas block 318 disposed between the outer surface 346 and the proximal end 58 of the core. Referring to FIG. 32 and FIG. 40, the proximal end cap 306 may include an exterior fitting 340 adjacent to the proximal end 58 of the core. The exterior fitting 340 may be substantially the same as previously described. Referring to FIG. 49 and FIG. 50, however, other configurations may be used. For example, the fitting may possess a rounded square shape. An exterior fitting 340 possessing a rounded square profile may facilitate tool access to the fitting during installation or removal of the suppressor from the barrel of the firearm.

TABLE 2

Exemplary Diameter Dimensions for Suppressor (500)

| Dimension | Description | Diameter (inches) | FIG. |
|---|---|---|---|
| D00 | Bore, 328 | 0.3600 | 41 |
| D0 | Aperture of STF, (502) | 0.3600 | 41 |
| D1 | Aperture of Baffle 1 (506) | 0.4000 | 41 |
| D2 | Aperture of Baffle 2 (508) | 0.4000 | 41 |
| D3 | Aperture of Baffle 3 (509) | 0.4000 | 41 |
| D4 | Aperture of Baffle 4 (548) | 0.4800 | 41 |
| D5 | Aperture of Baffle 5 (550) | 0.4800 | 41 |
| D6 | Aperture of Baffle 6 (552) | 0.4800 | 41 |
| D7 | Outer diameter of tube (402) | 2.0500 | 42 |
| D8 | Inner diameter of tube (402) | 1.8400 | 42 |
| D9 | Discharge port, 408 | 0.4800 | 42 |
| D10 | OD of Baffle 1 (506) Typ. | 1.8250 | 43 |
| D11 | Muzzle receiving opening, 310 | 0.7400 | 47 |
| D12 | Distal annular surface (334) | 1.0090 | 47 |

Figure 47:
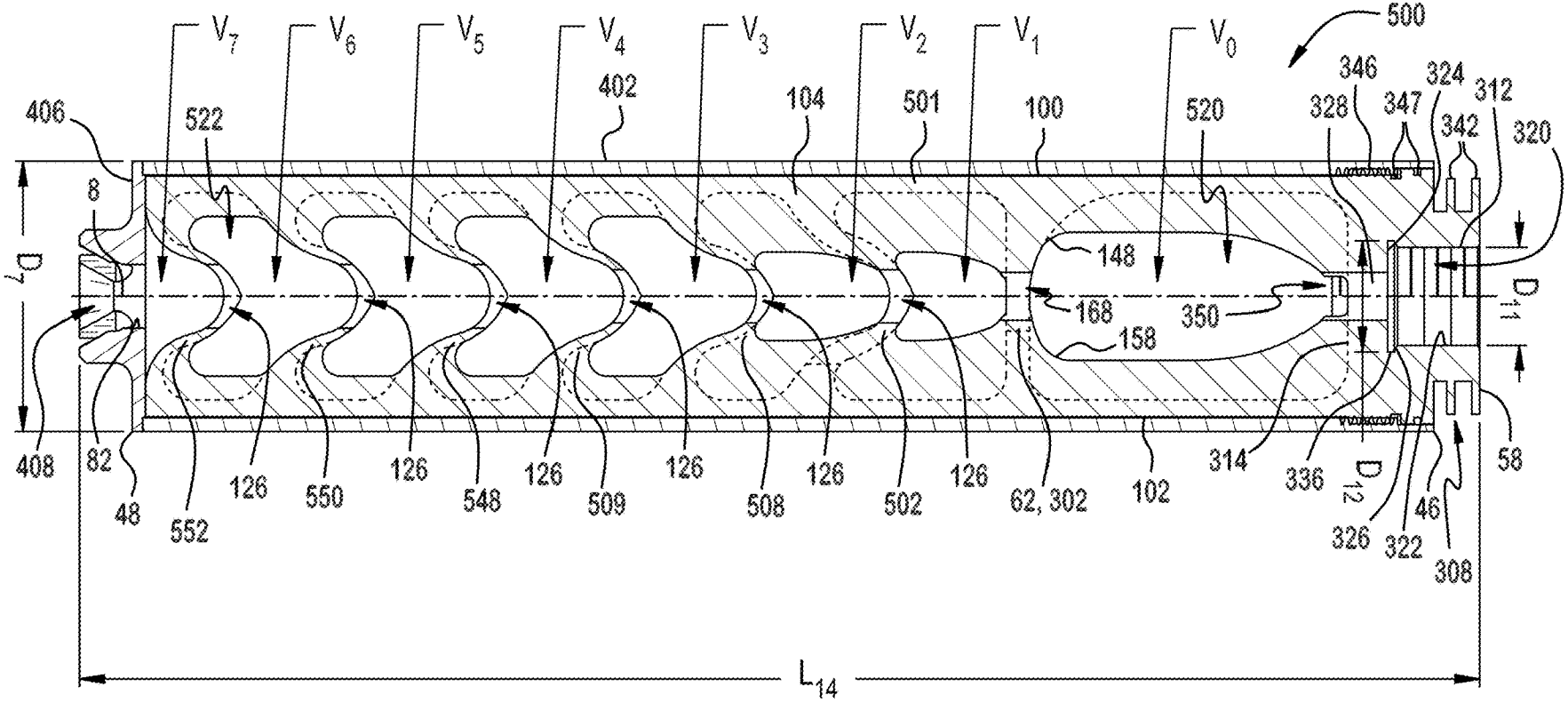
FIG. 47 is a cross-sectional view of the tube of FIG. 27, along line 47-47.

Referring to FIG. 28, FIG. 30, FIG. 32, FIG. 38, FIG. 47 and FIG. 49, the proximal end 58 of the core may include an opening 310 for receiving the muzzle of a firearm. As described above, the opening 310 for receiving the muzzle of a firearm may extend from the proximal end 58 of the core to a muzzle seating chamber 320 inside the proximal end cap 306 (FIG. 34) The opening 310 further may include a side wall 322 and a cross-section perpendicular to the central axis 8. Referring to FIG. 47, the cross-section of the opening 310 may have circular shape. The circular shape may possess a diameter. Generally, the diameter may range from approximately ⅝ of an inch to approximately 25/32 of an inch. In this embodiment, the diameter may be approximately 25/32 of an inch. See also, e.g., Table 2 (above).

Referring to FIG. 32, the side wall 322 of the opening 310 further may include a screw thread. The screw thread may be configured and dimensioned to mate with a screw thread on a firearm barrel adjacent to the muzzle. In this embodiment, the opening 310 and screw thread may be configured and dimensioned to receive and mate with the barrel of a M240 machine gun. In other embodiments, the opening 310 may be configured and dimensioned to receive and mate with the barrel of other firearms.

Figure 34:
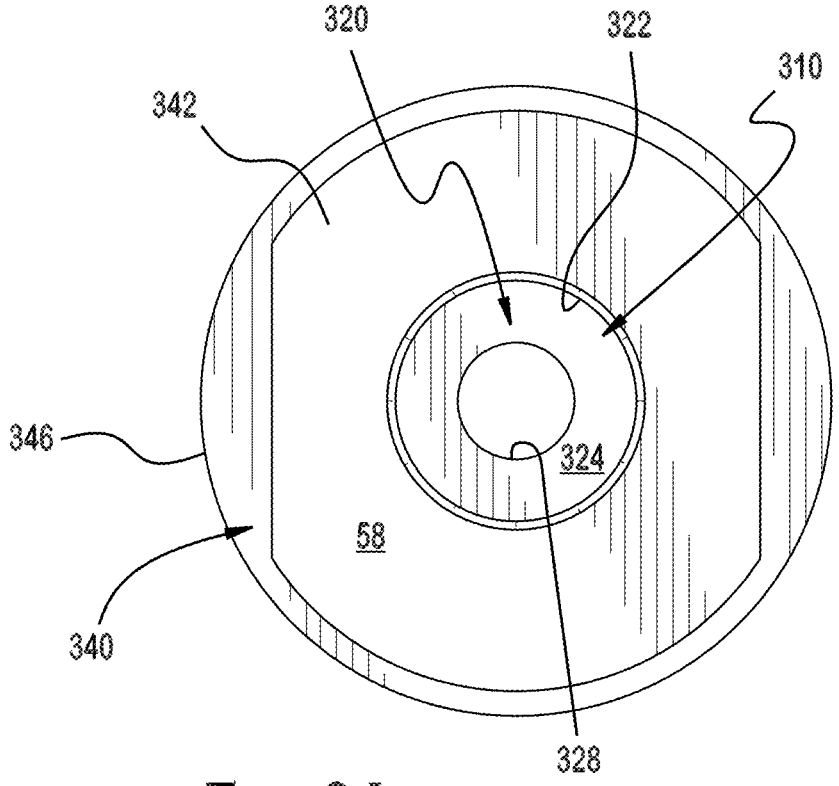
FIG. 34 is a rear view of the core of FIG. 33.
Figure 38:
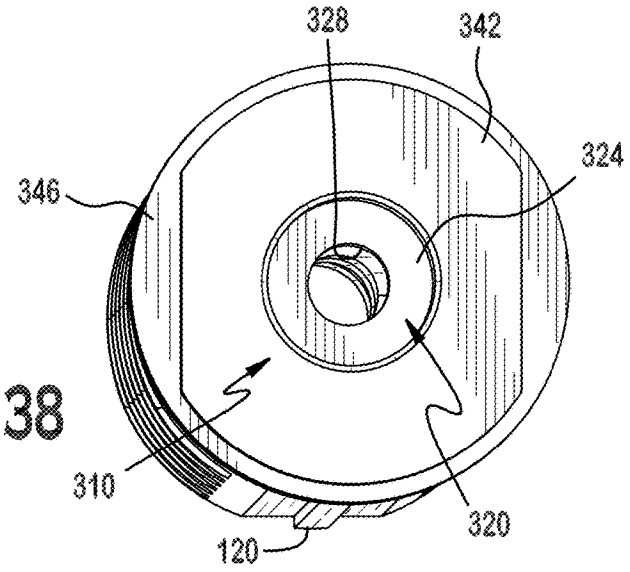
FIG. 38 is a rear right side perspective view of the core of FIG. 33.

Referring to FIG. 34 and FIG. 38, the muzzle seating chamber 320 may abut an end wall 324. As shown in FIG. 34, the muzzle seating chamber 320 may include a cross-section perpendicular to the central axis 8. The outer profile of the cross-section of the muzzle seating chamber may have circular shape. Referring to FIG. 47, the circular shape may possess a maximum outer diameter D12. Generally, the maximum outer diameter D12 of the muzzle seating chamber 320 may be greater than the diameter D11 of the opening. In this embodiment, the maximum outer diameter D12 may be approximately 0.84 inches. Accordingly, the proximal wall 326 of the muzzle seating chamber 320 may be a proximal annular surface. See also, Table 2 (above).

Figure 41:
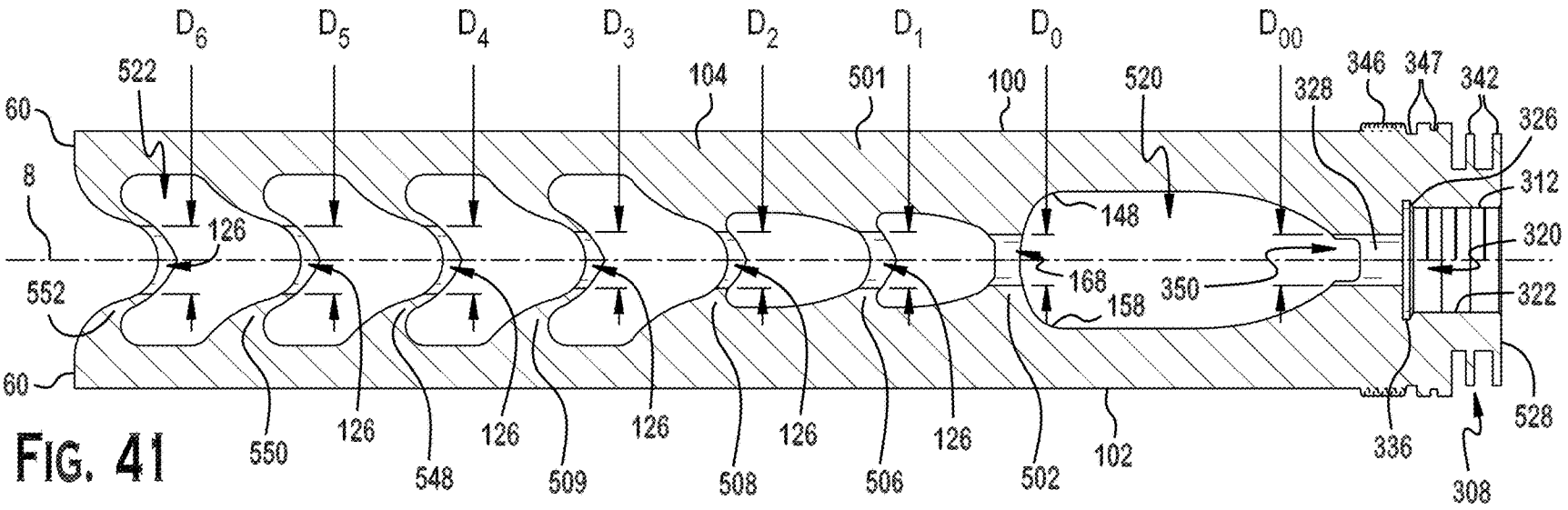
FIG. 41 is a cross-sectional view of the core of FIG. 31, along line 41-41.

Referring to FIG. 41 and FIG. 47, the muzzle seating chamber 320 may be in fluid communication with the blast chamber 520. For example, a bore 328 may extend from the end wall 324 to the proximal end wall 314 in the blast chamber 520. The bore 328 may be configured and dimensioned to allow passage of a bullet from a specific type of ammunition cartridge for which the barrel to be received in the opening is chambered. Hence, the bore 328 may be aligned with the central axis 8 of the discharge port 408, and thus the end wall 324 may form a distal annular surface 334. In use, the distal annual 334 surface may form a seat for the muzzle of a host barrel. For example, a threaded barrel may be advanced through the opening 310 until the muzzle abuts the distal annular surface 334. Further, the threaded barrel may be tightened against the distal annular surface 334 to further secure the barrel-core interface.

In this embodiment, the bore 328 may be configured and dimensioned to allow passage of a bullet from a 7.62×51 NATO ammunition cartridge. Although, in this embodiment the diameter of the bore 328 may be approximately 0.400 inches, the diameter of the bore 328 may possess a different diameter for a host barrel chambered for another type of ammunition cartridge (e.g., 7.62×39 mm and 5.56 NATO, 300 BLK, or others).

Figure 35:
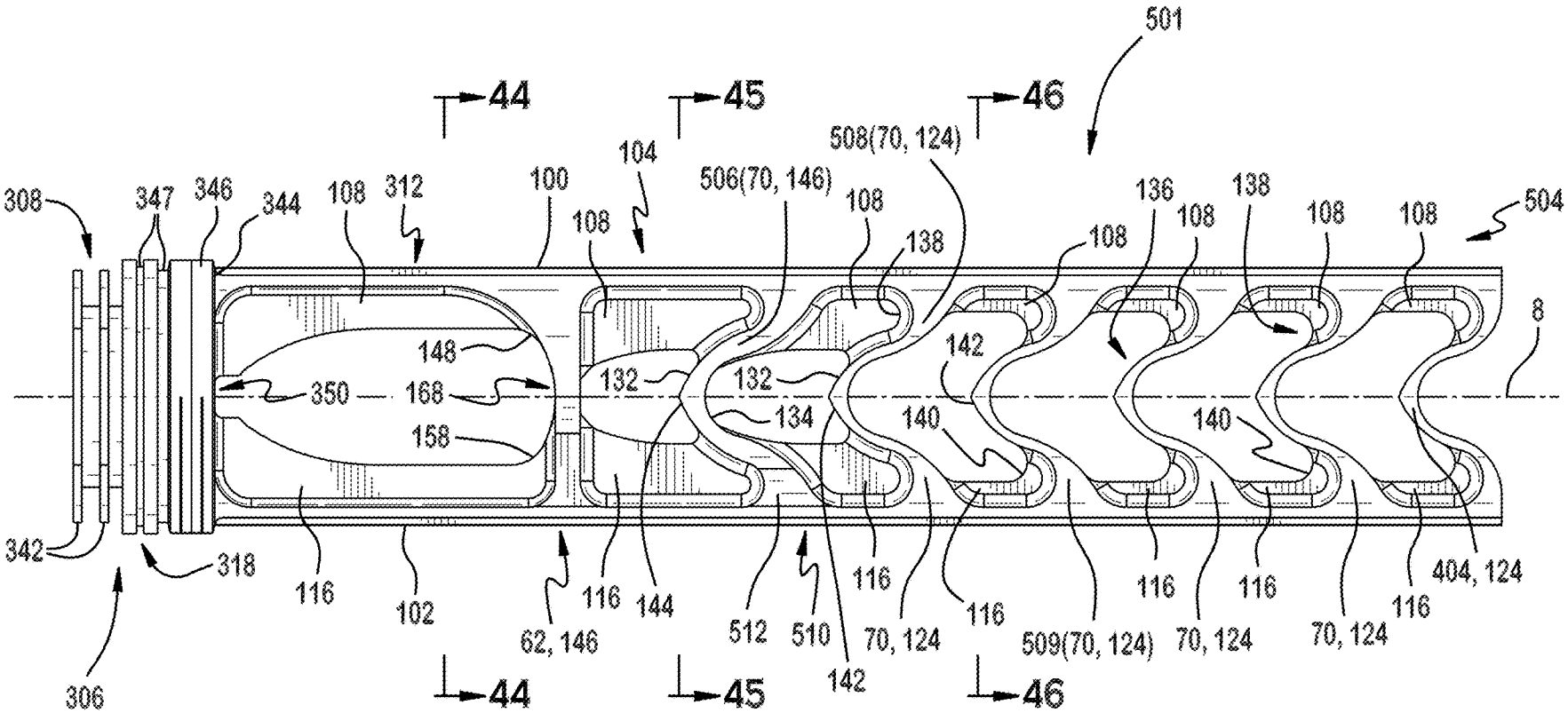
FIG. 35 is a left side view of the core of FIG. 33.

As indicated above, referring to FIG. 35, the self-torquing feature 502 and baffle array 20 may be disposed within a structurally enhanced frame 504. For instance, as shown in FIGS. 35, 41 and 47, the frame 504 may include a superior longitudinal member 100 and an inferior longitudinal member 102 with a deeper beam portion 108, 116 that extends between the proximal end wall 314 and the self-torquing feature 502 (62, 146), the self-torquing feature 502 (62, 146) and the lead pressure modulation baffle 506 (70, 146), and the lead pressure modulation baffle 506 (70, 146) and the second pressure modulation baffle 508 (70, 124). Referring to FIG. 40, the beam portions 108, 116 may extend radially to the bore 328 near the proximal end wall 314, as well as to the aperture 168 on the trailing side of the self-torquing feature 502 (62,146). Similarly, the beam portions 108, 116 may extend radially to the aperture 146 on the trailing side of the lead pressure modulation baffle 506 (70,146) and to the aperture 126 on the trailing side of the second pressure modulation baffle 508 (70,124). Also, referring to FIG. 36, the beam portion 108, 116 between the remaining baffles 509, 548, 550, 552 may be deeper than in the embodiment of FIG. 21.

Figure 44:
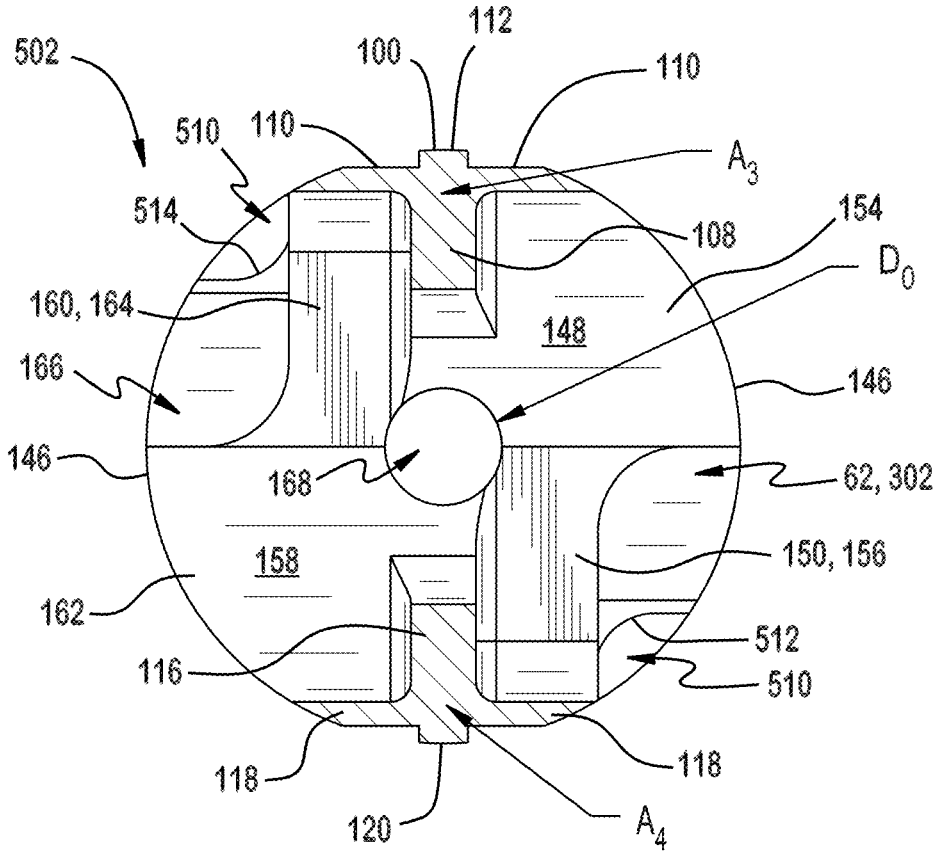
FIG. 44 is a cross-sectional view of the tube of FIG. 35, along line 44-44.
Figure 45:
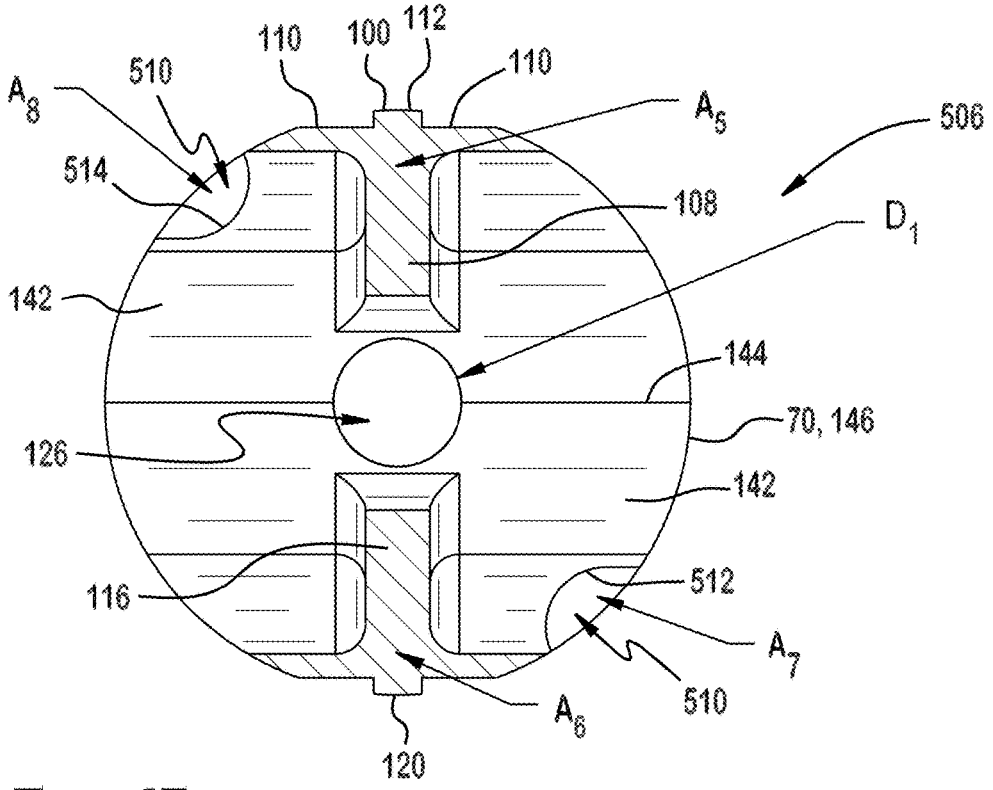
FIG. 45 is a cross-sectional view of the tube of FIG. 35, along line 45-45.
Figure 46:
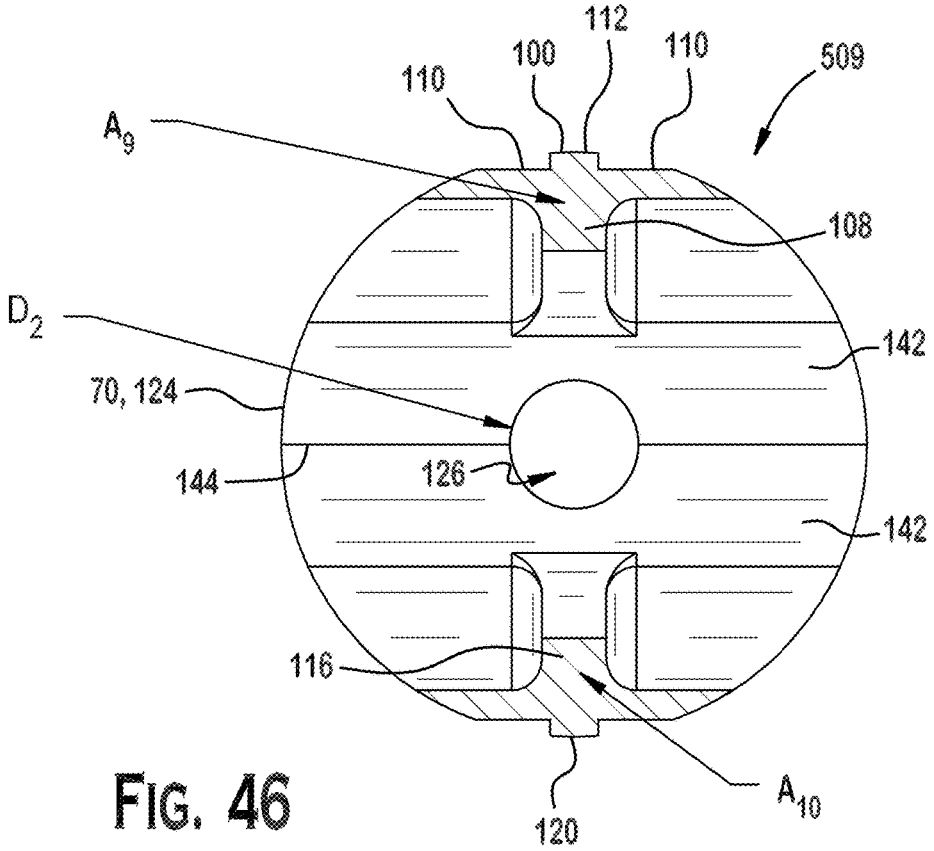
FIG. 46 is a cross-sectional view of the tube of FIG. 35, along line 46-46.

Accordingly, as shown in FIG. 35 and FIG. 44, the respective beam portions 108, 116 may have a greater depth, and thus extend closer to the aperture 168 of the self-torquing feature 502 (62, 302). Compare e.g., FIG. 5, FIG. 15, and FIG. 25. More particularly, referring to FIG. 44, the respective beam portions 108, 116 may include a cross-sectional area A3, A4 of approximately 0.128 square inches. Referring to FIG. 45, the beam portion 108, 116 may include a cross-sectional area A5, A6 of approximately 0.160 square inches. Referring to FIG. 46, the beam portion 108, 116 may include a cross-sectional area A9, A10 of approximately 0.120 square inches. Moreover, as shown in FIG. 35 and FIG. 45 the respective beam portions 108, 116 may also extend closer to the central axis 8 in the segment between the self-torquing feature 502 and the leading baffle 506. Id. Additionally, as shown in FIG. 35 and FIG. 46, the respective beam portions 108, 116 may also extend closer to the central axis 8 in the segment between the leading baffle 506 and the second baffle 508 of the array 20. See also, FIG. 36.

Figure 33:
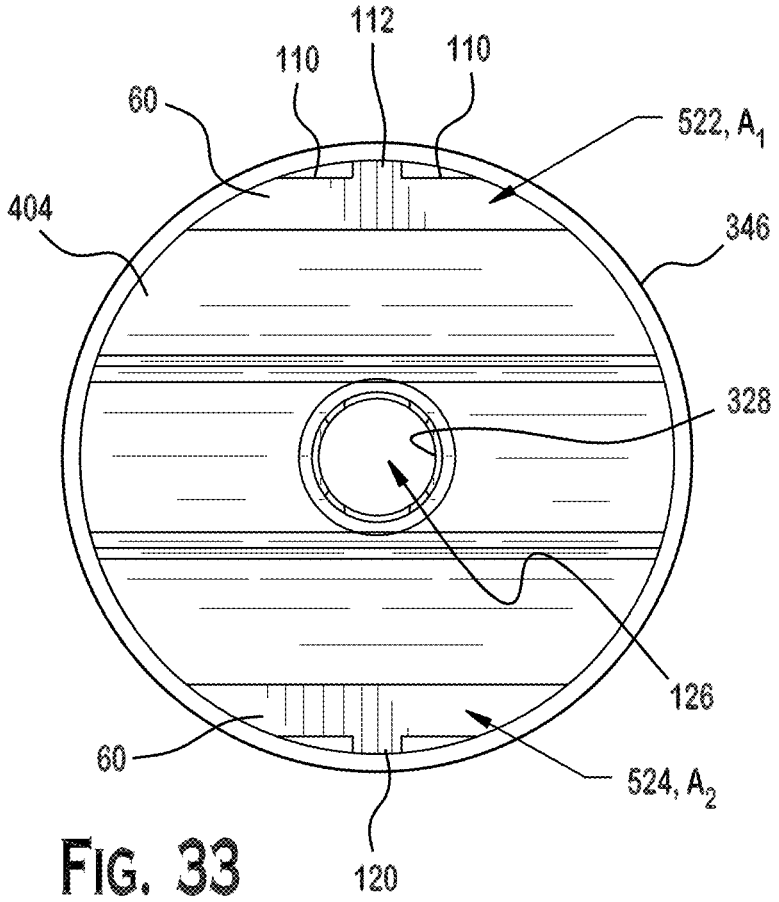
FIG. 33 is a front view of the core of the suppressor of FIG. 27.
Figure 37:
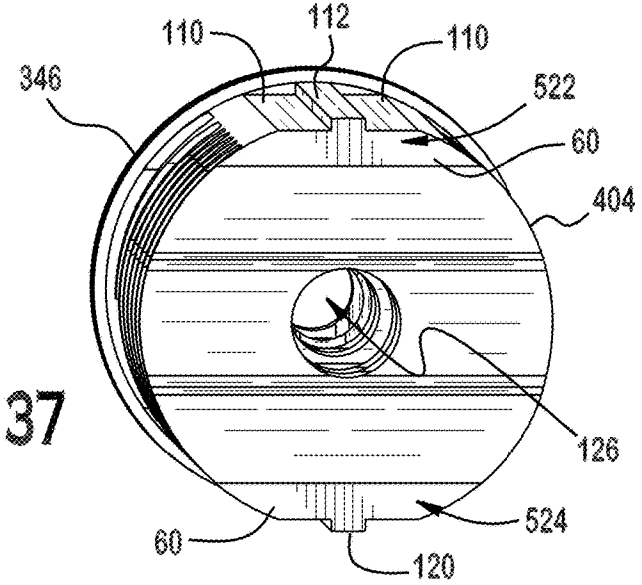
FIG. 37 is a front left side perspective view of the core of FIG. 33.
Figure 48:
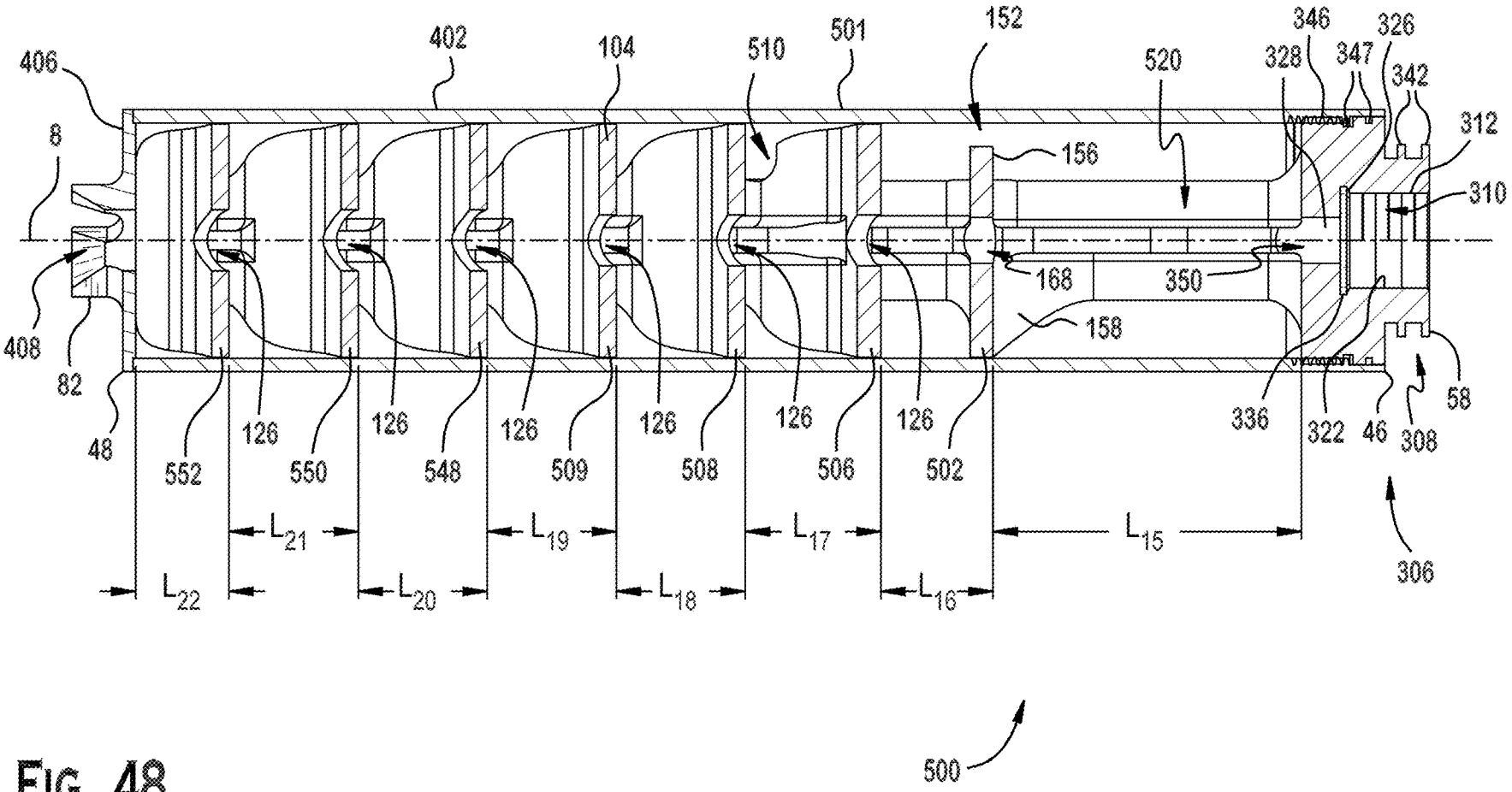
FIG. 48 is a cross-sectional view of the tube of FIG. 27, along line 48-48.

Referring to FIG. 31, FIG. 33, FIG. 39, and FIG. 41, the superior member 100 and the inferior member 102 may extend from the proximal end wall 314 to the distal end 60 of the core 501. Referring to FIG. 37 and FIG. 41, the distal faces of the superior member 100 and the inferior member 102 may be substantially planar and disposed perpendicular to the central axis 8, and thus form bearing surfaces 544, 546, as shown in FIG. 33. Each of the bearing surfaces 544, 546 may have an area A1, A2 of approximately 0.157 square inches. As shown in FIG. 47 and FIG. 48, the bearing surfaces A1, A2 of the superior member 100 and the inferior member 102 may each squarely contact the distal end wall 410 of the distal endcap 406 of the tube 402. Thus, after the core is telescopically received within the tube, connected to the tube with mating screw threads, and then tightened further with a torque wrench, the core and the tube may a form pre-stressed structure before the suppressor is subjected to any performance loads. This may further contribute to the suppressor's ability to operate effectively under service loads.

Additionally, the configuration of the core and tube may be adapted to reduce the likelihood of baffle strikes during operation. For instance, the size of the apertures in the core which provide a passage for a fired projectile to proceed through the suppressor may be enlarged gradually along the length of the suppressor. For example, referring to FIG. 41 the diameter DO of the aperture 168 of the self-torquing feature 502 (62,146) may be approximately 0.3600 inches (see e.g., FIG. 44), the diameters D1, D2, D3 of the three leading pressure modulation baffles 70 may be approximately 0.4000 inches (see e.g., FIG. 45), and the diameter D4, D5, D6 of the remaining baffles may be approximately 0.4800 inches (see e.g., FIG. 45).

TABLE 3

Exemplary Area Dimensions for Suppressor (500)

| Dimension | Description | Area (inches^2) | FIG. |
|---|---|---|---|
| A1 | Distal bearing surface, 100 | 0.1568 | 33 |
| A2 | Distal bearing surface, 102 | 0.1568 | 33 |
| A3 | Cross-sectional area, 100 | 0.1278 | 44 |
| A4 | Cross-sectional area, 102 | 0.1278 | 44 |
| A5 | Cross-sectional area, 100 | 0.1598 | 45 |
| A6 | Cross-sectional area, 102 | 0.1598 | 45 |
| A7 | Cross-sectional area: Jetting Relief Cut, 512 | 0.041 | 45 |
| A8 | Cross-sectional area: Jetting Relief Cut, 514 | 0.041 | 45 |
| A9 | Cross-sectional area, 100 | 0.1197 | 46 |
| A10 | Cross-sectional area, 102 | 0.1194 | 46 |

Figure 43:
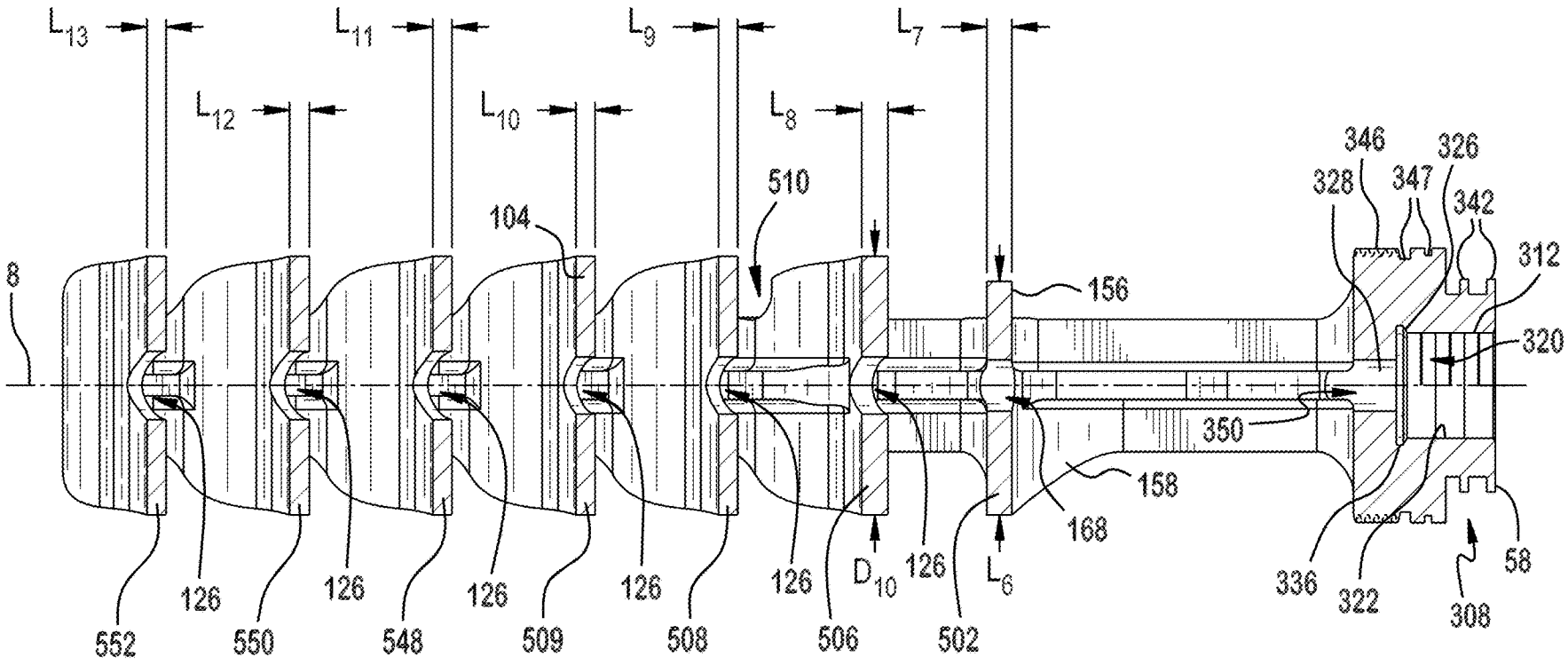
FIG. 43 is a cross-sectional view of the tube of FIG. 31, along line 43-43.

As shown in FIG. 43, the thickness of the partial transverse plates 146 which form the self-torquing feature 502 (62, 146) and the lead pressure modulation baffle 506 (70, 146) may be increased to provide a stronger sub-structure. For example, in the embodiment of FIG. 28, the minimum material thickness between the leading side and the trailing side of the self-torquing feature 502 (62, 146) and the lead pressure modulation baffle 506 (70, 146) may be approximately 0.177 inches and 0.124 inches, respectively. Accordingly, the minimum material thickness of the self-torquing feature 502 (62, 146) may be approximately 40-percent greater than the minimal material thickness of the lead pressure modulation baffle 506 (70, 146). Exemplary dimensions for the thickness and spacing of the self-torquing feature and baffles, as well as for the baffle space are provided in Table 1.

Figure 54:
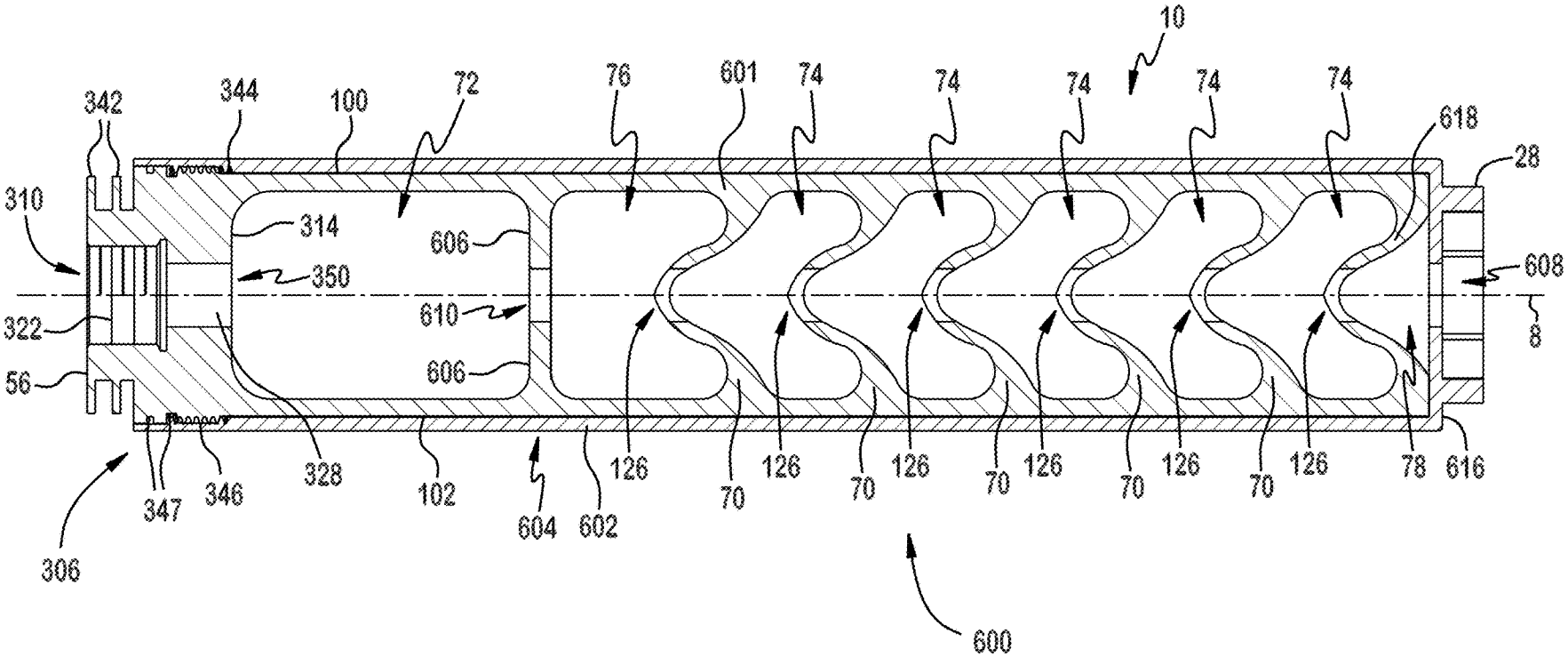
FIG. 54 is a cross-sectional view of the suppressor of FIG. 51, along line 54-54.

Referring to FIG. 32, the leading baffle 506 may include a jetting relief cut 510 opposite the self-torquing feature 502 (62, 146) to relive pressure and heat. For example, as shown in FIG. 40, FIG. 47, and FIG. 54, the lead pressure modulation baffle 506 (70, 146) may include a first notch 512 in the transverse plate opposite the void 154 of the first static vane 148. Additionally, the lead pressure modulation baffle 506 (70, 146) may include a second notch 514 (not shown) in the transverse plate opposite the void 166 of the second static vane 158. The first notch 512 may be disposed in the inferior concave segment 140 of the lead pressure modulation baffle 506 (70, 146). The second notch 514 may be disposed in the superior concave segment 138 of the lead pressure modulation baffle 506 (70, 146). The first notch 512 and the second notch 514 may be substantially the same size.

Referring to FIG. 45 and FIG. 48, the first notch 512 in combination with the tube 402 may define a first jetting relief cut area A8 perpendicular to the longitudinal axis of the core of approximately 0.04 square inches. The second notch 514 in combination with the tube 402 may define a second jetting relief cut area A7 perpendicular to the longitudinal axis of the core of approximately 0.04 square inches. Additionally, the surface area of the lead pressure modulation baffle 506 (70, 146) may be approximately 2.64 square inches. The ratio of the first jetting relief cut area A8 divided by the surface area of the lead pressure modulation baffle 506 (70, 146) may be approximately 0.015. The ratio of the sum of the first jetting relief cut area A8 and the second jetting relief cut area A7 divided by the surface area of the lead pressure modulation baffle 506 (70, 146) may be approximately 0.030.

TABLE 4

Exemplary Chamber and Control Volumes for Suppressor (500)

| Dimension | Description | Volume (inches^3) | FIG. |
|---|---|---|---|
| V0 | Blast chamber (520) | 5.42 | 47 |
| V1 | Transition chamber 1 | 2.22 | 47 |
| V2 | Pressure modulation chamber 1 | 1.89 | 47 |
| V3 | Pressure modulation chamber 2 | 1.98 | 47 |
| V4 | Pressure modulation chamber 3 | 2.00 | 47 |
| V5 | Pressure modulation chamber 4 | 2.00 | 47 |
| V6 | Pressure modulation chamber 5 - exit chamber | 2.00 | 47 |
| V7 | Transition chamber 2 | 0.67 | 47 |
| V8 | Control volume 1 (a) | 24.03 | 47 |
| V9 | Control volume 2 (b) | 18.88 | 47 |

Notes:
(a) Internal volume of tube between distal endwall (410) and proximal end wall (314);
(b) Volume of core between distal endwall (410) and proximal endwall (314).

Referring to FIG. 47, the tube 402, the proximal end wall 314, the first static vane 148, and the second static vane 158 may define a blast chamber 520. The tube 402, the trailing pressure modulation baffle 70, 124, and the exit baffle 404, 124 may define an exit chamber 522. The blast chamber 520 may possess a blast chamber volume V0 of approximately 5.42 cubic inches, and the exit chamber 522 may include an exit chamber volume V6 of approximately 2.00 cubic inches. The ratio of the exit chamber volume divided by the blast chamber volume (V6/V0) may be approximately 0.37.

Additionally, inter-baffle chamber volumes are identified in FIG. 47. Exemplary chamber volumes for the suppressor are presented in Table 4 (above). Also, the internal volume of the tube V8 (as calculated between the distal end wall and the proximal end wall), and the volume of the core V9 (as calculated within the control volume of the tube) are presented in Table 4 as well. Generally, the void ratio VR for a suppressor may be equal to the volume of the void space divided by the total volume [VR=((V8−V9)/V8)]. In this embodiment, the void ration of the suppressor is approximately 0.21.

Generally, the core 501 may be formed from a high temperature heat resistant alloy (e.g., 17-4 stainless steel), and further may include a high temperature heat resistant coating, including without limitation diffusional coatings, overlay coatings, or thermal barrier coatings (TBC). Also, the tube 402 may be formed from a high temperature heat resistant alloy (e.g., 17-4 Stainless Steel, Grade 9 6AL-4V Titanium), and further may include a high temperature heat resistant coating, including without limitation diffusional coatings, overlay coatings, or thermal barrier coatings (TBC). In a preferred embodiment, the core 501 and the tube 402 may be formed from heated treated 17-4 stainless steel, and the tube may be coated with Diamond Like Coating (DLC).

The preferred embodiment of a suppressor 500 disclosed in FIGS. 27-50 was subjected to performance evaluation. More particularly, the performance evaluation involved: (1) a sound abatement test; 2) a stress test; 3) a sound reduction degradation test; and 4) a thermal abatement test.

In the sound abatement test, a peak sound level measurement for a round fired through the suppressor was conducted in accordance with MIL-STD-1474D (12 Feb. 1997). More particularly, the suppressor 500 was secured to a M240L machine gun (short barrel chambered in 7.62×51 mm NATO) and peak sound level measurements were recorded at the shooter's left ear with a C-weighting on the meter. The sound meter was a Larson & Davis LXT sound meter used in "C" weighting. A first group of five rounds were fired at an interval of approximately 3-5 seconds. Peak sound level measurements were recorded for each of the rounds. Data from the initial test is presented in Table 5 (below). All the peak sound levels measurements from the first group (i.e., group 1) were less than 140.0 db. The average peak sound level measurement for group 1 being 136.98 dB.

After the initial sound abatement test, a stress test was conducted. In the stress test, 1,400 rounds were fired through the suppressor within a 24 hour period. Generally, this test evaluated the ability of the suppressed firearm to operate on demand for the duration of the testing. After the stress test, a second sound abatement test was conducted. Data for the second sound abatement test also are presented in Table 5. All the peak sound levels measurements from the second group (i.e., group 2) were less than 140.0 db. The average peak sound level measurement for group 2 being 137.20 dB.

TABLE 5

Peak Sound Level Measurement Data

| Group | Round | Peak Sound Level (dB) | Average PSL of Group (dB) | Average PSL Degradation |
|---|---|---|---|---|
| 1 | 1 | 138.3 | 136.98 | — |
| | 2 | 136.5 | | |
| | 3 | 136.5 | | |
| | 4 | 136.9 | | |
| | 5 | 136.7 | | |
| 2 | 1 | 139 | 137.20 | 0.0016 |
| | 2 | 136.8 | | |
| | 3 | 137.8 | | |
| | 4 | 135.2 | | |
| | 5 | 137.2 | | |

Note:
Average PSL Degradation = (Ave. PSL of Grp 2 − Ave. PSL of Grp 1)/Ave. PSL of Grp 1

After completion of these operational performance tests on the suppressor, a thermal abatement test was performed. The thermal abatement test involved recording temperature measurements of the suppressor at intervals of five minutes. Internal temperature measurements of the suppressor were recorded using a thermal probe inserted into the middle of the suppressor from the discharge port. A Fluke temperature probe and a Fluke 51-II thermometer were used to capture the interior temperature readings. Additionally, the external temperature of the suppressor was measured over the same 5 min intervals. The external temperature probe was a General IRT850K IR (infrared laser). The temperature measurements were recorded until the external temperature of the suppressor was less than 120 degrees Fahrenheit.

Data from the temperature decay test are presented in Table 6. Generally, the internal temperature measurements were greater than the exterior temperature measurements. The maximum internal temperature measurement recorded being approximately 1,275 degrees Fahrenheit. The maximum external temperature measurement recorded being approximately 1006 degrees Fahrenheit. The external temperature measurements of the suppressor fell below 120 degrees Fahrenheit after approximately 45 min.

TABLE 6

Temperature Decay Test Data

| Elapsed Time (Min) | Internal Temperature (° F.) | External Temperature (° F.) |
|---|---|---|
| 0 | 1275 | 1006 |
| 5 | 782.3 | 565.6 |
| 10 | 559.3 | 412.8 |
| 15 | 427.3 | 308.1 |
| 20 | 336.2 | 198.8 |
| 25 | 287.9 | 187.9 |
| 30 | 265.1 | 167.1 |
| 35 | 242.3 | 155 |
| 40 | 212.4 | 133 |
| 45 | 183.5 | 122 |
| 50 | 156.5 | 108.9 |

Figure 71:
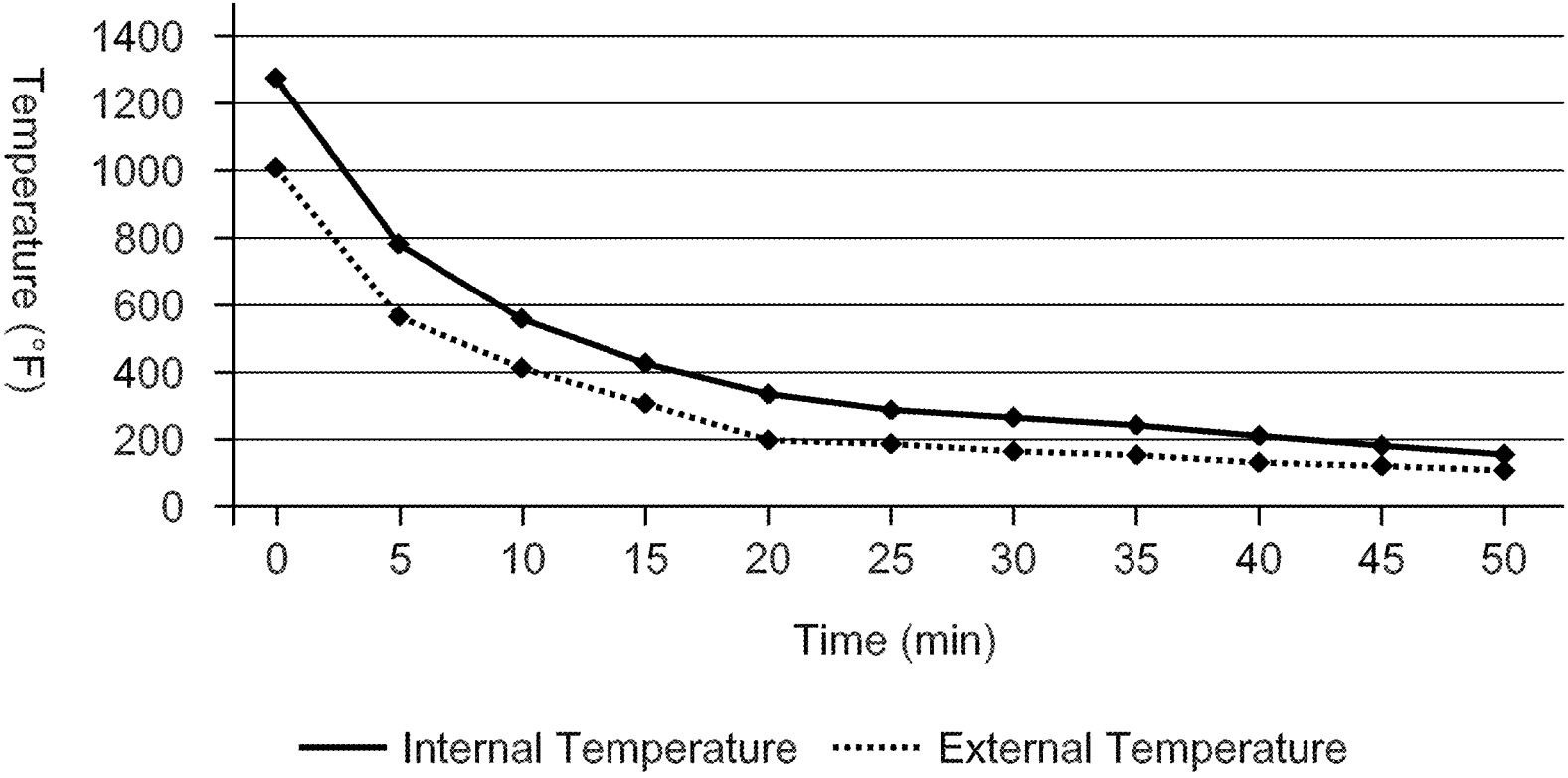
FIG. 71 is a graph of post stress test measurements of suppressor internal temperature and external temperature decay as a function of time.

FIG. 71 presents a graph of the data from Table 6. The rate of thermal abatement does not appear linear. Instead, generally three regions may be discerned from the data. In the first region, from approximately 0 minutes elapsed time to five minutes the temperature of the internal and dropped dramatically. This reduction in temperature is believed to have been predominately due to radiative heat loss. In the second region, from about 5 min elapsed time to about 20 minutes elapsed time, the rate of temperature reduction was more gradual. This reduction in temperature is believed to have been predominately due to convection processes and to a lesser extent radiative heat loss. The third region from about 20 minutes elapsed time to 40 minutes elapsed time, the rate of temperature reduction was more gradual still. This reduction in temperature is believed to have been due to convection processes.

Figure 51:
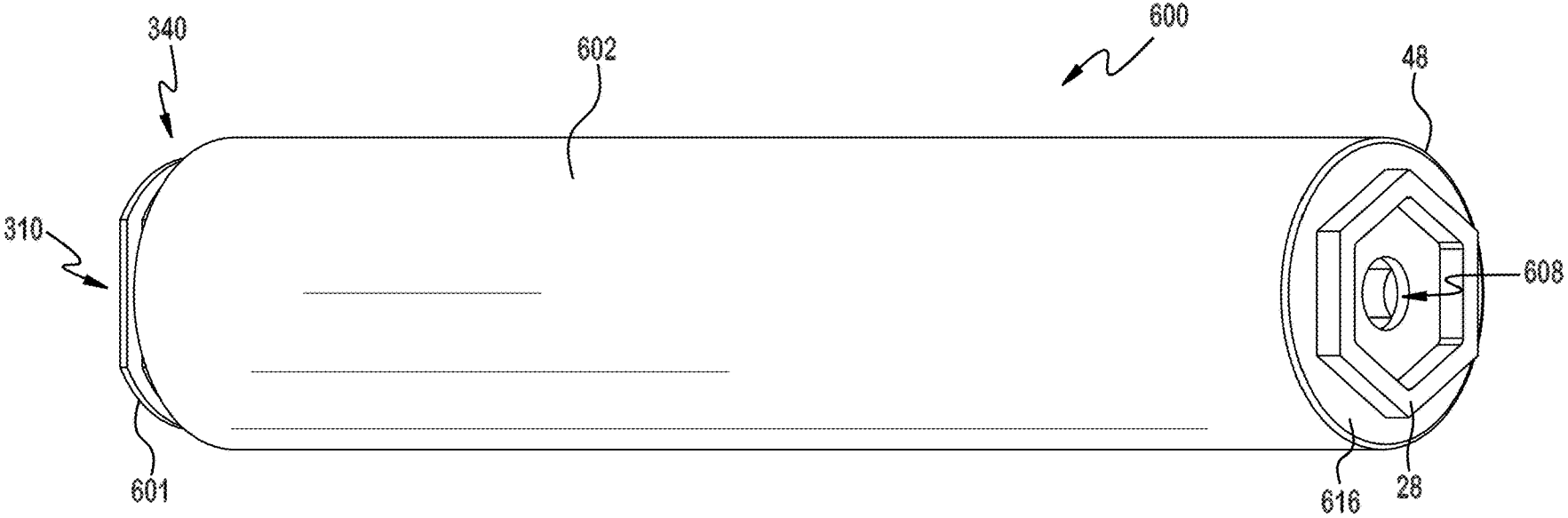
FIG. 51 is a front, left side perspective view of another embodiment of a suppressor.
Figure 52:
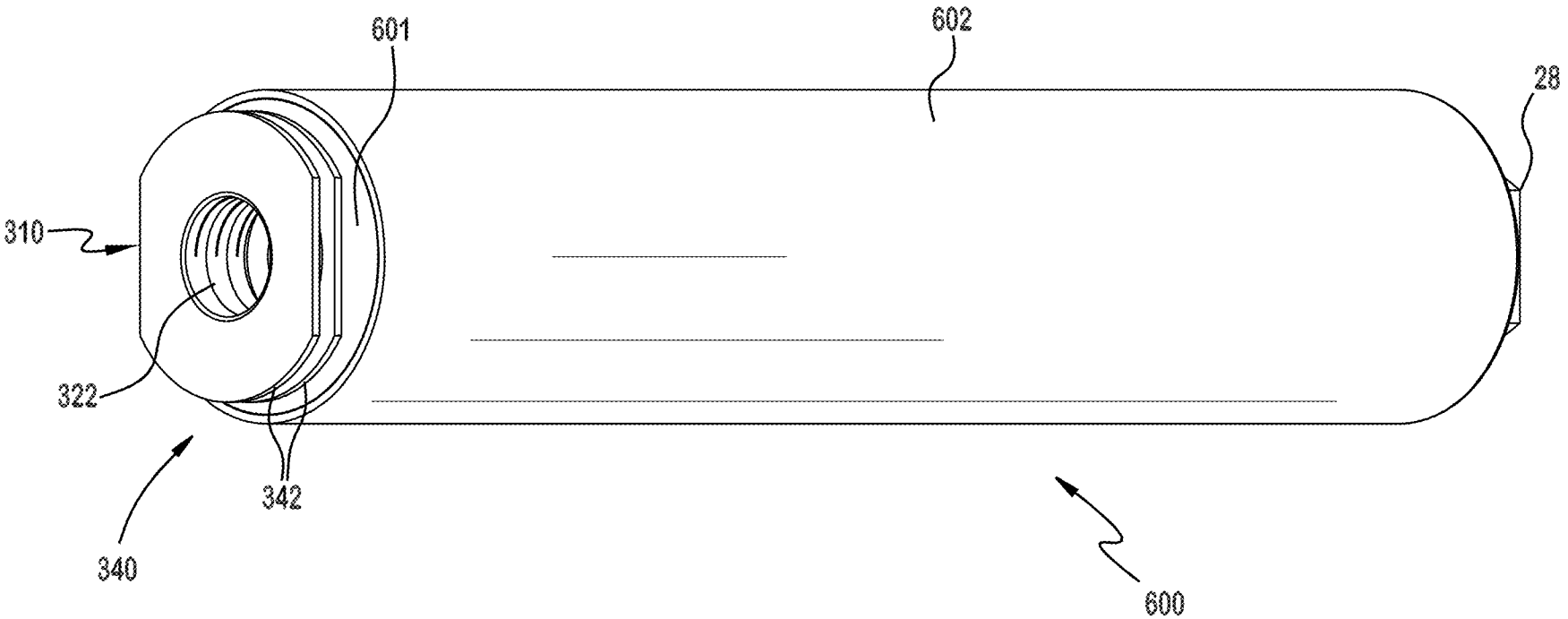
FIG. 52 is a rear left side perspective view of the suppressor of FIG. 51.
Figure 53:
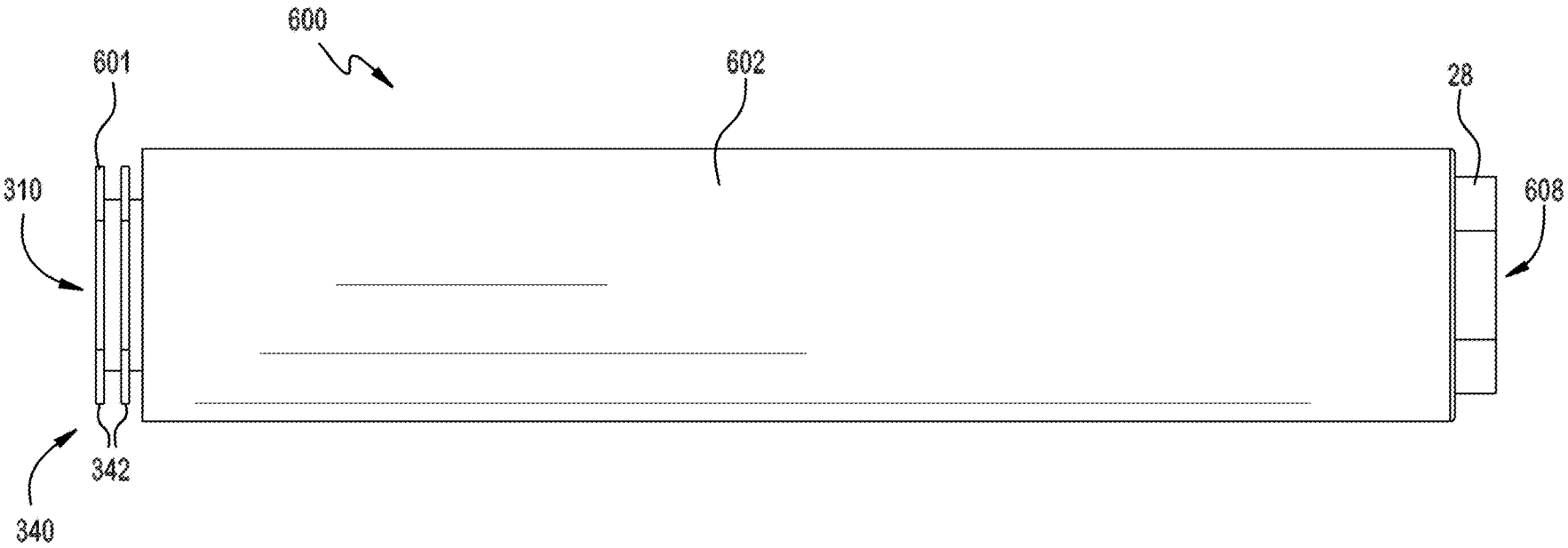
FIG. 53 is a left side view of the suppressor of FIG. 51, the right side view being a mirror image.
Figure 55:
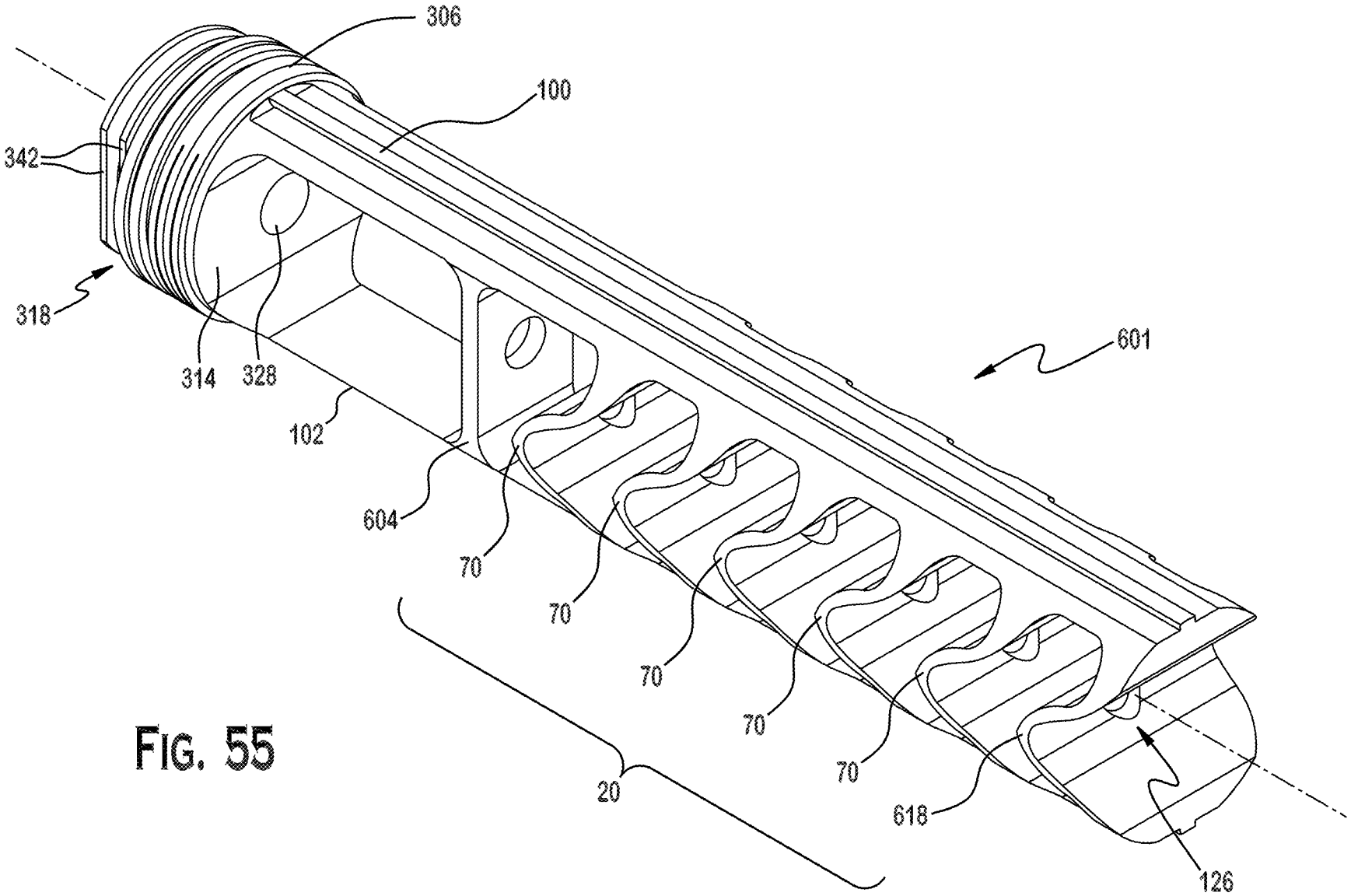
FIG. 55 is a front left side perspective view of the core of FIG. 54.
Figure 56:
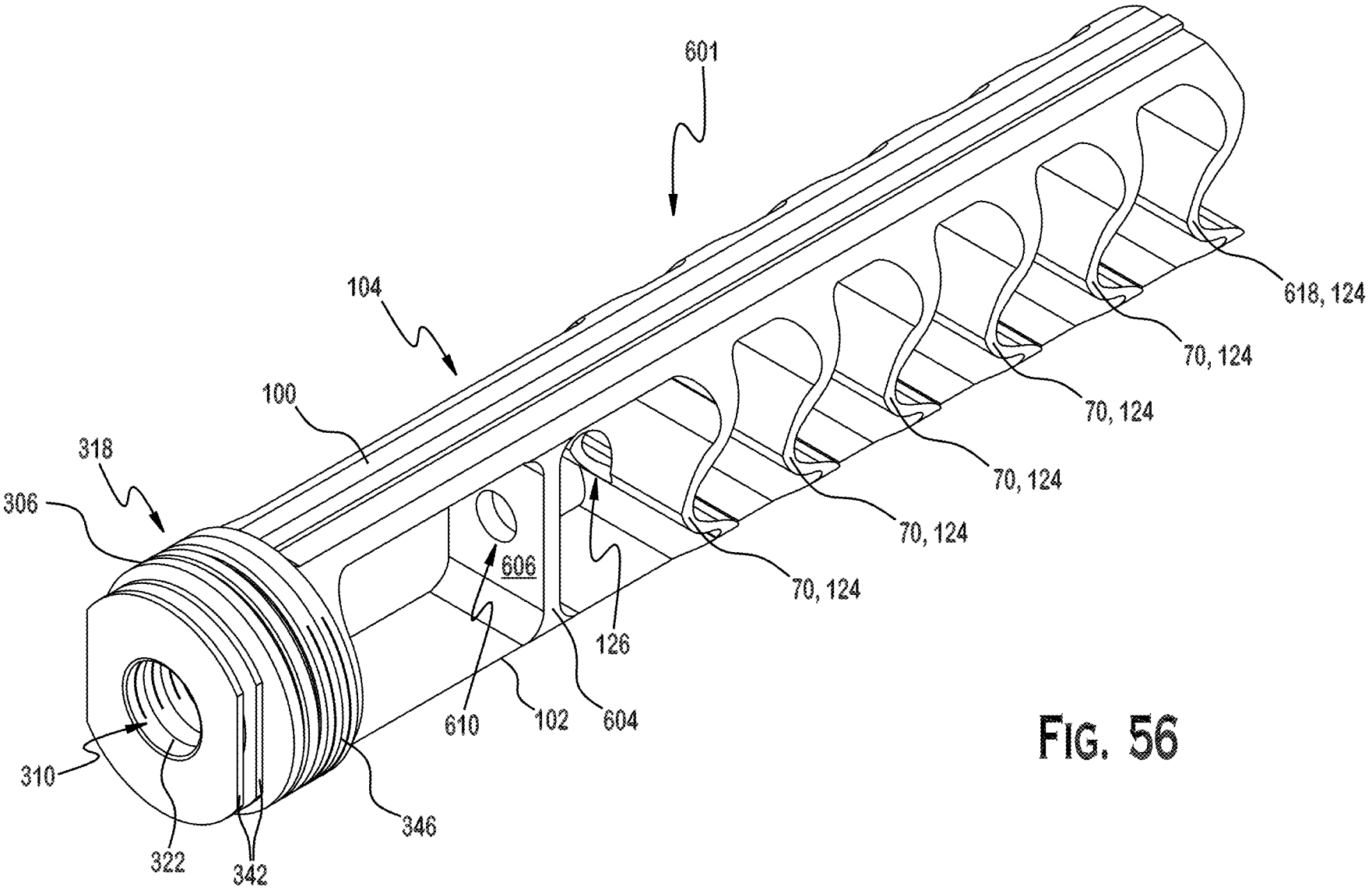
FIG. 56 is a rear left side perspective view of the core of FIG. 54.
Figure 57:
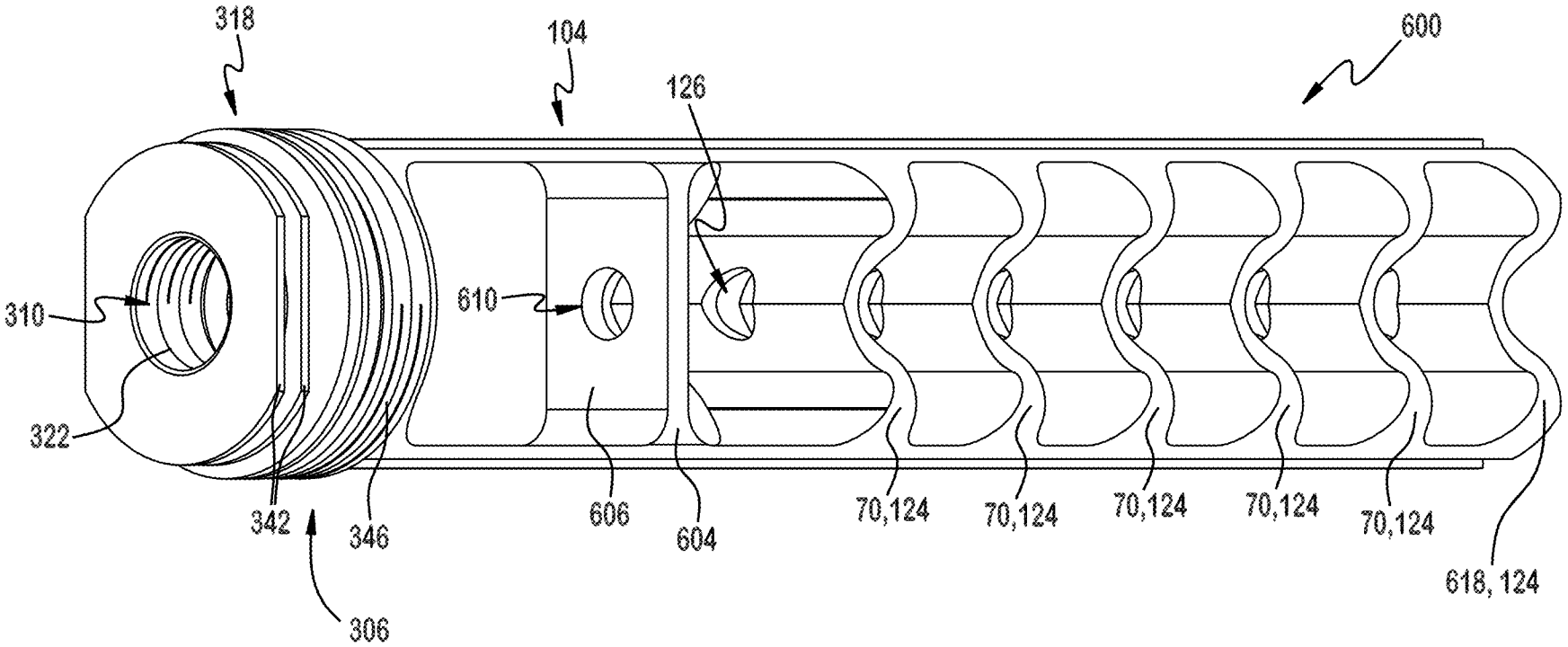
FIG. 57 is another rear left side perspective view of the core of FIG. 54.
Figure 58:
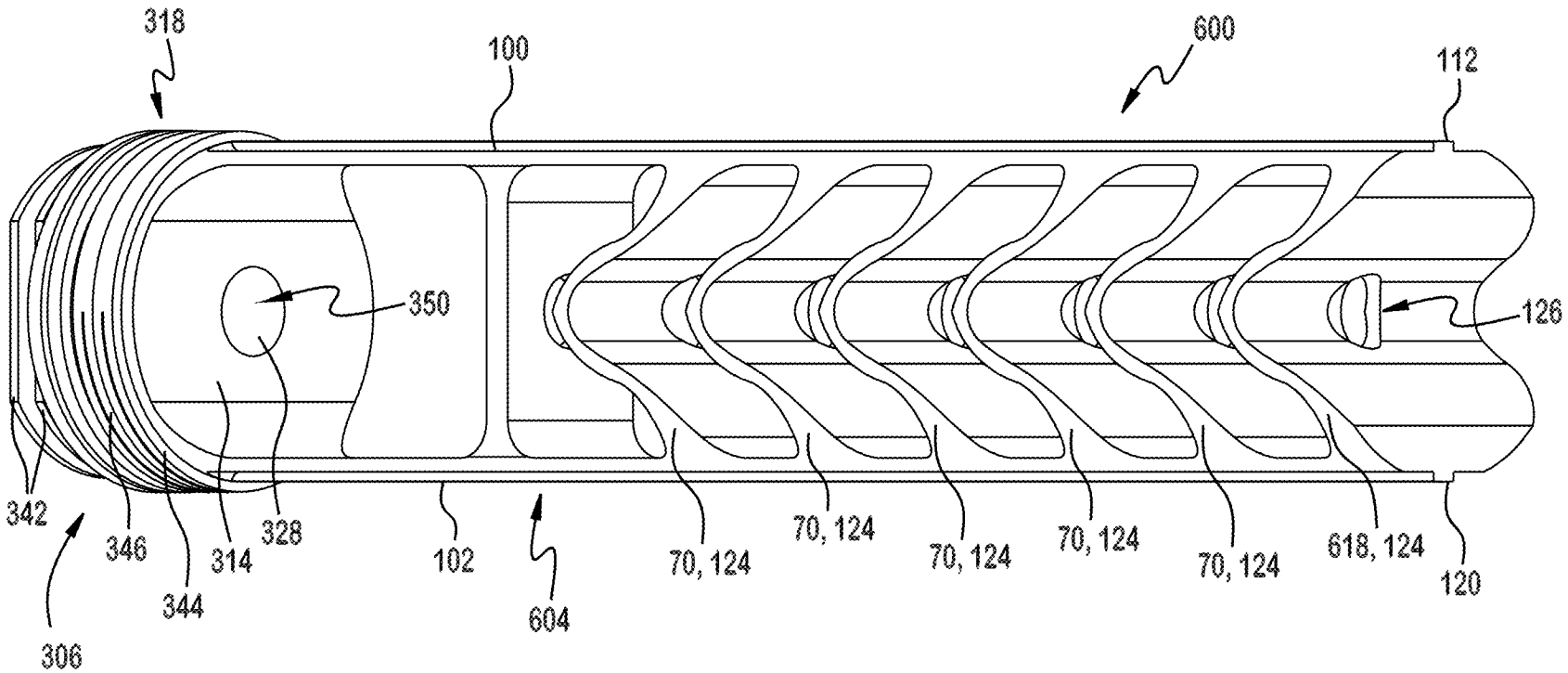
FIG. 58 is another front left side perspective view of the core of FIG. 54.
Figure 59:
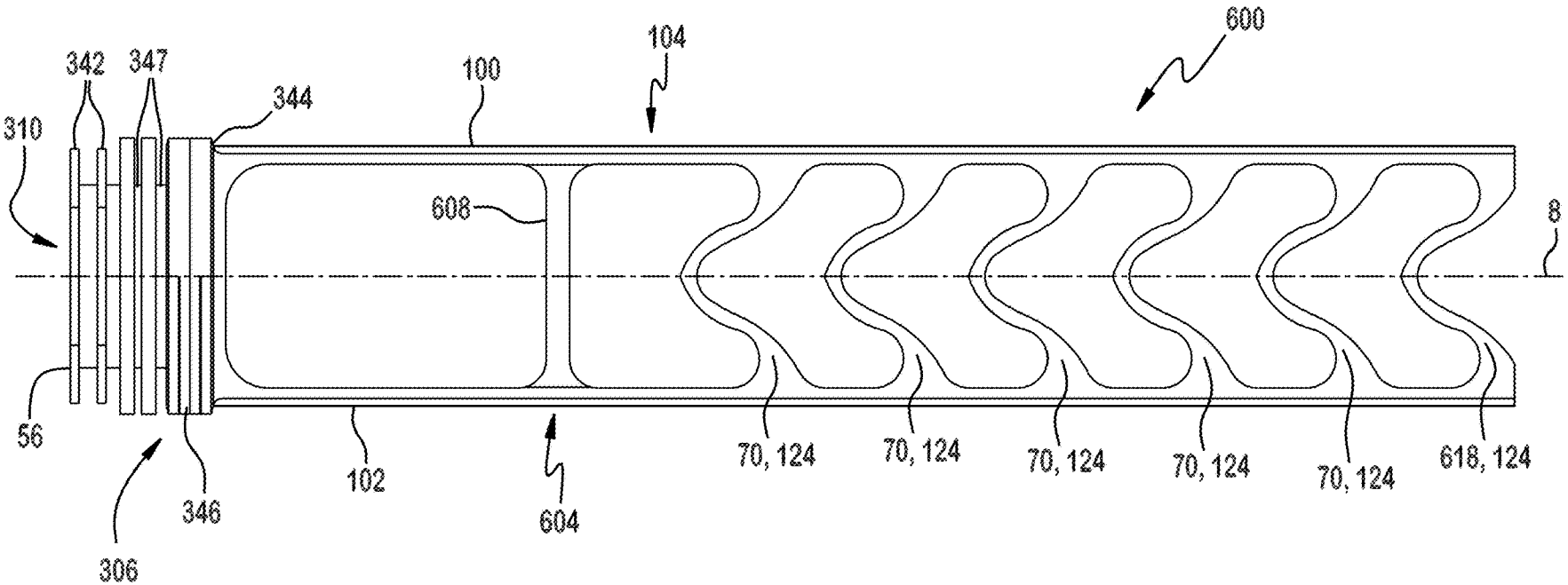
FIG. 59 is a left side view of the core of FIG. 54.
Figure 60:
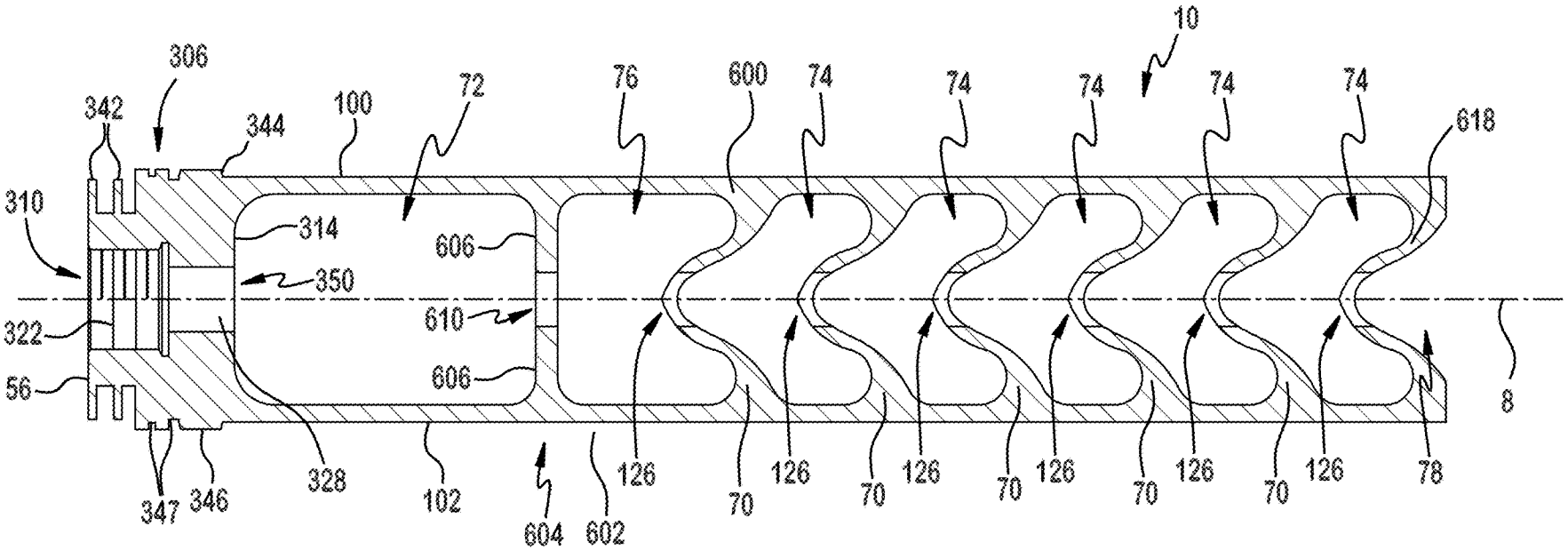
FIG. 60 is a cross-sectional view of the core of FIG. 59, along line 60-60.
Figure 61:
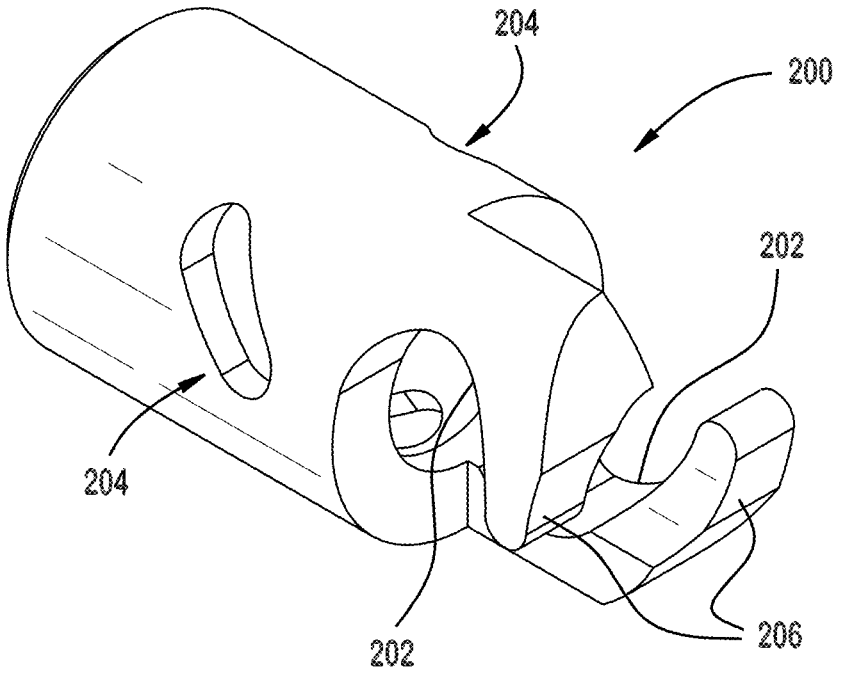
FIG. 61 is a perspective view of a self-torquing feature for a pistol.
Figure 62:
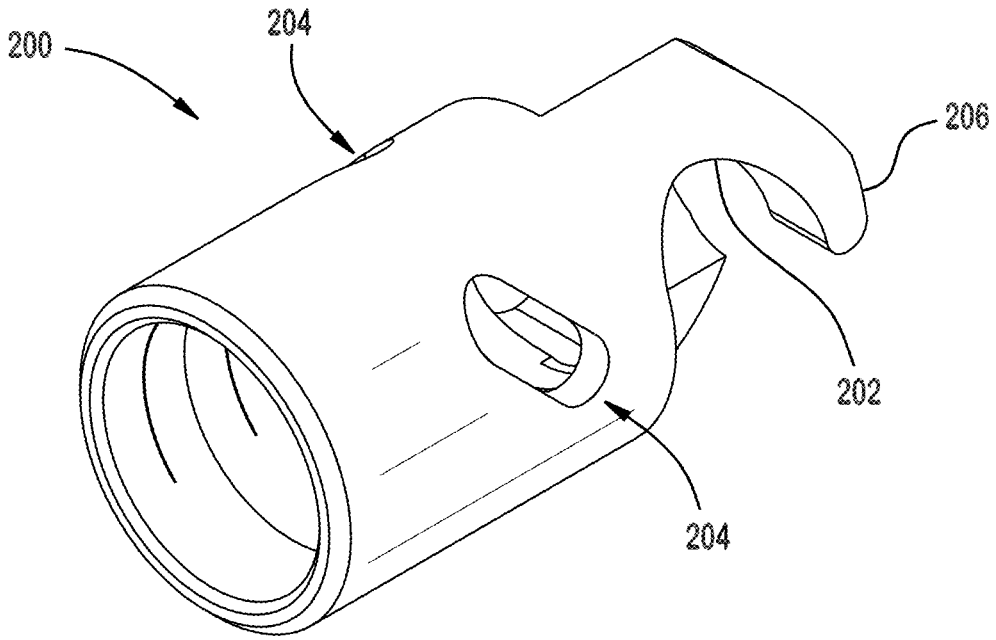
FIG. 62 is another perspective view of the self-torquing feature of FIG. 61.
Figure 63:
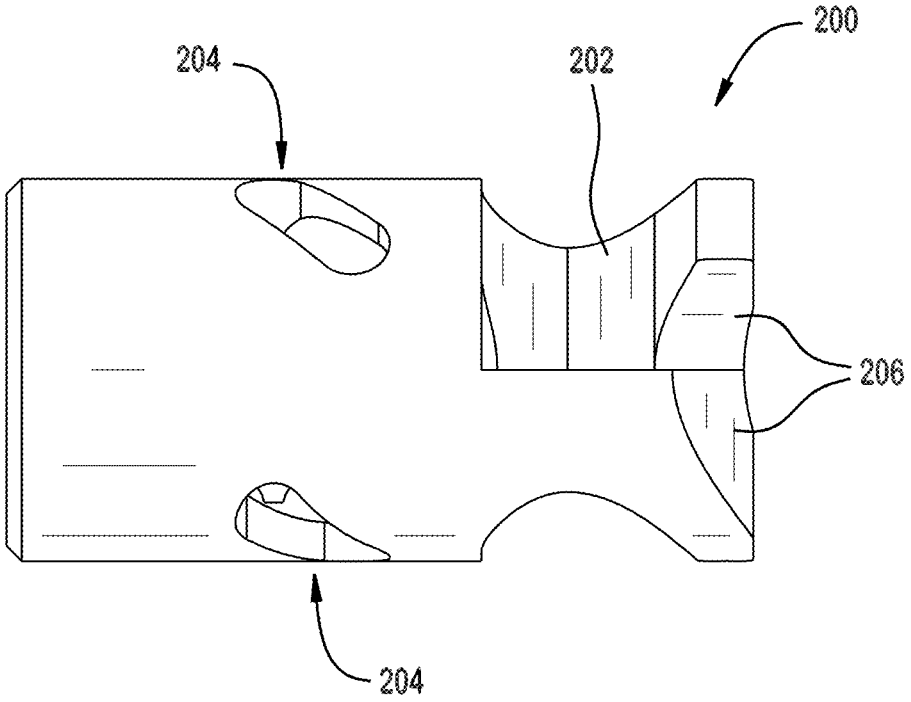
FIG. 63 is side view of the self-torquing feature of FIG. 61.
Figure 64:
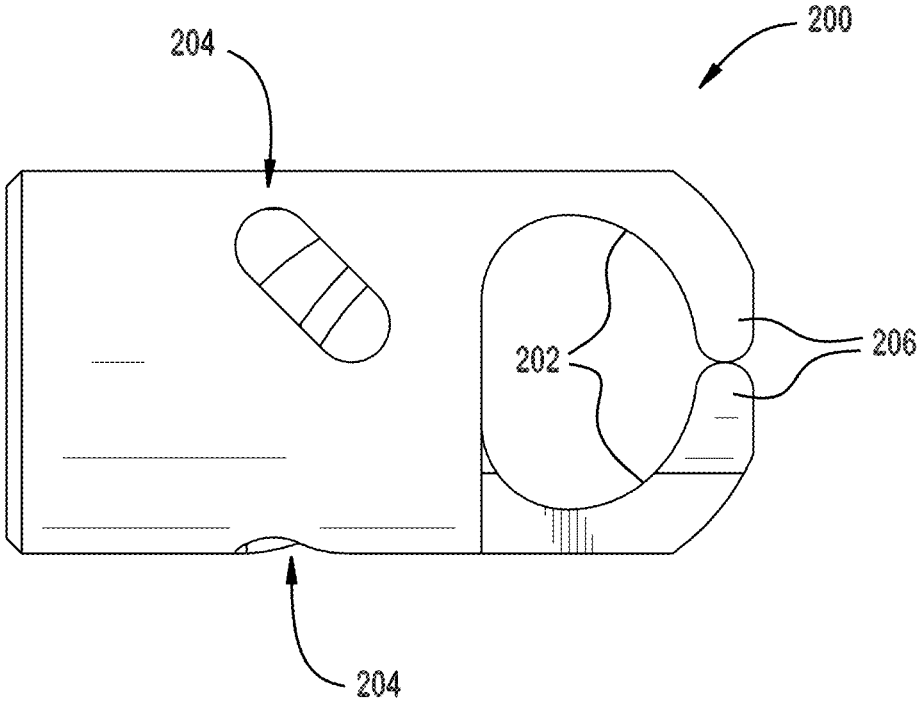
FIG. 64 is another side view of the self-torquing feature of FIG. 61.
Figure 65:
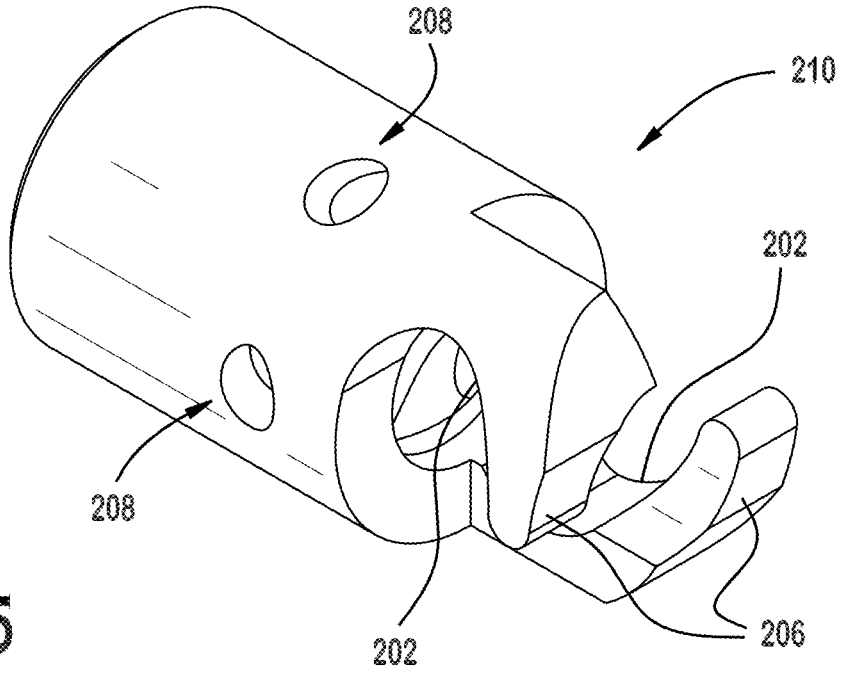
FIG. 65 is a perspective view of another self-torquing feature for a pistol.
Figure 66:
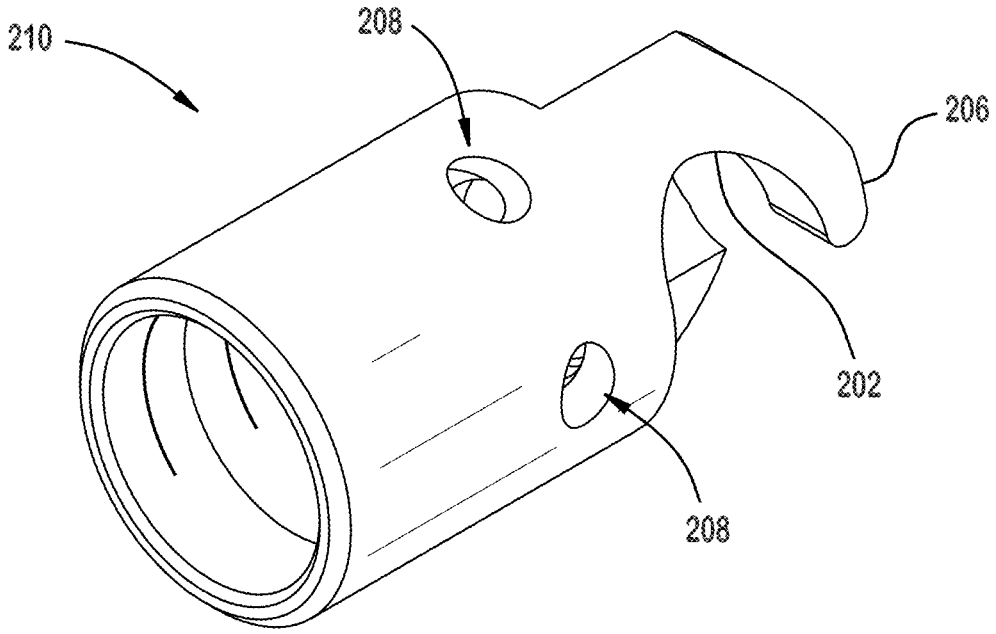
FIG. 66 is another perspective view of the self-torquing feature of FIG. 65.
Figure 67:
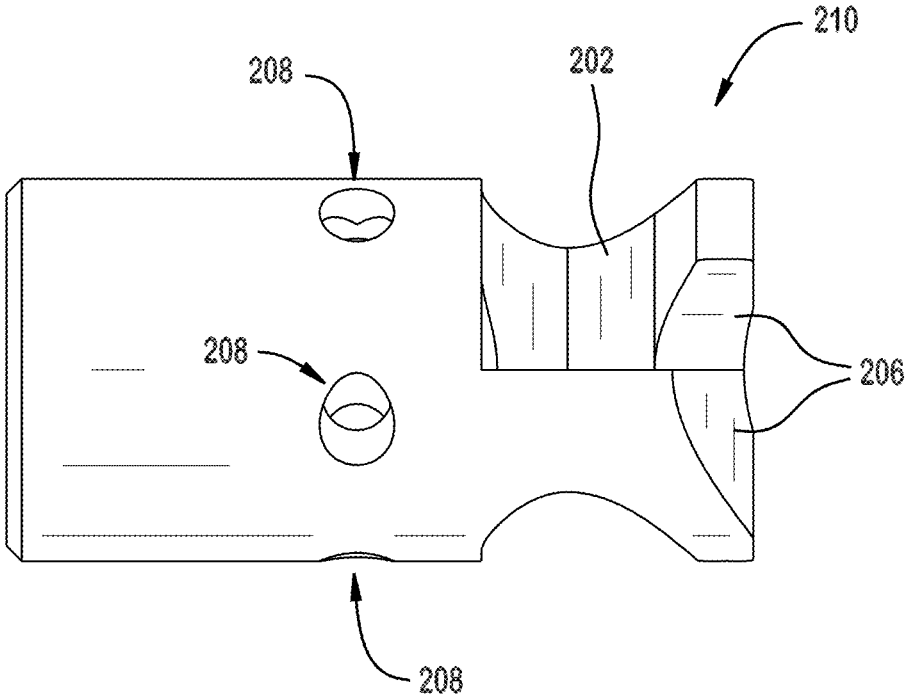
FIG. 67 is side view of the self-torquing feature of FIG. 65.
Figure 68:
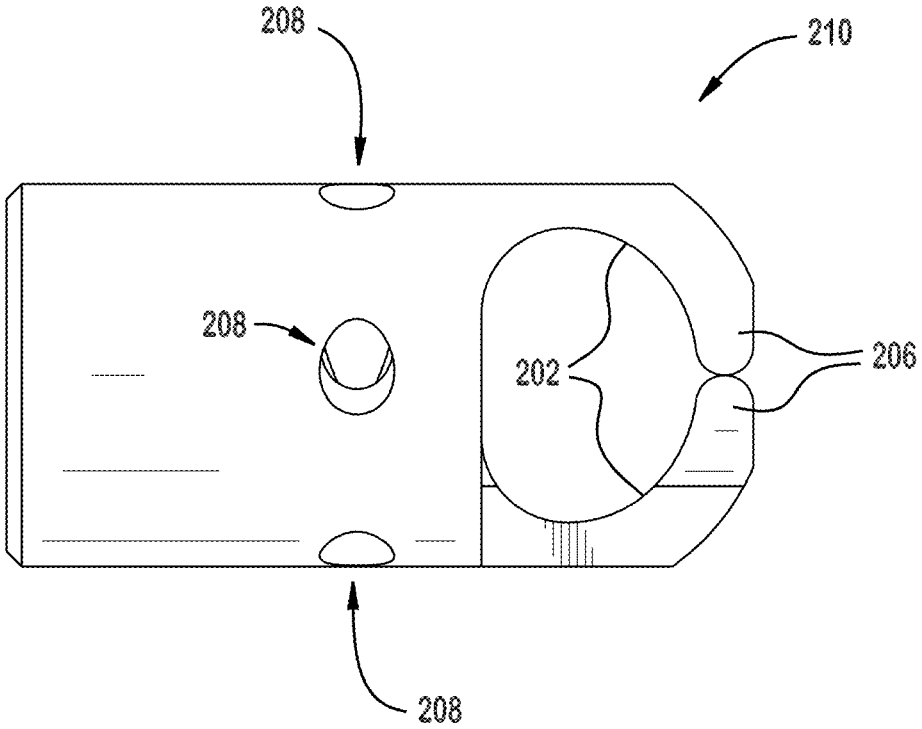
FIG. 68 is another side view of the self-torquing feature of FIG. 65.
Figure 69:
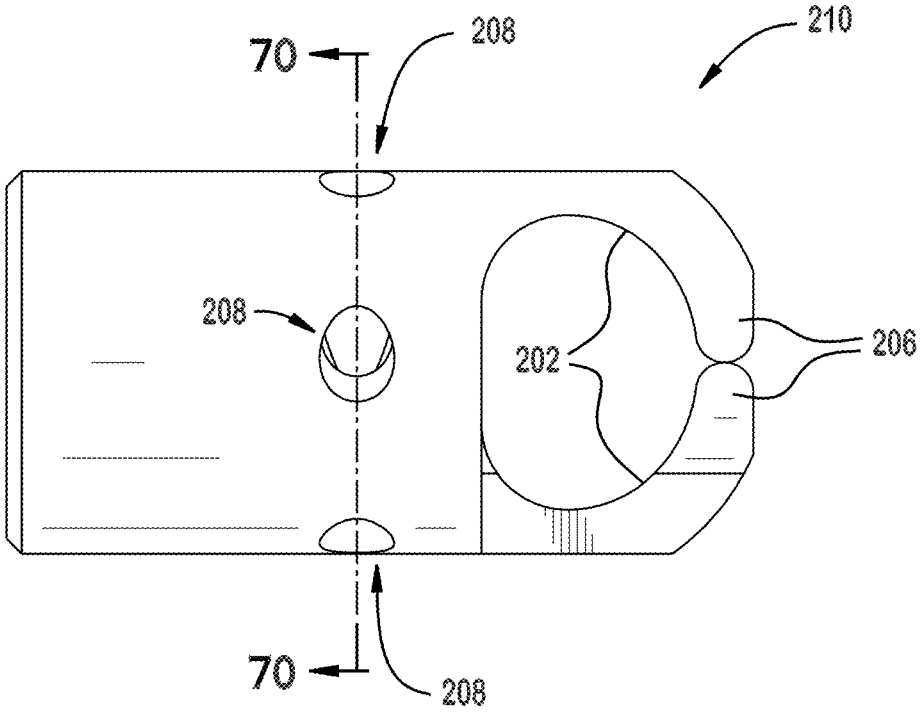
FIG. 69 is side view of the self-torquing feature of FIG. 65.
Figure 70:
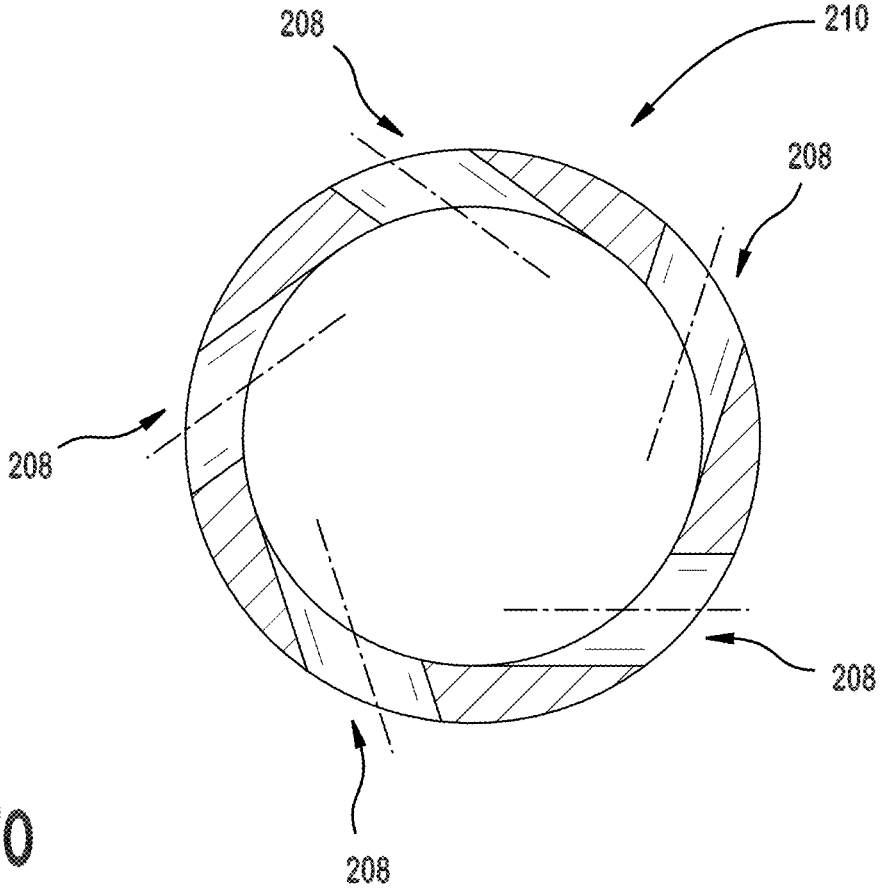
FIG. 70 is a cross-sectional view of the self-torquing feature of FIG. 69 along line 70-70.

Another embodiment of a suppressor is disclosed in FIGS. 51-60. Referring to FIG. 51, FIG. 52 and FIG. 53, the suppressor 600 may include a core 601 and a tube 602. The core 601 may be telescopically received in the tube. See e.g., FIG. 54. As shown in FIG. 55, FIG. 56, and FIG. 57, the core 601 may include a proximal end cap 306 and an array of baffles 20. More particularly, the array of baffles 20 may include a blast baffle 604, five pressure modulation baffles 70, and an exit baffle 618. The proximal end cap 306 may possess substantially the same features as in the embodiment of FIG. 20. Referring to FIG. 58, FIG. 59, and FIG. 60, the blast baffle 604 may be positioned between the proximal end wall 314 and the baffle array 20. The blast baffle 604 may include a planar surface 606 (see, FIG. 60). The planar surface(s) 606 may be disposed perpendicular to the central axis 8 of the barrel receiving opening 96 and the discharge port 608. Additionally, the blast baffle 604 may include an aperture 610 that is aligned with the central axis 8 of the discharge port 608. The aperture 610 may have circular shape. The bore 328 and the aperture 604 may have a diameter of approximately 0.400 inches. The blast baffle 604 may be spaced approximately 6.5 inches from the proximal end wall. The distance between the blast baffle 604 and the leading end of the first baffle 70 may be approximately 0.85 inches.

Referring to FIG. 55 and FIG. 56 the planar surface 606 may be bounded on two sides by voids which in combination with the inner surface of the tube 602 may form two vents 614. The surface area of the planar surface 506 may be approximately 2.47 square inches. The surface area of each vent 614 may be approximately 0.448 square inches. The ratio of the surface area of the vents 614 divided by the surface area of the planar surface 506 may be approximately 0.36. The configuration, dimensions, and spacing of the baffle array 20 may be substantially the same as in the core 100 of FIG. 2 and the core 300 of FIG. 13. The distal endcap and discharge port, however, may be part of the tube. As previously described, the core may be telescopically received in the tube and secured by mating screw threads on the outer surface 346 of the sidewall 344 and the inner surface of the tube, respectively. As previously described (above), the first segment of the core may be pinned to the barrel.

Referring to FIG. 61, FIG. 62, FIG. 63, and FIG. 64, in another embodiment a self-torquing feature 200 intended for a pistol suppressor may include a pair of control surfaces 202, as well as a radial pattern of angled cuts 204 that generally serve the same function as the partial transverse plate of fractional frame web 146. The pair of control surfaces 202 may include an interior lateral facet 206 which allows a bullet to pass between the pair of control surfaces 202. This embodiment of a self-torquing feature 200 may be incorporated on to a Nielsen device.

Referring to FIG. 65, FIG. 66, FIG. 67, FIG. 68, FIG. 69, and FIG. 70, in another embodiment intended for a pistol suppressor may include a pair of control surfaces 202, as well as a radial pattern of holes 208 cut from the outer diameter to the inner diameter. The holes 208 are centered off center from the axial center. In use, as exhaust gasses escape these holes 208, Newton's second/third law says that momentum is conserved, and an equal and opposite force may be applied to the self-torquing feature 210. That radial force may be a torque. The torque applied may be in the form of an impulse that occurs with each firing of the weapon. This embodiment of a self-torquing feature 210 may be incorporated on to a Nielsen device.

In use, a suppressor may be secured to the barrel of a firearm. During operation of the firearm, an ammunition cartridge (e.g., 7.62×51 mm NATO) may be fired. The discharge gases from the ammunition cartridge may propel the bullet (or projectile) through the bore and out the muzzle of the firearm. The bullet, traveling in a ballistic trajectory, may pass through the suppressor (e.g., the bore, the aperture in the self-torquing feature, the apertures in the pressure modulation baffles, the aperture in the quarter-baffle, and the discharge port) before exiting the suppressor, traveling down range, and striking a target. The discharge gases also may enter the suppressor. The expanding discharge gases may enter the blast chamber adjacent to the proximal end wall of the core.

The control surfaces of the self-torquing feature may deflect and direct the flow of expanding discharge gases to adjacent vents that fluidly connect the blast chamber to an intermediate (or transition) chamber. More particularly, the curved control surfaces may direct discharge gas flow from moving in a generally longitudinal direction to moving in a generally vertical direction. For example, the first curved surface may direct the discharge gas flow toward the inferior longitudinal member and to the adjacent void space that vents the discharge gasses to the adjacent transition chamber. Additionally, the second curved surface may direct the discharge gas flow toward the superior longitudinal member and to the adjacent void space that vents the discharge gas flow to transition chamber.

Redirecting the gas flow downward to the first void space may generate a first opposing force on the first control surface. The first opposing force may create a first moment about the central axis of the suppressor. Similarly, redirecting gas flow upward to the second void space may create a second opposing force on the second control surface. The second opposing force may create a second moment about the central axis of the suppressor. The first and second moments may create a couple which torques the suppressor about the central axis. The applied torque may stabilize and secure the muzzle-suppressor interface by keeping the threaded connection from loosening or stripping.

After entering the transition chamber, the discharge gasses may be directed sequentially through five pressure modulation baffles and the four respective pressure modulation chambers between them. Then the discharge gasses may pass through the quarter-baffle. Discharge gases may then exit the suppressor through the discharge port and any other vents that are in fluid communication with the boreway.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, the self-torquing feature may be incorporated into other suppressor apparatus. More particularly, the self-torquing feature maybe modified for use in other suppressor and muzzle booster configurations. Moreover, features and or elements from any disclosed embodiment may be used singly or in combination with other embodiments. Therefore, it is intended that this invention not be limited to the features disclosed herein, but that the invention include all embodiments falling within the scope and the spirit of the present disclosure.

What is claimed is:

1. A suppressor for a firearm comprising:

a core having a first longitudinal axis, the core comprising
- a first proximal end,
- a first distal end spaced from the first proximal end along the first longitudinal axis, and
- a first end cap disposed adjacent to the first proximal end, the first end cap comprises
  - a proximal end wall,
- an opening for receiving a barrel of a firearm, the opening extending from the first proximal end to a first interior end wall, the first interior end wall being disposed between the first proximal end and the proximal end wall,
- a bore which is aligned with the first longitudinal axis, the bore extending from the first interior end wall to the proximal end wall,
- a first static vane spaced from the proximal end wall along the first longitudinal axis, the first static vane being disposed opposite the proximal end wall, and
- an array of baffles aligned with the bore, the array of baffles being arranged between the first static vane and the distal end.

2. The suppressor of claim 1, further comprising a tube, the tube being arranged around the core.

3. The suppressor of claim 2, wherein the suppressor achieves a peak sound level measurement less than 140 dB measured left of an operator's ear in accordance with MIL-STD-1474-D.

4. The suppressor of claim 2, wherein the composition of the tube comprises a high temperature heat resistant alloy.

5. The suppressor of claim 4, wherein the high temperature heat resistant alloy is selected from the group consisting of 17-4 Stainless Steel and Grade 9 6AL-4V Titanium.

6. The suppressor of claim 4, wherein the high temperature heat resistant alloy is coated with Diamond Like Coating (DLC).

7. The suppressor of claim 6, wherein the high temperature heat resistant alloy is 17-4 stainless steel.

8. The suppressor of claim 1, wherein the first static vane comprises a first control surface for generating a moment torque about the first longitudinal axis.

9. The suppressor of claim 8, wherein the first control surface comprises a first curved surface segment, the first curved surface segment being concave with respect to the proximal end wall.

10. The suppressor of claim 9, wherein the first curved surface segment possesses constant curvature.

11. The suppressor of claim 9, wherein the first static vane further comprises a first proximal side, a first distal side, and a first planar segment abutting the first curved surface segment, the first curved surface segment and the first planar segment abutting a first void which extends from the first proximal side of the first static vane to the first distal side of the first static vane.

12. The suppressor of claim 11, wherein the first planar segment is transverse to the first longitudinal axis.

13. The suppressor of claim 12, wherein the first static vane is configured and dimensioned such that a torque is applied about the first longitudinal axis of the core as ammunition cartridge discharge gasses traverse the first curved surface segment and pass into the first void.

14. The suppressor of claim 12, wherein the array of baffles comprises a first baffle adjacent to the first static vane, the first baffle comprising an inferior concave segment and a first notch in the inferior concave segment, the first notch being disposed opposite to the first void.

15. The suppressor of claim 14, further comprising a second static vane abutting the first static vane, the second static vane comprising a second proximal side, a second distal side, a second curved surface segment, and a second planar segment abutting the second curved surface segment, the second curved surface segment and the second planar segment abutting a second void which extends from the second proximal side of the second static vane to the second distal side of the second static vane, and the first baffle further comprises a superior concave segment and a second notch in the superior concave segment, the second notch being disposed opposite to the second void.

16. The suppressor of claim 11, wherein the first curved surface segment has a first surface area, and the first planar segment has a second surface area.

17. The suppressor of claim 16, wherein the ratio of the first surface area divided by the second surface area is approximately 3.85.

18. The suppressor of claim 1, wherein the core further comprises a second static vane next to the first static vane.

19. The suppressor of claim 18, wherein the core further comprises a first aperture between the first static vane and the second static vane, the first aperture being aligned with the first longitudinal axis.

20. The suppressor of claim 19, wherein the first aperture comprises a first diameter and the bore comprises a second diameter, and the first diameter and the second diameter are substantially equal.

21. The suppressor of claim 20, wherein each baffle of the array of baffles further comprises a baffle aperture perpendicular to the first longitudinal axis, and each of the baffle apertures has a baffle array diameter, the baffle array diameter divided by the first diameter being approximately 1.2.

22. The suppressor of claim 21, wherein the baffle array diameter is approximately 0.480 inches.

23. The suppressor of claim 22, wherein the first diameter is approximately 0.400 inches.

24. The suppressor of claim 20, wherein a first plurality of baffles of the array of baffles further comprises a first baffle aperture perpendicular to the first longitudinal axis, and each of the first baffle apertures has a first baffle array diameter, the first baffle array diameter divided by the first diameter being approximately 1.1.

25. The suppressor of claim 24, wherein a second plurality of baffles of the array of baffles further comprises a second baffle aperture perpendicular to the first longitudinal axis, and each of the second baffle apertures has a second baffle array diameter, the second baffle array diameter divided by the first diameter being approximately 1.3.

26. The suppressor of claim 25, wherein the second baffle array diameter is approximately 0.480 inches.

27. The suppressor of claim 26, wherein the first diameter is approximately 0.360 inches.

28. The suppressor of claim 27, wherein the first baffle array diameter is approximately 0.400 inches.

29. The suppressor of claim 18, further comprising a tube arranged about the core, and the array of baffles comprises a trailing pressure modulation baffle and an exit baffle, wherein the tube, the proximal end wall, the first static vane, and the second static vane define a blast chamber, the tube, the trailing pressure modulation baffle, and the exit baffle defining an exit chamber, the blast chamber including a blast chamber volume and the exit chamber including an exit chamber volume, the ratio of the exit chamber volume divided by the blast chamber volume being approximately 0.37.

30. The suppressor of claim 29, wherein the blast chamber volume is approximately 5.42 cubic inches.

31. The suppressor of claim 30, wherein the exit chamber volume is approximately 2.00 cubic inches.

32. The suppressor of claim 1, wherein one of the array of baffles comprises a first jetting relief cut opposite the first static vane.

33. The suppressor of claim 32, wherein the one of the array of baffles comprises a second jetting relief cut.

34. The suppressor of claim 33, further comprising a tube, and the first jetting relief cut in combination with the tube forms a first jetting relief cut area, the second jetting relief cut in combination with the tube forms a second jetting relief cut area, and the one of the array of baffles comprises a surface area, the sum of the first jetting relief cut area and the second jetting relief cut area divided by the surface area defining a jet relief cut ratio of approximately 0.030.

35. The suppressor of claim 34, wherein the first jetting relief cut area is approximately 0.04 square inches.

36. The suppressor of claim 34, wherein the surface area is approximately 2.64 square inches.

37. The suppressor of claim 1, wherein the core further comprises a tubular body which projects from the proximal end wall, and which comprises one or more radial nozzle orifices in fluid communication with the bore.

38. The suppressor of claim 37, wherein the one or more radial nozzle orifices are configured and dimensioned to produce a torque about the first longitudinal axis of the core as ammunition cartridge discharge gasses traverse the bore and exit the tubular body via the one or more radial nozzle orifices.

39. The suppressor of claim 1, wherein the opening comprises a side wall, and the side wall comprises a screw thread such that the opening and the side wall are configured and dimensioned to mate with a barrel of an M240L/B machine gun.

40. A firearm apparatus comprising:

a suppressor as recited by claim 1;

a tube arranged around the core; and a firearm comprising a barrel, the barrel being received in the opening of the core.

41. The firearm apparatus of claim 40, wherein the firearm is a machine gun.

42. The firearm apparatus of claim 41, wherein the machine gun is an M240L machine gun.

43. The firearm apparatus of claim 42, wherein the suppressor achieves a peak sound level measurement less than 140 dB measured left of an operator's ear in accordance with MIL-STD-1474-D.

44. The firearm apparatus of claim 42, wherein the suppressor achieves an average peak sound level measurement of less than 140 dB measured left of an operator's ear in accordance with MIL-STD-1474-D after the firearm fires at least 1400 rounds of ammunition through the suppressor, and the average peak sound level measurement is determined from a group of five consecutive shots fired by the firearm through the suppressor.

45. The firearm apparatus of claim 42, wherein an internal temperature of the suppressor measures at least 1200 degrees Fahrenheit.

46. The firearm apparatus of claim 45, wherein an external temperature of the suppressor measures at least 1000 degrees Fahrenheit.

47. The firearm apparatus of claim 46, wherein the external temperature of the suppressor measures less than 120 degrees Fahrenheit less than 50 minutes after the internal temperature of the suppressor measures at least 1200 degrees Fahrenheit.

48. The suppressor of claim 1, wherein the composition of the core comprises a high temperature heat resistant alloy.

49. The suppressor of claim 48, wherein the high temperature heat resistant alloy is formed from 17-4 stainless steel.

50. The suppressor of claim 49, wherein the 17-4 stainless steel is heat treated.

* * * * *